US008029961B2

(12) United States Patent
Kuramoto et al.

(10) Patent No.: US 8,029,961 B2
(45) Date of Patent: Oct. 4, 2011

(54) TONER FOR DEVELOPING LATENT ELECTROSTATIC IMAGE, METHOD FOR PRODUCING THE SAME AND APPARATUS FOR PRODUCING THE SAME, AND DEVELOPER, TONER CONTAINER, PROCESS CARTRIDGE, IMAGE FORMING METHOD AND IMAGE FORMING APPARATUS

(75) Inventors: Shinichi Kuramoto, Numazu (JP); Shinji Ohtani, Shizuoka (JP); Yoshihiro Norikane, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 342 days.

(21) Appl. No.: 12/342,803

(22) Filed: Dec. 23, 2008

(65) Prior Publication Data

US 2009/0170018 A1 Jul. 2, 2009

(30) Foreign Application Priority Data

Dec. 28, 2007 (JP) ..... 2007-339380

(51) Int. Cl.
*G03G 9/087* (2006.01)

(52) U.S. Cl. ..... 430/109.1; 430/137.1

(58) Field of Classification Search ..... 430/109.1, 430/137.1
See application file for complete search history.

(56) References Cited

U.S. PATENT DOCUMENTS

| | | | | |
|---|---|---|---|---|
| 2004/0021017 | A1 | 2/2004 | Sumiyoshi et al. | |
| 2007/0059627 | A1* | 3/2007 | Fukui et al. | 430/110.3 |
| 2008/0241727 | A1 | 10/2008 | Norikane et al. | |
| 2008/0248416 | A1 | 10/2008 | Norikane et al. | |
| 2009/0162770 | A1* | 6/2009 | Sako et al. | 430/105 |
| 2009/0170019 | A1* | 7/2009 | Kuramoto et al. | 430/108.22 |

FOREIGN PATENT DOCUMENTS

| | | |
|---|---|---|
| JP | 52-30437 | 3/1977 |
| JP | 57-79961 | 5/1982 |
| JP | 60-112052 | 6/1985 |
| JP | 60-238847 | 11/1985 |
| JP | 62-245268 | 10/1987 |
| JP | 63-85644 | 4/1988 |
| JP | 1-147472 | 6/1989 |
| JP | 1-147476 | 6/1989 |
| JP | 1-161362 | 6/1989 |
| JP | 1-161363 | 6/1989 |
| JP | 1-161364 | 6/1989 |
| JP | 1-161365 | 6/1989 |
| JP | 1-164956 | 6/1989 |
| JP | 1-164957 | 6/1989 |
| JP | 1-164958 | 6/1989 |
| JP | 1-164959 | 6/1989 |
| JP | 1-173056 | 7/1989 |

(Continued)

*Primary Examiner* — Hoa Le

(74) *Attorney, Agent, or Firm* — Oblon, Spivak, McClelland, Maier & Neustadt, L.L.P.

(57) ABSTRACT

There is provided a toner for developing a latent electrostatic image, obtained by a method containing: ejecting a toner composition fluid from an ejection hole so as to make the toner composition fluid into droplets; and solidifying the droplets in an atomizing space so as to form solid particles, wherein the toner composition fluid contains at least a colorant formed by reacting a polymer containing 10 mol % or more of a monomer unit having a sulfonic acid group or a salt thereof, or a monomer unit having a sulfuric acid group or a salt thereof as a constitutional unit, and a basic dye.

13 Claims, 20 Drawing Sheets

FOREIGN PATENT DOCUMENTS

| | | |
|---|---|---|
| JP | 1-173057 | 7/1989 |
| JP | 1-173058 | 7/1989 |
| JP | 1-173059 | 7/1989 |
| JP | 1-173060 | 7/1989 |
| JP | 1-173064 | 7/1989 |
| JP | 1-173065 | 7/1989 |
| JP | 1-173066 | 7/1989 |
| JP | 1-173067 | 7/1989 |
| JP | 1-173068 | 7/1989 |
| JP | 2-2575 | 1/1990 |
| JP | 4-40467 | 2/1992 |
| JP | 7-152202 | 6/1995 |
| JP | 8-211655 | 8/1996 |
| JP | 3063269 | 5/2000 |
| JP | 3068654 | 5/2000 |
| JP | 3141783 | 12/2000 |
| JP | 2003-262976 | 9/2003 |
| JP | 2003-262977 | 9/2003 |
| JP | 2003-280236 | 10/2003 |
| JP | 2004-91560 | 3/2004 |
| JP | 2004-267918 | 9/2004 |
| JP | 2004-331946 | 11/2004 |
| JP | 2005-36220 | 2/2005 |
| JP | 2005-518278 | 6/2005 |
| JP | 2005-232443 | 9/2005 |
| JP | 2005-238342 | 9/2005 |
| JP | 2006-152103 | 6/2006 |
| JP | 2006-193681 | 7/2006 |
| JP | 2006-293320 | 10/2006 |
| JP | 2007-108731 | 4/2007 |

* cited by examiner

TONER FOR DEVELOPING LATENT ELECTROSTATIC IMAGE, METHOD FOR PRODUCING THE SAME AND APPARATUS FOR PRODUCING THE SAME, AND DEVELOPER, TONER CONTAINER, PROCESS CARTRIDGE, IMAGE FORMING METHOD AND IMAGE FORMING APPARATUS

BACKGROUND OF THE INVENTION

1. Field of the Invention

The present invention relates to a toner for developing latent electrostatic images formed by electrophotography, electrostatic recording, electrostatic printing, etc., method for producing the same, and apparatus for producing the same, and a developer, toner container, process cartridge, image forming method and image forming apparatus using such toner.

2. Description of the Related Art

The electrophotographic method generally contains a latent electrostatic image formation step in which a latent electrostatic image is formed on a photoconductor (hereinafter, also referred as a latent electrostatic image bearing member, image bearing member, electrophotographic photoconductor or the like) utilizing a photoconductive material by means of various means, a developing step in which the latent electrostatic image is developed with a toner so as to form a toner image, a transferring step in which the toner image is transferred to a recording medium such as paper, a fixing step in which the toner image transferred to the recording medium is fixed to the recording medium by heating, pressing, heating under pressure, applying a solvent vapor, or the like, a cleaning step in which the residual toner is removed from the photoconductor, and the like.

The developer for use in the electrophotography, electrostatic recording, electrostatic printing or the like is applied to an image bearing member such as a latent electrostatic image bearing member on which a latent electrostatic image is formed in the developing step, then transferred from the latent electrostatic image bearing member to a transfer medium such as a transfer paper in the transferring step. Thereafter, the developer is fixed onto a surface of the paper in the fixing step. As the developer for develop the latent electrostatic image formed on the latent electrostatic image bearing member, a two-component developer comprised of a carrier and a toner, and a single-component developer (e.g. a magnetic toner, and a non-magnetic toner) which does not require a carrier have been known in the art.

It has been required that the toner for use in the electrophotographic method is produced by a method which is energy-saving and has less adverse influence to the environment.

As a dry toner for use in the electrophotography, electrostatic recording or electrostatic printing, a pulverized toner has been widely used in the conventional art. Specifically, the pulverized toner is a toner formed by melt-kneading a binder resin such as a styrene resins or polyester resin together with other additives such as a colorant, and finely pulverizing the resulted mixture.

In the toner formation method using the pulverizing method, it is important to uniformly disperse each constituting materials and then pulverize in order to maintain the uniform shape of the resulted toner. Generally, the shape of the pulverized toner is uneven and the pulverized plane of the toner becomes random. Therefore, it is very difficult to control the shape or structure of the pulverized toner. Moreover, if the additives such as a colorant, a releasing agent, a charge controlling agent, and the like are added at a large quantity, the additives are prone to expose to the surface of the toner as the pulverization may occur at an interface between the additives and the binder resin at the time of the pulverization process. As a result, the charging becomes uneven between the toner particles, and there causes a problem such that the characteristics of the toner such as the flowability or charging ability are deteriorated.

Recently, the toner has been required to have a smaller particle size so as to realize a high quality image. However, the down sizing of the toner particle causes the following problems.

(1) The energy for the pulverization is exponentially increased.

(2) In addition to its uneven shape, the flowability of the toner is significantly lowered, and thus the supplying performance, transferring ability, and cleaning ability of the toner are deteriorated.

(3) The charging becomes significantly uneven between the toner particles, as a result of the pulverization at an interface between the additives and the binder resin.

Moreover, the toner production method using a chemical method has been recently studied. The chemical method is a method in which a toner is produced in a solvent, and specific examples thereof include a suspension-polymerization method, emulsified polymerization aggregation method, dissolution-suspension method, polyester elongation method, phase inversion emulsification method, and the like.

The suspension-polymerization method is such method that the additives, such as the colorant, releasing agent, charge controlling agent and the like, and the polymerization initiator are dispersed in monomers, the dispersion is then dispersed in an aqueous medium containing a dispersing agent so as to form oil droplets, and then the monomers within the droplet is polymerization reacted by heating so as to form a toner (refer to Journal of the Imaging Society of Japan, vol. 43, no. 1, pp. 33-39 (2004)).

One example of the emulsified polymerization aggregation method is a method described as follow. The polymerization initiator, styrene monomer and acryl monomer are added together so as to generate a resin emulsion as a result of the emulsification polymerization. The coloring agent dispersion and the resin emulsion, and optionally a dispersion of the other additives such as a releasing agent, charge controlling agent and the like are mixed, and added with a pH adjusting agent or aggregating agent so as to make them grow to have the predetermined particle size. Thereafter, fine particles are fused together by heating and stirring to thereby form a toner (refer to Japanese Patent (JP-B) No. 3141783, and Journal of the Imaging Society of Japan, vol. 43, no. 1, pp. 40-47 (2004)).

The dissolution suspension method is a method which involves a volume contraction, and includes a step for suspending, in an aqueous phase, an oil phase formed by dissolving a binder resin in an organic solvent capable of dissolving the binder resin so as to prepare suspension, and a step of removing the organic solvent from the suspension. In this method, additives such as a colorant, releasing agent, charging agent and the likes are dispersed or dissolved together with the binder resin in a volatile solvent such as an organic solvent having a low boiling point, this solution is then suspended in an aqueous medium in the presence of a dispersant so as to form oil droplets, and the volatile solvent is removed from the oil droplets. Therefore, the dissolution suspension method is superior to the suspension polymerization method, emulsified polymerization aggregation method or the like, as the wide selection of resin is usable for the binder resin, and particularly, polyester resin effective in a full-color process which requires clearness or smoothness of an image area after fixing can be used (refer to JP-A No. 07-152202, and Journal of the Imaging Society of Japan, vol. 43, no. 1, pp. 48-53 (2004)).

The polyester elongation method is a method which includes a step for emulsifying and aggregating an oil phase in an aqueous phase so as to form dispersion wherein the oil phase is formed by dissolving polyester resin containing a reactive resin in an organic solvent capable of dissolving the polyester resin, and a step for allowing the polyester to elongation reaction while removing the organic solvent from the dispersion. Unlike the suspension polymerization method and emulsified polymerization aggregation method, this method is superior in terms of that polyester resin effective in a full-color process which requires clearness or smoothness of an image area after fixing can be used, and viscoelasticity of a toner can be controlled by controlling the elongation reaction, resulting the fixing ability at a wide range of temperature (refer to Journal of the Imaging Society of Japan, vol. 43, no. 1, pp. 54-59 (2004)).

The phase inversion emulsification method is such a method that additives such as a colorant, releasing agent, charging agent and the like are dispersed or dissolved together with a binder resin in a volatile solvent such as an organic solvent having a low boiling point, a continuous aqueous phase is poured into the thus obtained solution so as to inverse from W/O (water in oil) dispersion to O/W (oil in water) dispersion to thereby form oil droplets, and the volatile solvent is removed from the oil droplets. This method is also notable as the wide selection of resin is usable for the binder resin, and particularly, polyester resin effective in a full-color process which requires clearness or smoothness of an image area after fixing can be used (refer to JP-B No. 3063269, and JP-A No. 08-211655).

As a toner produced in accordance with such the chemical method, there haven been known a capsule toner, core-shell toner and the like, which have embodiments capable of effectively exhibiting the predetermined functions in view of the recent concerns about the environmental issues.

Comparing to the pulverizing method, the chemical method produces toner having a smaller particle size and a narrower particle size distribution. However, in accordance with the chemical method, the toner is produced in water or a hydrophilic solvent, and thus the surface of the resulted toner becomes hydrophilic, which causes the lowered charging ability, and unstability in the storage stability and environmental characteristics, and induces problems such as inferior developing and transferring, toner scattering, lower image quality, and the like. Moreover, as the chemical method releases a large volume of waste liquid and requires a large amount of energy to dry the toner, it is not preferable in view of the environmental load.

In order to prevent deterioration of flowability, transferring property or cleaning property due to the down-sized toner in the pulverization method and to prevent lowering of charging ability, and unstability of storage stability and environmental characteristics due to the hydrophilic surface of the toner in the chemical method, the conventional toner is generally added with inorganic or organic fine particles on the surface thereof, and the adhesion of the toner is reduced by the effects of the fine particles. Moreover, the inorganic or organic fine particles are generally applied to the surface of the toner also for the purpose of applying sufficient flowability enough to transfer the toner from the toner vessel to the developing unit.

As such the fine particles, there have been known hydrophobic powder such as hydrophobic silica (refer to JP-A No. 52-30437), a mixture wherein aluminum oxide or titanium oxide fine particles are added to silica fine particles (refer to JP-A No. 60-238847), aluminum-coated titanium fine particles (refer to JP-A No. 57-079961). Moreover, as the titanium oxide, there have been proposed the one having a crystal structure of anatase (refer to JP-A No. 60-112052), aluminum oxide-coated titanium oxide (refer to JP-A No. 57-79961), and titanium oxide fine particles which are surface treated with a coupling agent (refer to JP-A No. 04-40467). However, silica, which has the highest effect on providing flowability, is commonly used. By applying hydrophobic powder such as silica, the flowability, developing performance and transferring performance of the toner is largely improved.

However, theses external additives applied on the surface of the toner continuously receive physical stress in the developing unit, transferring unit, cleaning unit, or the like at the time being used in a copying machine or printer. As a result, the external additives may be buried into the toner inside from the surface thereof, or be detached from the surface of the toner. Therefore, the adhesion of the toner increases with time, which causes the decrease in the transferring efficiency and reliability of cleaning.

As a toner production method which replaces the pulverization method or chemical method, there has been proposed a method in which fine droplets are formed by utilizing piezoelectric pulse, and the droplets are dried and solidified so as to form a toner (refer to JP-A No. 2003-262976). Moreover, there has proposed a method in which droplets are formed by utilizing heat expansion inside of a liquid room, and the droplets are dried and solidified so as to form a toner (refer to JP-A No. 2003-280236). Furthermore, there has been proposed a method in which acoustic lens are used to carry out the same process mentioned above (refer to JP-A No. 2003-262977).

The toner produced in accordance with any of these methods is also added with the charge controlling agent so as to provide charge controlling effect which is the important characteristic of the toner. In the case where the toner dispersion added with the charge controlling agent is ejected from fine ejection holes, it is difficult to stably eject the dispersion without clogging the ejection holes in most cases. Therefore, such the method requires a process for finely dispersing the charge controlling agent, and may further requires an addition of a dispersion stabilizer so as to maintain the finely dispersed state at a certain period. Especially when an aqueous medium is used and fine droplets are dried and solidified to thereby produce a toner, a surface of the resulted toner becomes hydrophilic. In such the case, similarly to the case of the pulverization method and chemical method, it is necessary to add inorganic or organic fine particle to the surface of the toner so as to prevent the reduction in the charging ability, and unstability in the storage stability and environmental characteristics.

In recent years, the dry toner has been required to realize an image of the quality close to offset printing or a photograph. To this end, as well as the down sizing the toner so as to attain high resolution, it is desired that the deposition about of the toner is reduced and a pile height of the toner layer is lowered so as to provide a natural texture like the one obtained with the offset printing, and clearness of the colorant is increased so as to widen the capacity of the color reproduction.

In order to balance between the reduced amount of toner deposition, lowered pile height of the toner layer, and remaining of the high image density, it is a common practice that the amount of the pigment to be contained in the toner is increased. If the amount of the pigment is increased, however, the large amount of the pigment may inhibit the fixing, or the charge of the toner may become unstable as the pigment is present on the surface of the toner, which may cause the deterioration of the image. In the case of the chemical toner, such as the one obtained from the suspension polymerization method or dissolution suspension method, it is difficult to form droplets and obtain particles as the viscosity of the solution is increased.

In order to improve the clearness of the colorant so as to widen the capacity of color reproduction, there have been known the method in which a pigment is finely dispersed, and the method in which a dye is used.

As the technique for finely dispersing the pigment, especially for the purpose of stabilizing the dispersion state in the organic solvent, JP-A No. 2005-232443 discloses the use of graft polymer pigment dispersant, and JP-A No. 2005-36220 discloses the use of silicone macromer pigment dispersant. If the pigment is dispersed more finely, the larger amount of the pigment dispersant is required to stabilize the dispersion. This cases problems such that the charging stability of the toner is inhibited, the fixing property is largely changed, and the like. As the technique for finely pulverizing the pigment, the use of a ball mill or beads mill is commonly known. In recent years, in order to even more finely pulverize the pigment, there have been proposed the pulverization method using a laser ablation (refer to JP-A Nos. 2004-267918 and 2005-238342), the pigment fine dispersion method using the dissolution and precipitation process (refer to JP-A Nos. 2004-331946, 2004-091560 and 2006-193681), and the method in which the pigment solution is spray-dried to provide fine particles of the pigment (refer to JP-A No. 2005-518278 and 2006-152103). However, the large amount of the pigment dispersant is necessary to stabilize the dispersion, and there are sill the problems such that charging stability of the toner is inhibited, the fixing property is largely changed, and the like.

The dye is excellent in color tone and clearness. However, it also has problems such that the light fastness is poor, the formed image is blurred as the dye is migrated during the storage, and a film or the like is stained if the image formed with the dye is contacted with the film or the like. In order to solve these problems, there has been proposed the use of polymer dye. Examples thereof are a polymer dye in which a phenol dye is introduced into polyester structure (refer to JP-A No. 62-245268), a polymer dye in which an azo dye having a vinyl group is polymerized (refer to JP-A No. 63-85644), a polymer dye added with a rhodamine dye (refer to JP-A Nos. 01-147472, 01-147476, 01-161362, 01-161363, 01-161364, 01-161365, 01-164956, 01-164957, 01-164958, 01-164959, 01-173056, 01-173057, 01-173058, 01-173059, 01-173060, 01-173064, 01-173065, 01-173066, 01-173067, 01-173068, and 02-2575). However, these polymer dyes are all unique and expensive.

Moreover, there have been proposed the toner for latent electrostatic photography containing a colorant obtained by reacting the resin having a carboxyl group or sulfonyl group at a side chain thereof with a basic dye (refer to JP-B No. 3068654), and color particles and a color toner in which the amount of the functional groups of the resin and reactive amount of the dye to the resin are determined. However, these are similar to the toner in the related art in terms of a particle size distribution and characteristics of the toner.

There has been also proposed a toner production method in which a toner composition fluid in which a toner composition is made into liquid is ejected from ejection holes of a nozzle by applying pressure to the toner composition fluid so as to form a column state of the toner composition fluid, and the toner composition fluid is made into droplets by vibrating a nozzle plate or retention means at a constant frequency (refer to JP-A Nos. 2006-293320, and 2007-108731). In this method, a pigment used as a colorant is finely dispersed, and thus the capacity of color reproduction is not necessarily wide, as well as having problems of clogging or unstable ejection due to the pigment.

As mentioned above, it is the current situation that there have not yet been provided a method for producing a toner, the toner produced by the same, and an image forming method using such the toner, all of which have sufficient performances such that the resulted toner has a wide capacity of color reproduction, vivid color tone, high clearness, sharp particle size distribution, and excellent toner characteristics such as charging ability, environmental stability, storage stability and the like, does not generate any waste liquid, does not contain any residual monomer, does not require drying process, and is at low cost.

BRIEF SUMMARY OF THE INVENTION

The present invention aims at solving the problems in the related art in view of the aforementioned current situation. Specifically, an object of the present invention is to provide a toner for developing a latent electrostatic image, which has an excellent transferring performance and cleaning performance, and is capable of forming a vivid and high quality image. Another object of the present invention is to provide a method for producing such the toner, and apparatus for producing such the same. Another object of the present invention is to provide a developer, toner container, process cartridge, image forming method and image forming apparatus, all of which uses such the toner.

It is another object of the present invention to provide a toner for developing a latent electrostatic image, which is used for a developer developing a latent electrostatic image in electronic photography, latent electronic recording, latent electronic printing, or the like, method for producing the same and apparatus for producing the same, wherein the environmental loads at the time of the production is little, the toner is efficiently produced, the produced toner has a monodispersity of the particle size which has never been realized in the related art, and the produced toner has no or very little variation, which has been seen in the particles produced in accordance with the conventional methods, in the characteristics required by the toner such as flowability, charging ability, and the like.

As a result of the intensive researches and studies conducted by the present inventors for the purpose of achieving the aforementioned objects, it was found that in the method wherein a toner composition fluid was ejected from ejection hole(s) so as to make the toner composition fluid into droplets, and the droplets were made into solid particles in atomizing space so as to form toner particles, a use of a colorant formed by reacting a polymer and a basic dye significantly reduces dispersed particles present in the toner composition so that the ejection performance was extremely stabilized, and as a result, toner particles having a monodispersity and little variation between the particles in various characteristics required for the toner such as flowability, charging ability and the like were obtained. Moreover, it was found that the toner capable of forming a vivid and high quality image and an image of less discolored could be obtained.

The present invention has been made based upon the aforementioned findings by the present inventors, and means for solving the aforementioned problems are as follows:

<1> A toner for developing a latent electrostatic image, obtained by a method containing:

ejecting a toner composition fluid from an ejection hole so as to make the toner composition fluid into droplets; and solidifying the droplets in an atomizing space so as to form solid particles, wherein the toner composition fluid contains at least a colorant formed by reacting a polymer containing 10 mol % or more of a monomer unit having a sulfonic acid group or a salt thereof, or a monomer unit having a sulfuric acid group or a salt thereof as a constitutional unit, and a basic dye.

<2> The toner according to (1), wherein the toner composition fluid contains an organic solvent dissolving at least the colorant.

<3> The toner according to (2), wherein a content of the colorant in the toner composition fluid is 5 parts by mass to 98 parts by mass with respect to 100 parts by mass of a solids content of the toner composition fluid.

<4> The toner according to any one of <1> to <3>, wherein the monomer unit having a sulfonic acid group or the salt thereof, or the monomer unit having a sulfuric acid group or the salt thereof as the constitutional unit is at least one selected from the group consisting of 2-(meth)acrylamide-2-methylpropane sulfonic acid, a salt thereof, styrene sulfonic acid, and a salt thereof.

<5> The toner according to any one of <1> to <4>, wherein the polymer contains 10 mol % or more of a monomer unit at least one selected from the group consisting of 2-(meth) acrylamide-2-methylpropane sulfonic acid, a salt thereof, styrene sulfonic acid, and a salt thereof, and an alkyl(meth) acrylate monomer unit, as constitutional units.

<6> The toner according to any one of <1> to <5>, wherein the toner has a weight average particle diameter of 1 μm to 6 μm, and a ratio D4/Dn of the weight average particle diameter D4 to a number average particle diameter Dn of 1.00 to 1.10.

<7> A method for producing the toner as defined in any one of <1> to <6>, containing:

ejecting a toner composition fluid from an ejection hole so as to make the toner composition fluid into droplets; and solidifying the droplets in an atomizing space so as to form solid particles, wherein the toner composition fluid contains at least a colorant formed by reacting a polymer containing 10 mol % or more of a monomer unit having a sulfonic acid group or a salt thereof, or a monomer unit having a sulfuric acid group or a salt thereof as a constitutional unit, and a basic dye.

<8> The method for producing the toner according to <7>, the ejecting is performed by vibrating a nozzle plate having the ejection hole and applying a pressure to the toner composition fluid, so as to continuously eject the toner composition fluid from the ejection hole to thereby from the droplets.

<9> The method for producing the toner according to <8>, wherein a vibration frequency of the nozzle plate is 50 kHz or more but less than 50 MHz.

<10> The method for producing the toner according to any one of <8> or <9>, wherein the nozzle plate is disposed in a retention section configured to retain the toner composition fluid, and the nozzle plate is vibrated by vibrating the retention section.

<11> The method for producing the toner according to <10>, wherein a vibration frequency of the retention section is 50 kHz or more but less than 50 MHz.

<12> The method for producing the toner according to any one of <8> to <11>, wherein the nozzle plate is a metal plate which has a thickness of 5 μm to 100 μm, and the ejection hole having an aperture size of 1 μm to 40 μm.

<13> The method for producing the toner according to any one of <8> to <12>, wherein the nozzle plate has 1 to 3,000 ejection holes.

<14> The method for producing the toner according to <7>, wherein the droplet forming unit contains a nozzle plate having a plurality of the ejection holes formed thereon, and a vibration unit containing a transducer which is configured to generate vibration, a vibration amplifier configured to amplify the vibration generated by the transducer, and a vibration plane disposed opposite to and parallel to the nozzle plate, and wherein the ejecting is to periodically eject the toner composition fluid supplied between the nozzle plate and the vibration plane from the ejection hole so as to periodically form and release the droplets.

<15> The method for producing the toner according to <14>, wherein the vibration plate is in the shape of a rectangle, and has a ratio of a short side thereof to a long side thereof is 2.0 or more.

<16> The method for producing the toner according to any one of <14> or <15>, wherein the vibration amplifier is in the shape of horn.

<17> The method for producing the toner according to any one of <14> to <16>, wherein the transducer is a Langevin transducer.

<18> The method for producing the toner according to any one of <14> to <17>, wherein the nozzle plate were formed in an area of the nozzle plate at where a deviation of sound pressure generated by the vibration unit is 10 kPa to 500 kPa, and a vibration frequency of the vibration generated by the vibration unit is 20 kHz or more but less than 2.0 MHz.

<19> The method for producing the toner according to any one of <14> to <18>, wherein the film has a ratio R ($\Delta L_{max}/\Delta L_{min}$) of 2.0 or less, where $\Delta L_{max}$ denotes a maximum amount of a vibration direction deviation $\Delta L$ of the film in the area where the ejection holes were disposed, and $\Delta L_{min}$ denotes a minimum amount of $\Delta L$.

<20> The method for producing the toner according to any one of <14> to <19>, wherein the vibration plane of the vibration amplifier is larger than a plane where the vibration amplifier and the transducer are connected to each other.

<21> The method for producing the toner according to <7>, wherein the droplet forming unit contains a nozzle plate on which a plurality of the ejection holes are formed, a circular ring vibration unit disposed in an area surrounding an area of the nozzle plate where the nozzle plate is deformable, and configured to vibrate the nozzle plate, and wherein the ejecting is to periodically eject the toner composition fluid from the ejection holes so as to periodically form and release the droplets.

<22> The method for producing the toner according to <21>, wherein the film is in the shape of convex which is projected in the direction at which the droplets are released, and the ejection holes are formed in the convex part.

<23> The method for producing the toner according to <22>, wherein the convex shape of the film is a circular cone and the circular corn has R/h of 14 to 40 where h denotes a height of the circular cone and R denotes a diameter of a bottom plane of the circular cone.

<24> The method for producing the toner according to <22>, wherein the convex shape of the film is a truncated cone, and the truncated cone has R/h of 14 to 40 and r/R of 0.125 to 0.375 where h denotes a height of the truncated cone, R denotes a diameter of a bottom plane of the truncated cone, and r denotes a diameter of a top plane of the truncated cone.

<25> The method for producing the toner according to any one of <21> to <24>, wherein the film is vibrated at a vibration mode wherein the film has no node in a direction of a diameter of the circular ring vibration unit.

<26> The method for producing the toner according to any one of <21> to <25>, wherein a vibration frequency of the film is 20 kHz or more but less than 2.0 MHz.

<27> The method for producing the toner according to any one of <21> to <26>, wherein the nozzle are formed in an area of the nozzle plate at where pressure the nozzle plate gives to the toner composition fluid is in the range of 10 kPa to 500 kPa.

<28> The method for producing the toner according to any one of <21> to <27>, wherein the film has a ratio R ($\Delta L$-max/$\Delta L$min) of 2.0 or less, where $\Delta L$max denotes a maximum amount of a vibration direction deviation $\Delta L$ of the film in the area where the ejection holes were disposed, and $\Delta L$min denotes a minimum amount of $\Delta L$.

<29> The method for producing the toner according to any one of <21> to <28>, wherein the film is a metal thin film having a thickness of 5 μm to 500 μm, and each of the ejection holes has an aperture size of 3 μm to 35 μm.

<30> The method for producing the toner according to any one of <21> to <29>, wherein the droplet forming unit has 2 to 3,000 ejection holes.

<31> The method for producing the toner according to any one of <7> to <30>, wherein the solidifying is performed by removing the solvent from the droplets of the toner composition fluid.

<32> The method for producing the toner according to any one of <31>, wherein the removal of the solvent is performed at the same time as when a dry gas is brown in the same direction as the ejecting direction of the droplets and the droplets are conveyed by the dry gas in the solvent removal system.

<33> The method for producing the toner according to <32>, wherein the dry gas is air or a nitrogen gas.

<34> The method for producing the toner according to any one of <32> or <33>, wherein the dry gas has a temperature of 40° C. to 200° C.

<35> The method for producing the toner according to any one of <32> to <34>, wherein the solvent removal system has a carrier path which is surrounded by an electric field curtain charged with a reverse polarity of the droplets, and the droplets are passe through the electric field curtain.

<36> The method for producing the toner according to <35>, wherein the toner particles are collected in a toner collection section after a charge of the toner particles formed as a result of passing though the electric field curtain is temporarily neutralized by means of a discharger.

<37> The method for producing the toner according to <36>, wherein the discharging by means of the discharger is carried out by soft X-ray radiation.

<38> The method for producing the toner according to <36>, wherein the discharging by means of the discharger is carried out by plasma radiation.

<39> The method for producing the toner according to any one of <36> to <38>, wherein the toner collection section is tapered in such manner that an aperture diameter thereof is gradually narrowed, and the toner particles are transferred by the dry gas which flows downwards from the outlet of the toner collection section which has a narrower aperture diameter than that of the inlet of the toner collection section so as to convey the toner particles to the toner storage vessel.

<40> The method for producing the toner according to <39>, wherein the flow of the dry air is a vortex flow.

<41> A developer containing the toner for developing a latent electrostatic image as defined in any one of <1> to <6>.

<42> A toner container containing a container, and the toner for developing a latent electrostatic image as defined in any one of <1> to <6> housed in the container.

<43> A process cartridge containing at least a latent electrostatic image bearing member, and a developing unit configured to apply the toner for developing a latent electrostatic image to the latent electrostatic image bearing member so as to develop the latent electrostatic image formed on the latent electrostatic image bearing member and form a visible image, wherein the process cartridge is detachably disposed to an image forming apparatus.

<44> An image forming method containing:

forming a latent electrostatic image on a latent electrostatic image bearing member;

developing the latent electrostatic image using the toner as defined in any one of <1> to <6> so as to form a visible image;

transferring the visible image to a recording medium; and heating and pressurizing the transferred image on the recording member by means of a fixing member in the form of a roller or a belt so as to fix the transferred image onto the recording medium.

<45> An image forming apparatus containing:

a latent electrostatic image bearing member;

a latent electrostatic image forming unit configured to form a latent electrostatic image on the latent electrostatic image bearing member;

a developing unit configured to apply the toner as defined in any one of <1> to <6> to the latent electrostatic image and develop the latent electrostatic image so as to form a visible image;

a transferring unit configured to transfer the visible image to a recording member; and a fixing unit containing a fixing member in the form of a roller or a belt, and configured to heat and pressurize the transferred image on the recording medium by means of the fixing member so as to fix the transferred image onto the recording medium.

<46> Toner composition fluid for a jet atomizing method contains at least a colorant formed by reacting a polymer containing 10 mol % or more of a monomer unit having a sulfonic acid group or a salt thereof, or a monomer unit having a sulfuric acid group or a salt thereof as a constitutional unit, and a basic dye, wherein the toner composition fluid is used in a method in which the toner composition fluid is ejected from an ejection hole so as to make the toner composition fluid into droplets, the droplets are solidified in an atomizing space so as to form solid particles to thereby produce a toner.

According to the present invention, the various problems in the related art can be solved, and there can be provided a toner for developing a latent electrostatic image, method for producing the same, apparatus for producing the same, developer using the same, toner container using the same, process cartridge using the same, image forming method using the same, and image forming apparatus using the same, all of which has excellent transferring and cleaning performances, is capable of forming vivid high quality images, and capable of stably forming color images of high quality and high grade regardless of the environment and time-lapse.

Moreover, according to the present invention, there is provided a toner for developing a latent electrostatic image for use in a developer for developing a latent electrostatic image in electrophotography, latent electrostatic recording, latent electrostatic printing and the like, method for producing the same, apparatus for producing the same, developer using the same, toner container using the same, process cartridge using the same, image forming method using the same and image forming apparatus using the same, all in which the environmental load is reduced at the time of the production, the toner is efficiently produced, the produced toner has the particle size of monodispersity which has never been seen in the art, and no or extremely little variation in various characteristics required for the toner such as excellent charging ability and the like, whereas the particles produced by the conventional production method has a variation in such characteristics.

Specifically, the toner according to the present invention has no or extremely little, which is the degree that can be ignored, of the variation width due to variations between particles that can be seen in the toner produced by the conventional pulverization or chemical method. This is the feature realized only in the present invention. By realizing this feature, it becomes possible to produce an image which is substantially accurate to a latent electrostatic image formed on a photoconductor. Namely, it is presumed that physical stress required for achieving a charging amount of the toner set in the electrophotographic process is extremely little as a result of that uniformity of the particle size distribution, shape, and surface condition is achieved, and thus shelf-life of the toner is significantly prolonged. As a result, it is possible to produce high quality images for a long period of time.

DETAILED DESCRIPTION OF THE INVENTION

Figure 1:
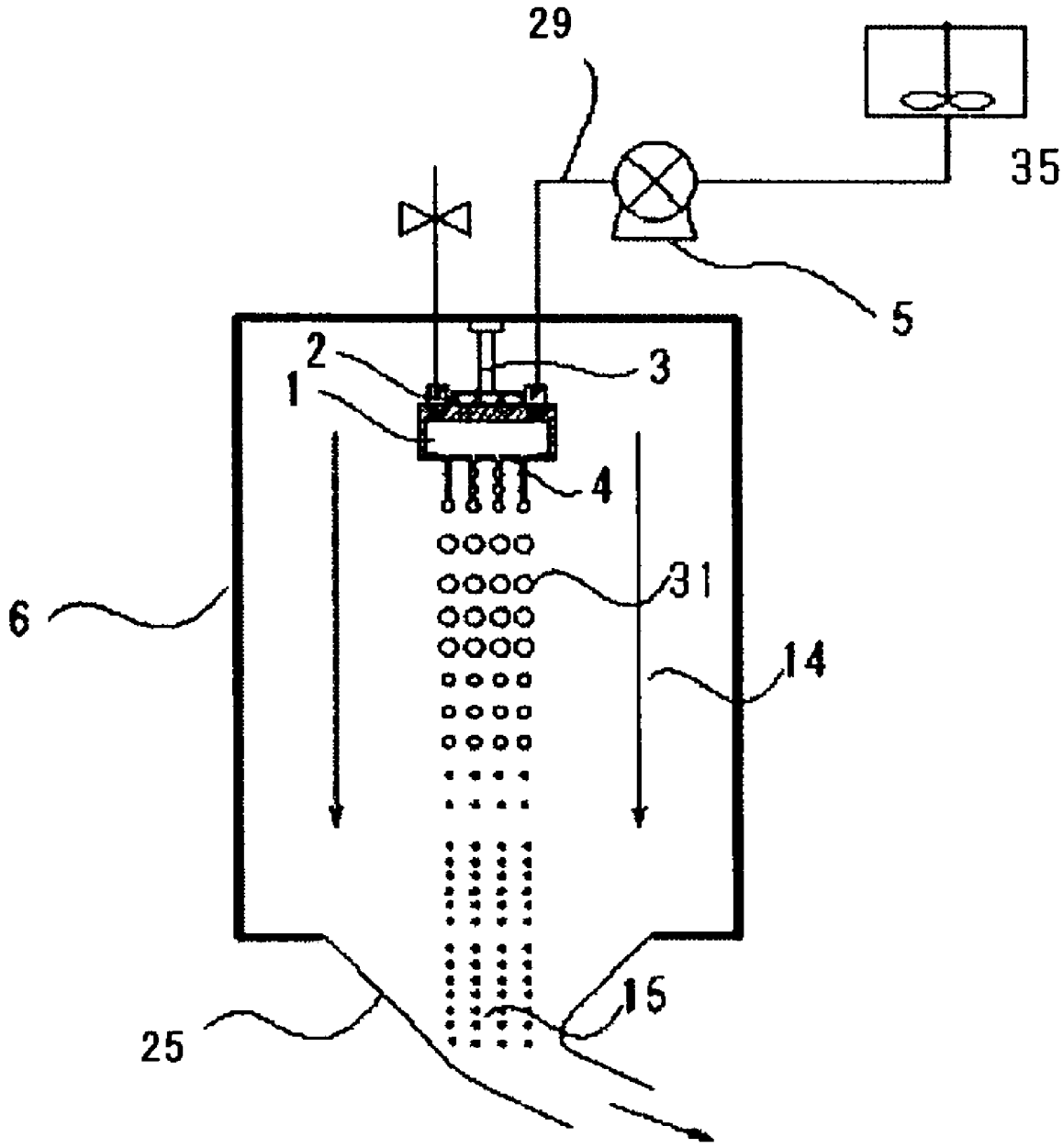
FIG. 1 is a diagram explaining one example of the apparatus for producing a toner.

The toner for developing a latent electrostatic image of the present invention contains at least a binder resin and a colorant. By using the organic solvent-soluble colorant formed by reacting a certain polymer and a basic dye, dispersed particles present in a toner composition fluid becomes extremely reduced, and thus the ejection performance is stabilized and toner particles having a monodispersity and little variation between the particles in various characteristics required for the toner such as flowability, charging ability and the like are obtained, and moreover, the toner capable of forming a vivid and high quality image and an image of less discolored can be obtained.

Hereinafter, the details of the toner of the present invention will be explained in the descriptions of the production method for a toner for developing a latent electrostatic image of the present invention.

The toner composition contains a colorant formed by reacting a basic dye and a polymer in which 10 mol % or more of the constitutional units thereof are a monomer unit having a sulfonic acid group or a salt thereof, and/or a monomer unit having a sulfuric acid group or a salt thereof The toner composition optionally contains other substances, such as a binder resin, wax, a magnetic material and the like. Moreover, the toner composition is preferably dissolved, or finely dispersed in an organic solvent so as to form a toner composition fluid which the toner composition is made in the state of liquid.

In the case where the aforementioned polymer for use in the present invention is a vinyl polymer, examples of the vinyl monomer unit having a sulfonic acid group and/or a salt thereof and/or a sulfuric acid group and/or a salt thereof, i.e. the constitutional monomer unit of the vinyl polymer, include monomers such as 2-(meth)acryloyloxyethane sulfonic acid, 2-(meth)acryloyloxypropane sulfonic acid, 2-(meth)acrylamide-2-(C1-C4)alkylpropane sulfonic acid, vinyl sulfonic acid, allyl sulfonic acid, styrene sulfonic acid, α-methylstyrene sulfonic acid, vinyltoluene sulfonic acid, vinylnaphthalene sulfonic acid, vinyl sulfuric acid, and the like. Among these monomers, 2-(meth)acryloyloxyethan sulfonic acid, 2-(meth)acyloyloxypropane sulfonic acid, 2-(meth)acrylamide-2-(C1-C4)alkylpropane sulfonic acid, and styrene sulfonic acid are preferable, 2-acrylamide-2-methylpropane sulfonic acid and styrene sulfonic acid are more preferable, and 2-acrylamide-2-methylpropane sulfonic acid is the most preferable, as the polymerization ability thereof is high and the resultant polymer of high molecular weight can be easily obtained.

These constitutional monomer units may be used in an acidic state, or used by neutralizing a part or all of the sulfonic acid group and/or sulfuric acid group.

Examples of the counter ion forming a salt of the sulfonic acid group and/or sulfuric acid group include metal ion, ammonium ion, C1-C22 alkyl or alkenyl ammonium ion, C1-C22 alkyl or alkenyl substituted pyridinium ion, C1-C22 alkanol ammonium ion, and the like. Among these, metal ion such as sodium ion, or potassium ion, or ammonium ion is preferable, and sodium ion and potassium ion are more preferable.

The aforementioned polymer may also be used in the form of a copolymer with a monomer. Examples of such monomer include: styrene monomers such as styrene, α-methyl styrene, divinyl benzene, and the like; alkyl(meth)acrylate monomers such as methylacrylate, methylmethacrylate, ethylacrylate, ethylmethacrylate, n-butylmethacrylate, i-butylmethacrylate, t-butylmethacrylate, hexylacrylate, cyclohexylacrylate, octylacrylate, 2-ethylhexylacrylate, and the like; unsaturated carboxylic acid monomers such as acrylic acid, methacrylic acid, (anhydrous) maleic acid, fumaric acid, itaconic acid, and the like; nitrogen-containing (meth) acrylate monomers such as dimethylaminoacrylate, dimethylaminoethylacrylate, diethylaminoethylacrylate, diethylaminopropylacrylate, N-aminoethylaminopropylacrylate, dimethylaminomethacrylate, dimethylaminoethylmethacrylate, diethylaminoethylmethacrylate, diethylaminopropylmethacrylate, N-aminoethylaminopropylmethacrylate, and the like; and monomers such as 2-hydroxyethylacrylate, 3-hydroxypropylacrylate, 4-hydroxybutylacrylate, 2-hydroxyethylmethacrylate, and the like.

Among these, it is preferable to use the alkyl(meth)acrylate monomer for the purpose of improving the compatibility with the binder resin and the solubility to the organic solvent.

These monomers are loaded together with a commonly known radical polymerization initiator, which is a radical polymerizable monomer in water, in a polymerization vessel so as to be polymerized. As the radical polymerization initiator, persulfate such as potassium persulfate, ammonium persulfate, or the like, organic peroxide such as cumenehydroperoxide, t-butylhydroperoxide, or the like, azobisisobutyronitrile, azobisisovaleronitrile, and the like. The polymerization may also be taken place in an organic solvent depending on the selection and quantity of the monomer for a copolymer for use.

In the case where the amount of the monomer unit having a sulfonic acid or salt thereof or a sulfuric acid group or salt thereof is small, the sufficient coloring cannot be achieved. Therefore, the amount of the monomer unit having such the acid group is 10 mol % or more, and preferably 30 mol % or more.

Specific examples of the basic dye include: CI BASIC YELLOW 1, 2, 11, 13, 14, 19, 21, 25, 28, 36, 40, 73; CI BASIC ORANGE 21, 22, 30; CI BASIC RED 12, 13, 14, 18, 27, 36, 38, 39, 46, 69, 70; CI BASIC VIOLET 7, 10, 11, 15, 16, 27, 28; CI BASIC BLUE 1, 4, 7, 9, 26, 35, 41, 45, 65, 66, 67, 75, 77, 129; CI BASIC GREEN 4; and the like.

The dying process between the basic dye and the polymer is progressed at pH value of 2 to 7, preferably 3 to 5. The temperature for this reaction is 30° C. to 100° C., and preferably 50° C. to 80° C. If the temperature is low, the reaction duration may be excessively long. If the temperature is high, there may be a problem such that the material is deteriorated. In the case where the temperature is adjusted at 40° C. to 60° C., the reaction duration is 20 minutes to 2 hours. The solvent for use may be water, an organic solvent such as N-vinylpyrrolidone, acrylonitrile, or the like, or a mixed solvent of water and the organic solvent.

Once the dying process is sufficiently progressed, the organicity of the polymer is increased, and thus the reacted polymer becomes insoluble to water or the organic solvent such as N-vinylpyrrolidone or acrylonitrile. Therefore, the colorant formed by reacting the polymer and the basic dye is obtained by repeating the filteration and washing of the reactant, and drying the thus obtained cake. The obtained colorant is dissolved or finely dispersed in an organic solvent to thereby a toner composition fluid.

The glass transition temperature of the colorant formed by reacting the polymer and the basic dye is preferably 30° C. to 80° C. In the case where the colorant has a glass transition temperature within the aforementioned range, the thermal characteristics of the toner are not adversely affected even when the large amount of the colorant is added thereto.

Examples of the aforementioned organic solvent include monohydric alcohol, dihydric alcohol, aromatic hydrocarbon, aliphatic hydrocarbon, ester, ketone, alicyclic hydrocarbon, volatile organopolysiloxane, and the like. Specific examples thereof are methanol, ethanol, 2-propanol, n-butanol, propylene glycol, toluene, xylene, isopentane, n-hexane, n-heptane, ethyl acetate, butyl acetate, acetone, methylethylketone, cyclohexane, and the like.

The present invention uses the colorant formed by reacting a certain polymer and the basic dye, and thus the colorant itself has a function as a binder resin. However, it is preferable that a conventional binder resin is used together with the colorant, as the thermal characteristics, electric characteristic and the like of the toner are easily controlled.

The amount of the colorant is preferably 5 parts by mass to 98 parts by mass with respect to 100 parts by mass of the solids content of the toner composition fluid. In the case where the amount of the colorant is less than 5 parts by mass, a sufficient coloring effect cannot be attained. In the case where the amount of the colorant is more than 98 parts by mass, it is extremely difficult to attain characteristics required in order to function as a toner.

Examples of the binder resin include: styrene resin; a vinyl polymer of monomers of acrylic acid and/or acrylic acid ester, or monomers of methacrylic acid and/or methacrylic acid ester; a copolymer of monomers of the aforementioned resins or copolymer prepared using two or more of the monomers of the aforementioned resins; polyester polymer; polyol resin; phenol resin; silicone resin; polyurethane resin; polyamide resin; furan resin; epoxy resin; xylene resin; terpene resin; coumarone-indene resin; polycarbonate resin; and petroleum resin.

Examples of the styrene resin include: styrene polymer and substituted polymer thereof such as polystyrene, poly p-chlorostyrene, polyvinyl toluene, or the like; a copolymer of styrene such as styrene-p-chlorostyrene copolymer, styrene-propylene copolymer, styrene-vinyltoluene copolymer, styrene-vinylnaphthalene copolymer, styrene-methylacrylate copolymer, styrene-ethylacrylate copolymer, styrene-butylacrylate copolymer, styrene-octylacrylate copolymer, styrene-methylmethacrylate copolymer, styrene-ethylmethacrylate copolymer, styrene-butylmethacrylate copolymer, styrene-α-methylchloromethacylate copolymer, styrene-acrylonitrile copolymer, styrene-vinylmethylether copolymer, styrene-vinylmethylketone copolymer, styrene-butadiene copolymer, styrene-isoprene copolymer, styrene-acrylonitrile-indene copolymer, styrene-maleic acid copolymer, styrene-maleic acid ester copolymer, or the like; and the like.

Examples of the acrylic resin include polymethyl methacrylate, polybutyl methacrylate, and the like, and examples of other resins include polyvinyl chloride, polyvinyl acetate, polyethylene, polypropylene, polyester resin, epoxy resin, epoxy polyol resin, polyurethane, polyamide, polyvinyl butyral, polyacrylic acid resin, rosin, modified rosin, terpene resin, phenol resin, aliphatic or alicyclic hydrocarbon resin, aromatic petroleum resin, chloridized paraffin wax, paraffin wax, and the like.

Examples of the monomers of acrylic acid and/or acrylic acid ester include acrylic acid or ester thereof, such as acrylic acid, methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate, phenyl acrylate, and the like.

Examples of the monomers of methacrylic acid and/or methacrylic acid ester include methacrylic acid, methyl methacrylates, ethyl methacrylates, propyl methacrylates, n-butyl methacrylates, isobutylmethacrylates, n-octyl methacrylates, n-dodecyl methacrylates, 2-ethylhexyl methacrylates, stearyl methacrylates, phenyl methacrylates, dimethylamino methacrylates, diethylaminoethyl methacrylates, and the like.

Examples of other monomers forming the vinyl polymer or the copolymers include the following ones (1) to (16): (1) a halogenated monomer such as vinyl chloride, vinylidene chloride, vinyl bromide, vinyl fluoride or the like; (2) vinyl ester such as vinyl acetate, vinyl propionate, or the like; (3) vinyl ether such as vinylmethylether, vinylethylether, vinylisobutylether or the like; (4) vinyl ketone such as vinyl methyl ketone, vinyl hexyl ketone, methylisopropenyl ketone or the like; (5) an N-vinyl compound such as N-vinyl pyrrole, N-vinyl carbazole, N-vinyl indole, N-vinyl pyrrolidone or the like; (6) vinyl naphthalene; (7) acrylic acid or methacylic acid derivative such as acrylonitrile, methacrylonictile, acryl amide, or the like; (8) unsaturated dibasic acid such as maleic acid, citraconic acid, itaconic acid, alkenyl succinate, fumaric acid, mesaconic acid, or the like; (9) unsaturated dibasic acid anhydride such as maleic anhydride, citraconic anhydride, itaconic anhydride, alkyenyl succinic anhydride, or the like; (10) monoester of unsaturated dibasic acid such as monomethyl maleate, monoethyl maleate, monobutyl maleate, monomethyl citraconate, monoethyl citraconate, monobutyl citraconate, monomethyl itaconate, monomethyl alkenyl succinate, monomethyl fumarate, monomethyl mesaconate, or the like; (11) unsaturated dibasic acid ester such as dimethyl maleate, dimethyl fumarate or the like; (12) α,β-unsaturated acid such as crtonic acid, cinnamic acid, or the like; (13) α,β-unsaturated acid anhydride such as crtonic anhydride, cinnamic anhydride, or the like; (14) a monomer having a carboxyl group such as anhydride of the aforementioned α,β-unsaturated acid and lower fatty acid, alkenyl malonic acid, alkenyl glutaric acid, alkenyl adipic acid, anhydride or monoester thereof, or the like; (15) hydroxyalkylester of acrylic acid or methacrylic acid such as 2-hydroxyethyl acrylate, 2-hydroxyethyl methacrylate, 2-hydroxypropyl methacrylate, or the like; and (16) a monomer having a hydroxyl group such as 4-(1-hydroxy-1-methylbutyl)styrene, 4-(1-hydroxy-1-methylhexyl) styrene.

Although there are low reactive resins among the conventionally used resins, such the resins can be used together with the aforementioned resins.

Examples of the styrene monomer include styrene, o-methylstyrene, m-methylstyrene, p-methylstyrene, p-phenylstyrene, p-ethylstyrene, 2,4-dimethylstyrene, p-n-anylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, p-nitrosyrene, and derivatives thereof.

Examples of the monomers forming the vinyl polymer or copolymer include: monoolefin such as ethylene, propylene, butylene, isobutylene, or the like; and polyene such as butadiene, isoprene, or the like.

In the present invention, vinyl polymers or copolymers as the binder resins may respectively have a cross-linked structure in which a vinyl polymer or a copolymer is cross-linked by use of a crosslinker having two or more vinyl groups. Examples of the crosslinker used in this case include aromatic divinyl compounds such as such as divinylbenzene, and divinylnaphthalene. Examples of diacrylate compound which is bound with an alkyl chain include ethyleneglycoldiacrylate, 1,3-butyleneglycoldiacrylate, 1,4-butanedioldiacrylate, 1,5-pentandioldiacrylate, 1,6-hexanedioldiacrylate, neopentylglycoldiacrylate, and the aforementioned compounds wherein acrylate is replaced with methacrylate. Examples of diacrylate compound which is bound with an alkyl chain including a ether bond include: diethyleneglycoldiacrylate, triethyleneglycoldiacrylate, tetraethyleneglycoldiacrylate, polyethyleneglycol#400diaclylate, polyethylene glycol#600diaclylate, dipropyleneglycoldiacrylate, and compounds of which the acrylate of these compounds is replaced by methacrylate.

Besides the above stated, there are diacrylate compounds, and dimethacrylate compounds each of which are bound with a binding chain containing an aromatic group and ether binding.

Commercially available polyester diacrylate include MANDA (manufactured by Nippon Kayaku Co., Ltd.).

These crosslinkers are preferably used in an amount of 0.01 parts by mass to 2 parts by mass, and more preferably used in an amount of 0.03 parts by mass to 1 parts by mass relative to 100 parts by mass of other monomer components. Of these cross-linked monomers, aromatic divinyl compounds particularly divinyl benzene, and diacrylate compounds each of which are bound with a binding chain containing an aromatic group and ether binding are preferably used in terms of fixing property relative to a resin used as a toner material and anti-offset property. Among these, it is preferable to select a combination of monomers so as to obtain a styrene copolymer or a styrene-acrylic acid copolymer.

In the case where the amount of the crosslinker is more than 2 parts by mass, the residual substance is remained at the time when the toner composition fluid is prepared by dissolving the binder resin in the organic solvent. As a result, there are cases where the ejection holes are clogged at the time when the toner composition fluid is ejected from the ejection holes so as to form droplets, and the stable production cannot be carried out.

Examples of polymerization initiators to be used in the vinyl polymer or the vinyl copolymer in the method for producing a toner of the present invention include ketone peroxides such as 2,2'-azobis isobutylonitrile; 2-2'-azobis(4-methoxy-2,4-dimethylvaleronitrile); 2,2'-azobis(2,4-dimethylvaleronitrile); 2,2'-azobis(2-methylbutylonitrile); dimethyl-2,2'-azobis isobutylate; 1,1'-azobis (1-cychlohexane carbonitrile); 2-(carbamonylazo)-isobutylonitrile; 2,2'-azobis(2,4,4-trimethylpentane); 2-phenylazo-2',4'-dimethyl-4'-methoxyvaleronitrile; 2,2'-azobis (2-methylpropane); methyl ethyl ketone peroxide, acetylacetone peroxide, and cyclohexanon peroxide; and 2,2-bis(tert-butylperoxy)butane; tert-butyl hydroperoxide, cumene hydroperoxide; 1,1,3,3-tetramethylbutyl hydroperoxide; di-tert-butylperoxide; tert-butylcumyl peroxide; di-cumyl peroxide; α-(tert-butyl peroxy)isopropyl benzene; isobutyl peroxide, octanoil peroxide; decanoil peroxide; lauroyl peroxide; 3,5,5-trimethylhexanoil peroxide; benzoyl peroxide; m-tlyl peroxide; di-isopropyl peroxydicarbonate; di-2-ethylhexyl peroxydicarbonate, di-n-propyl peroxydicarbonate; di-2-ethoxyethyl peroxycarbonate; di-ethoxyisopropyl peroxydicarbonate; di(3-methyl-3-methoxybuty) peroxy carbonate, acetylcyclohexylsulfonyl peroxide; tert-butyl peroxyacetate; tert-butyl peroxyisobutylate; tert-butyl peroxy-2-ethylhexalate; tert-butyl peroxylaurate; tert-butyl-oxybenzoate; tert-butyl peroxy isopropylcabonate; di-tert-butyl peroxy isophthalate; tert-butyl peroxy allylcarbonate; isoamyl peroxy-2-ethylhexanoate; di-tert-butyl peroxy hexahydroterephthalate; and tert-butyl peroxy azelate.

When the binder resin is a styrene-acrylic resin, in the molecular mass distribution of tetrahydrofuran (THF)-soluble parts in the resin components determined by GPC, a resin having at least one peak in an area of the number average molecular mass of 3,000 to 50,000 and having at least one peak in an area of a molecular mass of 100, 000 or more is preferably used in terms of fixing property, off-set property, and storage stability. As for the THF-soluble parts, such a binder resin of which a component having a number average molecular mass of 100,000 or less exists at 50% to 90% is preferably used; a binder resin having the main peak in an area of the number average molecular mass of 5,000 to 30,000 is more preferably used; and a binder resin having the main peak in an area of a molecular mass of 5,000 to 20,000 is most preferably used.

Compared to the styrene resin or acrylic resin, the polyester resin is capable of further reducing a melt viscosity while maintaining the stability of the toner during the storage. Such the polyester resin can be obtained, for example, by condensation reaction of alcohol and carbonic acid.

Examples of the alcohol include: bihydric alcohol such as polyethylene glycol, diethylene glycol, triethylene glycol, 1,2-propylene glycol, 1,3-propylene glycol, 1,4-propylene glycol, neopenthyl glycol, 1,4-butene diol, 1,4-bis(hydroxymethyl)cyclohexane, bisphenol A, hydrogenated bisphenol A, etherified bisphenol such as polyoxyethylene bisphenol A ether or polyoxypropylene bisphenol A ether, bihydric alcohol monomers in which the aforementioned diols are substituted C3-C22 saturated or unsaturated group, other bihydric alcohol monomers, or the like; and tri- or more hydric alcohol such as sorbitol, 1,2,3,6-hexantetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethyrol ethane, trimethyrol propane, 1,3,5-trihydroxymethyl benzene, or the like. Examples of the carboxylic acid used to obtain the polyester resin include: monocarboxylic acid such as palmitic acid, stearic acid, oleic acid, or the like; bivalent organic acid monomer such as maleic acid, fumaric acid, measaconic acid, citraconic acid, terephthalic acid, cyclohexane carboxylic acid, succinic acid, adipic acid, sebacic acid, malonic acid, bivalent organic acid monomers in which these are substituted with C3-C22 saturated or unsaturated hydrocarbon group, anhydrides thereof, dimer of lower alkylester and linoleic acid; trivalent or more of polyvalent carboxylic acid monomer such as 1,2,4-benzenetricarboxylic acid, 1,2,5-benzenetricarboxylic acid, 2,5,7-napthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, empol trimer acid, anhydrides thereof, or the like. In case where the amount of the tri- or more hydric alcohol or trivalent or more of polycarboxylic acid, the residual substance is remained without being dissolved at the tile when the toner composition fluid is formed by dissolving the binder resin in the organic solvent, and as a result, there may be a case where the ejection hole is clogged at the time of ejecting the toner composition fluid from the ejection hole and forming the droplets and the stable production cannot be carried out.

When the binder resin is a polyester resin, in the molecular mass distribution of tetrahydrofuran (THF)-soluble parts in the resin components determined by GPC, a resin having at least one peak in an area of the number average molecular mass of 3,000 to 50,000 is preferably used in terms of fixing property, and anti-off-set property of toner. As for the THF-soluble parts, such a binder resin that the component having a number average molecular mass of 50,000 or less exists at 70% to 100% is preferably used, and a binder resin having at least one peak in an area of a molecular mass of 5,000 to 20,000 is more preferably used. In the case where the amount of the components having the number average molecular mass of more than 50,000 is large, the time required for the process for preparing the toner composition fluid may be prolonged, the ejection holes may be clogged at the time when the toner composition fluid is ejected from the ejection holes so as to form droplets, and the stable production cannot be carried out. Therefore, it is not preferably to add a large amount thereof.

When the binder resin is a polyester resin, the acid value is preferably 0.1 mgKOH/g to 40 mgKOH/g, more preferably 0.1 mgKOH/g to 30 mgKOH/g, and most preferably 0.1 mgKOH/g to 20 mgKOH/g.

Examples of the aforementioned epoxy resin include polymerization condensation products of bisphenol A and epichlorohydrin. Specific examples thereof are EPOMIK R362, R364, R365, R366, R367, and R369 (manufactured by Mitsui Chemicals Inc.), EPOTOHTO YD-011, YD-012, YD-014, YD-904, and YD-017 (manufactured by Tohto Kasei Co., Ltd.), EPOCOAT 1002, 1004, and 1007 (manufactured by Shell Chemicals Japan Ltd.). The epoxy group at the terminal of these epoxy resins may be capped with a phenol compound such as cumyl phenol, or alkyl phenol.

As the binder resin applicable for the toner of the present invention, in at least one of the vinyl polymer component and polyester resin component, resin containing a monomer component capable of reacting with both of the resin components can also be used. Among monomers constituting a polyester resin, the monomer capable of reacting with vinyl polymer is, for example, unsaturated dicarboxylic acid such as phthalic acid, maleic acid, citraconic acid, itaconic acid or anhydrides thereof. The monomer constituting the vinyl polymer component is the one having a carboxyl group or a hydroxy group, acrylic acid ester, or methacrylic acid ester.

The number average molecular weight and weight average molecular weight of the resin for use in the present invention are measured in accordance with GPC (Gel Permeation Chromatography) at the following conditions:

Instrument: GPC-150C (Waters Corporation)

Columns: KF801-807 (Shodex)

Temperature: 40° C.

Solvent: THF (tetrahydrofuran)

Flow rate: 1.0 ml/min

Samples: samples containing concentrations of 0.05% by mass to 0.6% by mass (0.1 ml)

In this manner, a molecular mass distribution of the binder resin is obtained, and using a molecular mass calibration curve constructed from monodisperse polystyrene standards, the number-average molecular mass and mass-average molecular mass of the binder resin are calculated.

In the present invention, the acid value of the binder resin components of a toner composition is determined by the following method, and the basic measurement procedure is compliant with JIS K-0070.

(1) Additives other than binder resins (polymer component) in a sample are preliminarily removed, before the sample is used, or the acid value and the content of the components other than the binder resin component and cross-linked binder resin component are preliminarily determined. 0.5 g to 2.0 g of the crushed product sample is precisely weighed. The weight of the polymer component is determined as W(g). For example, when the acid value of binder resins is measured from a toner, the acid value and the content of colorants, magnetic material, or the like are separately measured, and then the acid value of the binder resin is calculated.

(2) The sample is poured in a 300 ml beaker, 150 mL of a mixture of toluene/ethanol with a volume ratio of 4/1 is added to the sample and dissolved.

(3) Using 0.1 mol/L of KOH ethanol solution, the sample is titrated using an automatic potentiometric titrator.

(4) The usage of the KOH solution at that time is determined as S(mL). A blank sample is measured at the same time, and the usage of the KOH solution at that time is determined s B(mL). Then, the acid value of the binder resin component is calculated using the following Equation (5).

$$\text{Acid Value(mgKOH/g)}=((S-B)\times f\times 5.61)/W \qquad \text{Equation (5)}$$

The composition containing toner binder resin and a binder resin preferably has a glass transition temperature (Tg) of 35° C. to 80° C., and more preferably has a glass transition temperature (Tg) of 40° C. to 75° C. from the perspective of the storage stability of toner. When the glass transition temperature (Tg) is lower than 35° C., the toner is liable to be degraded in a high-temperature atmosphere, and offset events may easily occur at the time of fixing. When the glass transition temperature (Tg) is more than 80° C., the fixing property of toner may degrade.

In the present invention, a wax can also be contain in the toner materials along with the binder resin and the colorants.

The was used in the present invention is not particularly limited and may be suitably selected from those typically used, however, examples thereof include oxides of aliphatic hydrocarbon waxes such as low-molecular mass polyethylenes, low-molecular mass polypropylenes, polyolefin waxes, microcrystalline waxes, paraffin waxes, and Sasol Wax or block copolymers thereof; vegetable waxes such as candelilla waxers, caunauba waxes, sumac waxes, jojoba waxes; animal waxes such as bees waxes, lanolin waxes, whale wax; mineral waxes such as ozokerite, ceresin, and peterolatum; waxes containing an aliphatic ester as the main component such as montanic acid ester waxes and caster waxes, and waxes of which a part or the entire aliphatic ester such as deacidified caunauba waxes.

Further examples of the wax include saturated straight chain fatty acid such as palmitin acid, stearin acid, montanic acid, straight chain alkylcarboxylic acid having a long-chain alkyl group or the like; unsaturated fatty acid such as brassidic acid, eleostearic acid, prinaric acid or the like; saturated alcohol such as stearil alcohol, eicosyl alcohol, behenyl alcohol, carnaubic alcohol, ceryl alcohol, mesilyl alcohol or long-chain alkyl alcohol; polyvalent alcohol such as solbitol; fatty acid amide such as linoleic acid amide, olefin acid amide, laulic acid amide or the like; saturated fattcy acid bisamide such as methylenebiscapric acid, ethylenebis laulic acid amide, hexamethylenebisstearic acid amide or the like; unsaturated fatty acid amide such as ethylenebis oleic acid amide, hexamethylenebis olecic acid amide, N,N'-dioleyl adipic acid amide, N,N'-dioleyl cebacic acid amide or the like; aromatic bisamide such as m-xylene bisstearic acid amide, N,N-distearyl isophthalic acid amide or the like; fatty acid metal salt such as calcium stearate, calcium laurate, zinc stearate, magnesium stearate or the like; wax in which fatty acid hydrocarbon wax is grafted using a vinyl monomer such as styrene or acrylic acid; a partially esterified compound of fatty acid such as behenic acid monoglyceride, a polyvalent alcohol or the like; and a methyl-esterified compound having a hydroxyl group which is obtained by hydrogenating a vegetable oil.

More preferable examples of the wax include polyolefin which are subjected to a radical polymerization under high pressures; polyolefin of which low-molecule mass by-product materials obtained when high-molecule mass polyolefin is polymerized; polyolefin polymerized under low pressures using a catalyst such as Ziegler catalyst, and metallocene catalyst; polyolefin polymerized by utilizing radiant ray, electromagnetic ray, or light; low-molecular mass polyolefin obtained by pyrolizing a high-molecular mass polyolefin; paraffin wax, microcrystalline wax, Fisher Tropsch wax; synthesized hydrocarbon wax synthesized by Synthol process, Hidrocol process, Arge process, and the like; synthesized wax having a compound of 1 carbon atom as monomer; hydrocarbon wax having a functional group like hydroxyl group or carboxyl group; mixtures of hydrocarbon wax and hydrocarbon wax having a functional group; and graft-modified wax that the base of the above-mentioned wax is grafted by using a vinyl monomer such as styrene, ester maleate, acrylate, methacrylate, and maleic acid anhydride.

In addition, those having a sharp molecular mass distribution prepared by press exudation method, solvent method, re-crystallization method, supercritical gas extraction method or solution crystallization method; and those in which low-molecule mass solid fatty acids, low-molecule solid alcohol, low-molecule solid compounds, and other impurities are removed are also preferably used.

The melting point of the wax is preferably 70° C. to 140° C. for redressing the balance between fixing property and anti-offset property, and more preferably 70° C. to 120° C. When the melting point of the wax is less than 70° C., the anti-blocking property may degrade, and when the melting point is more than 140° C. anti-blocking property, anti-offset property may be hardly exerted.

By using a combination of two or more different waxes, both plasticization effect and releasing effect can be exerted at the same time.

Examples of waxes having plasticization effect include waxes each having a low-melting point, waxes each having a branched molecule structure, and waxes each having a polar group.

Examples of waxes having releasing effect include waxes each having a high-melting point, and examples of the molecular structure include straight chain molecules, and nonpolar molecules having no functional group. Examples of the combination include a combination of two or more different waxes that the difference in melting point is 10° C. to 100° C., and a combination of a polyolefin and graft-modified polyolefin.

When two different types of wax are selected, and the two waxes respectively have a similar structure, a wax having relatively low melting point exert plasticization effect, and the other wax i.e. a wax having high melting point exerts releasing effect. Here, when the difference in melting point is in the range of 10° C. to 100° C., the functional separation is effectively exerted. When the difference in melting point between the two waxes is less than 10° C., the functional separation may be hardly exerted. When the difference in melting point is more than 100° C., functional emphasis from mutual interaction may be hardly exerted. Here, the melting point of at least one of the waxes is preferably 70° C. to 120° C., and more preferably 70° C. to 100° C., because the functional separation effect tends to be easily exerted.

For the above mentioned wax, those having a branched structure, those having a polar group like functional group, and those modified with a component which is different from the main component respectively exert plasticization effect, and those having a straight chain structure, nonpolar wax which has no functional group, and unmodified straight wax respectively exerts releasing effect. Preferred combinations thereof include a combination of a polyethylene homopolymer having an ethylene as the main component or a polyolefin homopolymer having a copolymer and olefin other than ethylene as the main component, or a copolymer; a combination of a polyolefin and a graft-modified polyolefin; a combination of an alcohol wax, a fatty acid wax or an ester wax and a hydrocarbon wax; a combination of Fisher Tropsch wax or a polyolefin wax and a paraffin wax or a microcrystal wax; a combination of a paraffin wax and a microcrystal wax; and a combination of a carnauba wax, candelilla wax, a rice wax or a montan wax and a hydrocarbon wax.

In endothermic peak observed in toner DSC measurement, it is preferable that each of these waxes has a peak top temperature of the maximum endothermic peak within the range of 70° C. to 110° C., and more preferably, it has the maximum endothermic peak within the range of 70° C. to 110° C.

The total content of the wax is preferably 0.2 parts by mass to 20 parts by mass, and more preferably 0.5 parts by mass to 10 parts by mass with respect to 100 parts by mass of the binder resin.

In the present invention, the peak top temperature of the maximum endothermic peak of a wax measured in DSC is to be a melting point of the wax.

As for the DSC measuring unit of the wax or the toner, a high-precision internal combustion input compensation type of differential scanning calorimeter is preferably used for the measurement. The endothermic peak measurement is performed in compliant with ASTM D3418-82. As for the DSC curve used in the present invention, the temperature of the wax or the toner is raised once and lowered, record the temperature history, and then the DSC curve measured when the temperature of the wax or the toner is raised at 10° C./min. is used.

In the present invention, the charge controlling agent commonly used for an electrophotographic toner may be used together with the binder resin and the colorant.

If a colored material is used for the charge controlling agent, the toner may show different tones of color and, therefore, colorless materials or materials close to white are preferably used. Examples of the charge controlling agent include metal a metal-complex containing dye, a fluoride-modified quaternary ammonium salt, a metal salt of salicylic acid, a metal salt of salicylic acid derivative, and the like. In addition, the metal can be appropriately selected depending on the intended purpose. Examples of the metal include aluminum, zinc, titanium, strontium, boron, silicon, nickel, iron, chrome, zirconium, and the like.

For the charge controlling agent, commercially available products may be used. Examples thereof include Bontron E-82 of an oxynaphthoic acid metal complex, Bontron E-84 of a salicylic acid metal complex, and Bontron E-89 of a phenol condensate (produced by Orient Chemical Industries, Ltd.); LRA-901, and LR-147 of a boron metal complex (produced by Japan Carlit Co., Ltd.); quinacridones; azo pigments; and high-molecular mass compounds having sulfonic acid, carboxylic acid or a quaternary ammonium salt; and the like.

The content of the charge controlling agent in the toner can be appropriately determined depending on kinds of the binder resins, kinds of the additives, and dispersing methods, and the charge controlling agent is preferably added in an amount of 0.1 parts by mass to 10 parts by mass based on 100 parts by mass of the resin particles and, more preferably 0.2 parts by mass to 5 parts by mass. If more than 10 parts by mass thereof is used, the charging properties of the toner becomes exceedingly enhanced, resulting in reducing the effect of the charge controlling agent primarily used, and an electrostatic suction force that presses toner against developing rollers increases. Thus, it may cause reduction in the flowability of the developer and in image density.

Moreover, these charge controlling agents and releasing agents are melt-kneaded together with master batch, and/or the binder resin to use. Alternatively, these can be added a the time when they are dissolved or dispersed in an organic solvent, but the charge controlling agent(s) for use needs to be finely pulverized by means of a wet-pulverizer such as a beads mill, and then dispersed in the organic solvent so as not to clog an ejection hole.

Examples of the magnetic material for use in the present invention include (1) magnetic iron oxides such as magnetite, maghemite, and ferrite, and iron oxides containing other metal oxides; (2) metals such as iron, cobalt, and nickel, or alloys of these metals with metals such as aluminum, cobalt, copper, lead, magnesium, tin, zinc, antimony, beryllium, bismuth, cadmium, calcium, manganese, selenium, titanium, tungsten, and vanadium; and (3) mixtures thereof.

Specific examples of the magnetic material include $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PdFe_{12}O$, $NiFe_2O_4$, $NdFe_2O$, $BaFe_{12}O_{19}$, $MgFe_2O_4$, $MnFe_2O_4$, $LaFeO_3$, iron powders, cobalt powders, and nickel powders. Each of these magnetic materials may be used alone or in combination with two or more. Of these, fine powders of ferrosoferric oxide ($Fe_3O_4$), and $\gamma$-iron sesquioxide ($\gamma$-$Fe_2O_3$) are suitably used.

In addition, magnetic iron oxides such as magnetite, maghemite, and ferrite each containing different elements, and mixtures thereof may be used. Examples of the different elements include lithium, beryllium, boron, magnesium, aluminum, silicon, phosphorus, germanium, zirconium, tin, sulfur, calcium, scandium, titanium, vanadium, chromium, manganese, cobalt, nickel, copper, zinc, and gallium. The preferred different elements are selected from magnesium, aluminum, silicon, phosphorus, and zirconium. Each of these different elements may be taken in crystal lattice of an iron oxide, or may be taken in an iron oxide as an oxide, or may exist as an oxide or a hydroxide on the surface of an iron oxide, and preferably, each of these different elements is contained as an oxide.

Salts of these different elements may be mixed in the each of these different elements in the course of producing the magnetic material and subjected to a pH adjustment to thereby be taken in particles of the iron oxide. In addition, after particles of the magnetic material are prepared, the each of these different elements may be precipitated on particle surfaces of the iron oxide by subjecting the each of these different elements to a pH adjustment or by adding salts of each of these elements and subjecting them to a pH adjustment.

The usage of the magnetic materials is preferably 10 parts by mass to 200 parts by mass and more preferably 20 parts by mass to 150 parts by mass relative to 100 parts by mass of the binder resin. The number average particle diameter of these magnetic materials is preferably 0.1 μm to 2 μm, and more preferably 0.1 μm to 0.5 μm. The number average particle diameter can be determined by measuring a photograph magnified by use of a transmission electron microscope using a deditizer.

With respect to magnetic properties of the magnetic materials, the ones having magnetic properties of an anti-magnetic force of 20 oersted to 150 oersted, a saturated magnetization of 50 emu/g to 200 emu/g, and a remanent magnetization of 2 emu/g to 20 emu/g under application of 10K oersted are preferably used.

The glass transition temperature of the binder resin can be appropriately selected depending on the intended purpose. The glass transition temperature of the binder resin is preferably 30° C. to 80° C., more preferably 40° C. to 70° C. If the glass transition temperature is lower than 30° C., the thermal stability of toner may be decreased. If the glass transition temperature is higher than 80° C., the low-temperature fixing property may be insufficient.

The glass transition temperature (Tg) as used herein is determined in the following manner using TA-60WS and DSC-60 (Shimadzu Corp.) as a measuring device under the conditions described below.

[Measurement Conditions]

Sample container: aluminum sample pan (with a lid)
Sample amount: 5 mg
Reference: aluminum sample pan (10 mg of alumina)
Atmosphere: nitrogen (flow rate: 50 ml/min)
Temperature condition:
Start temperature: 20° C.
Heating rate: 10° C./min
Finish temperature: 150° C.
Hold time: 0
Cooling rate: 10° C./min
Finish temperature: 20° C.
Hold time: 0
Heating rate: 10° C./min
Finish temperature: 150° C.

Measurement results are analyzed using date analysis software (TA-60, version 1.52, Shimadzu Corp.). The glass transition temperature is determined from DrDSC curve—a DSC transition curve for the second heating operation—by a glass transition temperature analysis function of the device. In the present invention the first shoulder portion of the graph, where glass transition starts, is defined as the glass transition temperature.

The thus obtained toner may be added with external additives such as a flowability improving agent, a cleaning ability improving agent, and the like. The flowability improving agent functions and contributes to improve the flowability of the toner, namely to make the toner easy to flow.

Examples of the flowability improving agent include carbon black; fluoride resin powders such as fluorinated vinylidene fine powders, and polytetrafluoroethylene fine powders; silica fine powders such as wet-process silicas, dry-process silicas; titanium oxide fine powders, alumina fine powders, and surface-treated silicas of which the silica fine powder, the titanium oxide fine powder or the alumina fine powder is subjected to a surface treatment using a silane coupling agent, a titanium coupling agent, or a silicone oil; surface-treated titanium oxide fine powders, and surface-treated aluminas. Of these, silica fine powders, titanium oxide fine powders, and alumina fine powders are preferably used. Treated silicas of which the silica fine powder, the nonoxidized titanium fine powder or the alumina fine powder is subjected to a surface treatment using a silane coupling agent or a silicone oil are more preferably used.

With respect to the particle diameter of the flowability improving agent, the primary average particle diameter is preferably 5 nm to 500 nm, and more preferably 7 nm to 120 nm.

The silica fine powers are fine powers produced by vapor-phase oxidation of a silicon-halogen compound and referred to as so-called dry-process silica or fumed silica.

Examples of commercially available silica fine powers produced by vapor-phase oxidation of a silicon-halogen compound include AEROSIL-130, AEROSIL-300, AEROSIL-380, AEROSIL-TT600, AEROSIL-MOX170, AEROSIL-MOX80, and AEROSIL-COK84 (manufactured by NIPPON AEROSIL CO., LTD.); Ca—O—SiL-M-5, Ca—O—SiL-MS-7, Ca—O—SiL-MS75, Ca—O—SiL-HS-5, and Ca—O—SiL-EH-5 (manufactured by CABOT Corp.); Wacker HDK-N20 V15, Wacker HDKV-N20E, Wacker HDK-T30, and Wacker HDK-T40 (manufactured by WACKER-CHEMIE GMBH); D-CFine Silica (manufactured by Dow Corning Co., Ltd.); and Fransol (manufactured by Fransil Sa).

Further, hydrophobized silica fine powers produced by hydrophobizing silica fine powder produced by vapor-phase oxidation of a silicon halogen compound are more preferably used. For the hydrophobized silica fine powders, since the hydrophobization degree of hydrophobized silica fine powers measured in methanol titration test is 30% to 80%, hydrophobized silica fine powders are particularly preferable. Hydrophobization is given by chemically or physically treating silica fine powder with an organic silicon compound capable of reacting with or physically absorbing silica fine powder. As a preferred hydrophobization, it is preferable to employ a method in which a silica fine powder produce by vapor-phase oxidation of a silicon halogen compound is hydrophobized with an organic silicon compound.

Examples of the organic silicon compound include hydroxypropyltrimethoxysilane, phenyltrimethoxysilane, n-hexadecyltrimethoxysilane, n-octadecyltrimethoxysilane, vinylmethoxysilane, vinyltriethoxysilane, vinyltriacetoxysilane, dimethylvinylchlorosilane, divinylchlorosilane, γ-methacryloxypropyltrimethoxysilane, hexamethyldisilane, trimethylsilane, trimethylchlorosilane, dimethyldichlorosilane, methyltrichlorosilane, allyldimethylchlorosilane, allylphenyldichlorosilane, benzyldimethylchlorosilane, bromomethyldimethylchlorosilane, α-chlorethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, trimethylethoxysilane, trimethylmethoxysilane, methyltriethoxysilane, isobutyltrimethoxysilane, dimethyldimethoxysilane, diphenyldiethoxysilane, hexymethyldisiloxane, 1,3-divinyltetramethyldisiloxane, 1,3-diphenyltetramethyldisiloxane, and dimethylpolysiloxane having 2 to 12 siloxanes per molecule and containing 0 to 1 hydroxyl group which is bound to Si at each of the terminals of the siloxanes, and further include silicone oils such as dimethylsilicone oil. Each of these may be used alone or in combination with two or more.

The number average particle diameter of the flowability improving agent is preferably 5 nm to 100 nm, and more preferably 5 nm to 50 nm.

The specific surface area of the flowability improving agent based on nitrogen absorption measured by BET method is preferably 30 $m^2/g$ or more, and more preferably 60 $m^2/g$ to 400 $m^2/g$.

The specific surface area of a surface-treated fine powder based on nitrogen absorption measured by BET method is preferably 20 $m^2/g$ or more, and more preferably 40 $m^2/g$ to 300 $m^2/g$.

The usage of these fine powders is preferably 0.03 parts by mass to 8 parts by mass relative to 100 parts by mass of toner particles.

A cleaning improver is added to the toner to remove a developer remaining on a photoconductor and on a primary transferring member after a transferring step. Examples thereof include fatty acid metal salts such as zinc stearate, calcium stearate, stearic acid, and resin particles prepared by soap-free emulsion polymerization such as polymethylmethacrylate particles and polystyrene particles. Among these, polymer particles with a relatively narrow particle size distribution are preferable, and polymer particles with a volume-average particle diameter of 0.01 μm to 1 μm are more preferable.

To the toner of the present invention, other additives can be suitably added in accordance with the necessity, aiming at protecting latent electrostatic image bearing member and carrier, improving cleaning ability, controlling thermal property, electric property, and physical property, controlling resistance property, controlling softening point, and improving fixing rate. Examples of the other additives include various metal soaps, fluoride surfactants, dioctyl phthalate; conductivity imparting agents such as tin oxides, zinc oxides, carbon black, and antimony oxides; and inorganic fine powders such as titanium oxides, aluminum oxides, and aluminas. Each of these inorganic fine powders may be hydrophobized in accordance with the necessity. In addition, it is possible to use a small amount of lubricant such as polytetrafluoroethylene, zinc stearate, and polyfluorovinylidene; and abrasive such as cesium oxides, silicon carbides, and strontium titanate; and caking protecting agents. Besides, white fine particles and black fine particles having a reverse polarity from the polarity of toner particles can be further added as developing property improving agent.

It is also preferable that each of these additives is treated with treatment agents such as silicone varnish, various types of modified-silicone varnish, silicone oil, various types of silicone oil, silane coupling agent, silane coupling agent having a functional group, and other organic silicon compounds or other types of treatment agents, aiming at controlling the charge amount of the toner.

The method for producing a toner of the present invention will be explained hereinafter.

The method for producing a toner of the present invention contains ejecting a toner composition fluid from an ejection hole so as to make the toner composition fluid in droplets, and atomizing the droplets in an atomizing atmosphere so as to form solid particles. As the means for ejecting the toner composition fluid from the ejection hole and the making the toner composition fluid into the droplets, there are the following methods.

(1) A method in which the toner composition fluid is ejected from a nozzle plate which is vibrated at a constant frequency, while applying pressure (hereinafter, this method will be referred as Rayleigh breakup method).

(2) A method in which the toner composition fluid is made into droplets by the vibrations caused by the sound pressure generated adjacent to the ejection hole (hereinafter, this method will be referred as a film vibration method).

The Rayleigh breakup method is classified into a method where the nozzle plate to which the ejection hole is disposed is directly vibrated, and a method where a retention section is vibrated. The film vibration method is classified into a method where a plane opposed to the nozzle plate of the retention section is vibrated by using a horn transducer (hereinafter, referred as a horn type film vibration method), and a method where a nozzle plate is connected to a transducer and then the nozzle plate is directly vibrated (hereinafter, referred as a ring type film vibration method).

At first, the principle of the Rayleigh breakup method will be briefly explained.

The uniform jets phenomenon of a liquid column is explained in Rayleigh, Loard "On the Instability of Jets" Proc. London Math. Soc. 110:4. As explained in the aforementioned literature, the wavelength condition λ at which the liquid column becomes the most unstable is represented by the following formula (1) using the diameter of the liquid column dj.

$$\lambda=4.5dj \tag{1}$$

The frequency f of the disturbance generated at this time is represented by the following formula (2) where a velocity of the liquid column is expressed as v.

$$f=v/\lambda \tag{2}$$

As explained in Schneider J. M., C. D. Hendricks, Rev. Instrum. 35(10), 1349-50, the conditions for stably forming the uniform particles were determined as a result of the experiments, and it has been confirmed that the uniform particles can be stably formed at the condition represented by the following formula (3).

$$3.5<\lambda/dj<7.0 \tag{3}$$

As explained in Lindblad N. R. and J. M. Schneider, J. Sci. Instrum. 42, 635, the minimum jet velocity Vmin at which the liquid ejected from the ejection hole forms the liquid column is represented by the following formula (4) based on the law of the conservation of energy.

$$V\min=(8\sigma/\rho dj)^{1/2} \tag{4}$$

In the formulae (1)-(4), σ denotes a surface tension of the liquid, ρ denotes a density of the liquid, and dj denotes a diameter of the liquid column. These formulae are effective to presume the conditions for reproducing such the aforementioned phenomena. However, we have confirmed that these relative formulae can be varied depending on the materials, mixed components, or dispersant of the liquid. Nevertheless, the phenomena for forming droplets as a result of such the disturbance are seen using the various liquid as a result that the transducer is disposed in the retention section and is vibrated at a frequency f.

The apparatus to be used for the method for producing a toner in accordance with the Rayleigh breakup method (hereinafter, may be referred to as an apparatus for producing a toner, or a toner production apparatus) is selected from the apparatus known in the art without any restriction, provided that it produces a toner in accordance with the method for producing a toner of the present invention. However, it is preferable to use a toner production apparatus containing a droplet forming unit configured to eject a toner composition fluid, which is a liquid state of the toner composition containing the colorant formed by reacting at least a polymer and a basic dye, from a nozzle plate vibrated at a constant frequency so as to form droplets, and a toner particle forming unit configured to remove the solvent contained in the droplets so as to dry the droplets, to thereby yield the toner particles. In the toner production apparatus, the droplet forming unit contains a vibration unit configured to directly vibrate the nozzle plate. More preferably, the vibration unit vibrates the nozzle plate at the same time as the toner composition fluid is passing through the nozzle plate. Moreover, the apparatus contains a retention section configured to retain the toner composition fluid. The retention section is preferably provided with a retention section in which the toner composition fluid is retained, and is configured to vibrate the nozzle plate by vibrating the retention section.

Note that, the vibration unit contains at least a vibration generating unit (transducer), and may also contain a vibration amplifier and the like.

Figure 2:
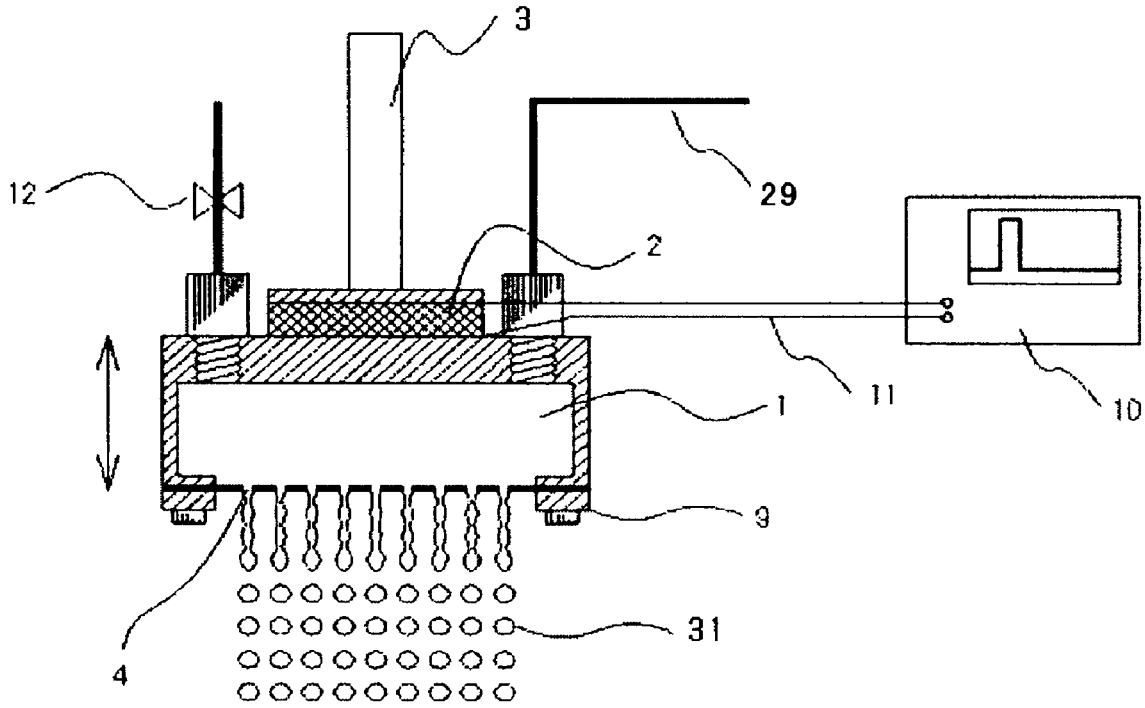
FIG. 2 is a diagram explaining one example of a droplet forming unit which vibrates a retention section.

As shown in FIGS. 1 and 2, the retention section 1 where the toner composition fluid is retained is connected with a fluid supplying tube 29 which is configured to supply the fluid to the retention section 1, and the retention section 1 is provided with a housing 9 which holds a plate having ejection holes 4. Moreover, the retention section 1 is connected with a vibration unit 2 configured to vibrate the entire retention section 1. The vibration unit 2 is preferably controlled in a manner such that the vibration unit 2 is connected with a waveform generating device 10 via a conductive trace 11. Furthermore, in order to produce various different products, it is preferred that the retention section 1 is provided with a drain 12 which removes the liquid retained in the retention section 1 in view of the productivity.

The retention section 1 is required at least to retain the toner composition fluid at the pressurized state. Therefore, the retention section 1 is preferably formed from the members formed of a metal such as SUS, aluminum, and the like, and preferably has a resistance for a pressure of an approximately 10 MPa. However, the embodiment of the retention section 1 is not construed to limit thereby.

The vibration unit 2 is preferably configured to vibrate the entire retention section 1 having ejection holes 4 by means of a single transducer. As the vibration unit 2 which applies the vibrations to the retention section 1, any means can be suitably selected without any restriction, provided that it accurately applies the vibrations at a constant frequency. Examples thereof include a piezoelectric element which functions to convert the electrical energy to the physical energy. Specifically, the piezoelectric element exhibits telescopic motion as the voltage is applied, and this telescopic motion gives the vibrations to the ejection holes 4.

Examples of a material used for the piezoelectric element include piezoelectric ceramic such as lead zirconate titanate (PZT). Since lead zirconate titanate (PZT) has a small displacement amount, and thus in many cases, it may be used as a laminate structure thereof. Other examples of the material used for piezoelectric element include a piezoelectric polymer such as polyvinylidene fluoride (PVDF), and a single crystal such as crystal quartz, $LiNbO_3$, $LiTaO_3$, or $KnbO_3$.

The aforementioned constant frequency is appropriately adjusted depending on the intended purpose without any restriction. For example, the constant frequency is preferably 50 kHz to 50 MHz, more preferably 100 kHz to 10 MHz, and even more preferably 100 kHz to 450 kHz, as microscopic droplets having an extremely uniform particle diameter are formed.

The vibration unit 2 is adjacently disposed to the retention section 1 equipped with the plate having the ejection holes 4. In order to uniformly vibrate the liquid columns generated from the ejection holes 4, the vibration unit 2 and the plate having the ejection holes 4 are most preferably disposed parallel to each other. Even in the case where some deformation is caused in the process of the vibration, the located relation of the vibration unit 2 and the plate having ejection holes 4 is preferably maintained within the tilted angle of 10 degrees or less.

As the ejection hole 4, only a single ejection hole may be disposed and it is possible to produce particles with the single ejection hole. However, in view of the efficient formation of fine droplets having the extremely uniform particle size, it is preferable that a plurality of ejection holes are disposed, and the droplets ejected from each ejection holes are dried in a solvent removal system, e.g. a solvent removal system 6 in the drawing.

The number of the ejection hole formed on the nozzle plate is adjusted depending on the intended purpose without any restriction. However, it is preferably 1 to 3,000, more preferably 1 to 2,000, and even more preferably 200 to 1,500 for the purpose of more accurately forming fine droplets having the extremely uniform particle diameter.

The holding unit 3 which fixes and holds a part of the vibration unit 2 is disposed so as to fix the retention section 1 and the vibration unit 2 in the apparatus. The material of the holding unit 3 is suitably selected without any restriction provided that it is a rigid material such as a metal. Optionally, a part of the holding unit 3 is equipped with a rubber material or resin material as a vibration relaxant so as to suppress any fluctuation in the vibration of the retention section 1 caused by the excessive resonance.

The ejection hole 4 is a hole configured to eject the toner composition fluid as the liquid column. The material and shape of the nozzle plate having the ejection hole 4 are suitably selected depending on the intended purpose without any restriction. For example, the nozzle plate having the ejection hole 4 is a metal plate having a thickness of 5 μm to 100 μm, preferably 5 μm to 50 μm, and an aperture size of the ejection hole 4 is 1 μm to 40 μm, as the prevention of the clog of the ejection hole by the fine particles having a diameter of 1 μm or less dispersed in the toner composition fluid, and the formation of fine droplets having the extremely uniform particle diameter at the vibration frequency of 100 kHz or more are both realized. The vibration frequency is estimated to be 100 kHz or more in view of the productivity, as the frequency region in which the droplets are stably formed by the droplet phenomenon is substantially decreased as the aperture size of the ejection hole 4 is increased. Note that, the aperture size is a diameter in the case where the aperture is in the shape of a circle, and is a minor axis in the case where the aperture is in the shape of an oval.

The fluid supplying system 5 is preferably a constant rate pump such as a tube pump, gear pump, rotary pump, clinger pump, or the like. Moreover, the fluid supplying system 5 may be a pump which is configured to supply the fluid by the pressure such as a condensed air. The retention section is filled with the toner composition fluid by means of the fluid supplying system 5, and moreover the fluid supplying system 5 enables to increase the internal pressure of the retention section to the level at which the formation of droplets is realized. The liquid pressure may be measured by means of a pressure gate equipped with the pump or a pressure sensor designed for an exclusive use for this system.

The solvent removal system 6 is suitably selected without any restriction, provided that it removes the solvent from the droplets 31. The solvent removal system 6 is preferably configured to blow the dry gas 14 in the same direction as the ejection direction of the droplets 31 so as to generate an air flow, to convey the droplets 31 within the solvent removal system 6 by the air flow, and to remove the solvent contained in the droplets 31 during the conveying to thereby form toner particles 15. Note that, "dry gas" denotes a gas having the dew-point temperature of −10° C. or lower under the atmospheric pressure. The dry gas is suitably selected without any restriction provided that the gas enables to dry the droplets 31. Examples thereof include air, nitrogen gas, and the like.

The toner collection section 25 is a member mounted at the bottom of the toner production apparatus in order to effectively collect and convey the toner. The configuration of the toner collection section 25 may be suitably designed without any restriction, provided that the toner collection section 25 enables to collect the toner. However, from the viewpoint stated above, as exemplarily shown in the drawing, it is preferable that the toner collection section 25 is tapered in such manner that an aperture diameter thereof is gradually narrowed, and the toner particles 15 are transferred by the dry gas 14 which flows downwards from the outlet of the toner collection section 25 which has a narrower aperture diameter than that of the inlet of the toner collection section 25 so as to convey the toner particles 15 to the toner storage vessel 32 which is disposed downstream with respect to the toner collection section 25.

As a conveyance method of the toner particles 15, the toner particles 15 may be pressurized and conveyed to the toner storage vessel 32 by the flow of the dry gas 14 as shown in the drawing. Alternatively, the toner particles 15 may be suctioned from the side of the toner storage vessel 32. The direction of the flow of the dry gas 14 is not particularly restricted, but it is preferably a voted flow, as the fine particles are removed from the toner particles 15 by the centrifugal force generated by the flow.

Furthermore, it is preferable that the toner collection section 25 and the toner storage vessel 32 are respectively made of a conductive material, and both of them are connected to an earth lead from the perspective that the conveyance of the toner particles 15 is effectively performed. In addition, the toner production apparatus is preferably an explosion-proof.

Figure 3:
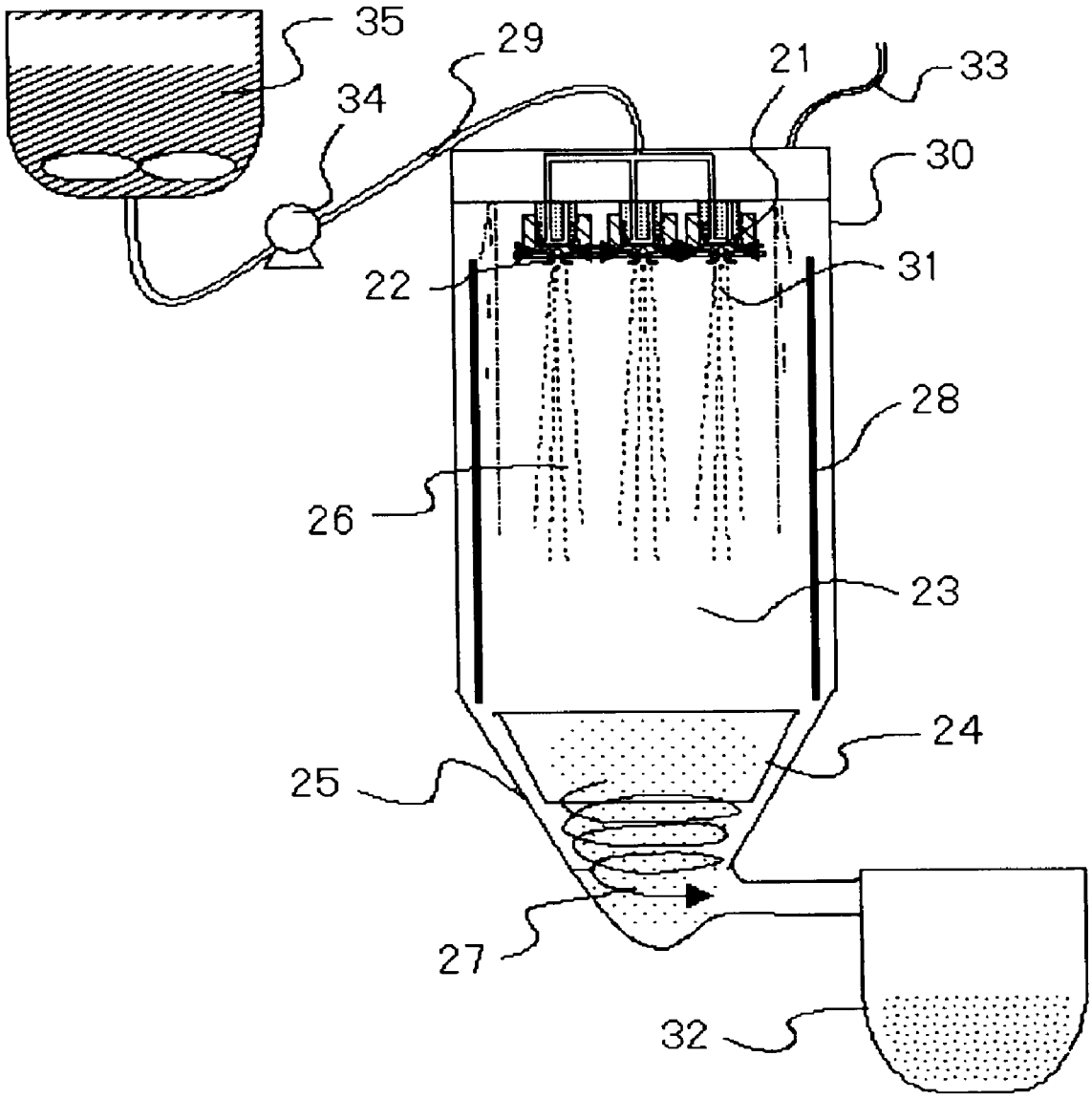
FIG. 3 is a schematic diagram showing an apparatus (the apparatus for producing a toner) containing a large number of the droplet forming units.

As shown in FIG. 3, the preferable embodiment of the apparatus is such that the apparatus contains at least a toner composition fluid storage vessel 35 as the retention section, a nozzle plate 21 as the droplet forming unit disposed in a drying vessel 30, an electrode 22, a solvent removal system 23 as the toner particle forming unit, a discharger 24, and a toner collection section 25.

In the toner production apparatus shown in FIG. 3, the dissolved or dispersed solution retained in the toner composition fluid storage vessel 35 is supplied to the fluid supplying unit 34 via a fluid supplying tube 29, and the amount of the fluid to be supplied is controlled by the fluid supplying unit 34. The solution is then passed through the fluid supplying flow path 37, and ejected from the ejection holes formed on the nozzle plate 21 to form droplets 31. Thereafter, the droplets 31 are charged by the electrode 22, and the solvent is removed from the droplets 31 by the solvent removal system 23 so as to form toner particles 26. The toner particles 26 are then discharged by the discharger 24, collected in the toner collection section 25 by the vortex flow 27, and then conveyed to the toner storage vessel 32.

Each member of the toner production apparatus shown in FIG. 3 will be specifically explained hereinafter.

The nozzle plate 21 shown in FIG. 3 is a member configured to eject the toner composition fluid, which is a liquid state of the toner composition, so as to form droplets.

The material and shape of the nozzle plate are suitably designed depending on the intended purpose without any restriction. For example, the nozzle plate is a metal plate having a thickness of 5 μm to 100 μm, preferably 5 μm to 50 μm, as well as having a single or plurality of the ejection holes, each having an aperture size of 1 μm to 40 μm. Such the configuration is preferable, as the shearing force is imparted to the toner composition fluid at the time of being ejected from the ejection holes as a result of that the retention section 1 itself is vibrated, and thus it is capable of forming fine droplets having extremely uniform diameters. Note that, the aperture size denotes a diameter in case where the aperture is in the shape of a round, and a minor axis in case where the aperture is in the shape of an oval.

The constant frequency is appropriately adjusted depending on the intended purpose without any restriction. For example, the constant frequency is preferably 50 kHz to 50 MHz, more preferably 100 kHz to 10 MHz, and even more preferably 100 kHz to 450 kHz, as microscopic droplets having an extremely uniform particle diameter are formed.

The nozzle plate 21 may have only one ejection hole. However, in view of the efficient formation of fine droplets having the extremely uniform particle size, it is preferable that the nozzle plate 21 has plurality of ejection holes, and the droplets 31 ejected from each ejection holes are dried in a solvent removal system, e.g. the solvent removal system 23 in the drawing.

Figure 4:
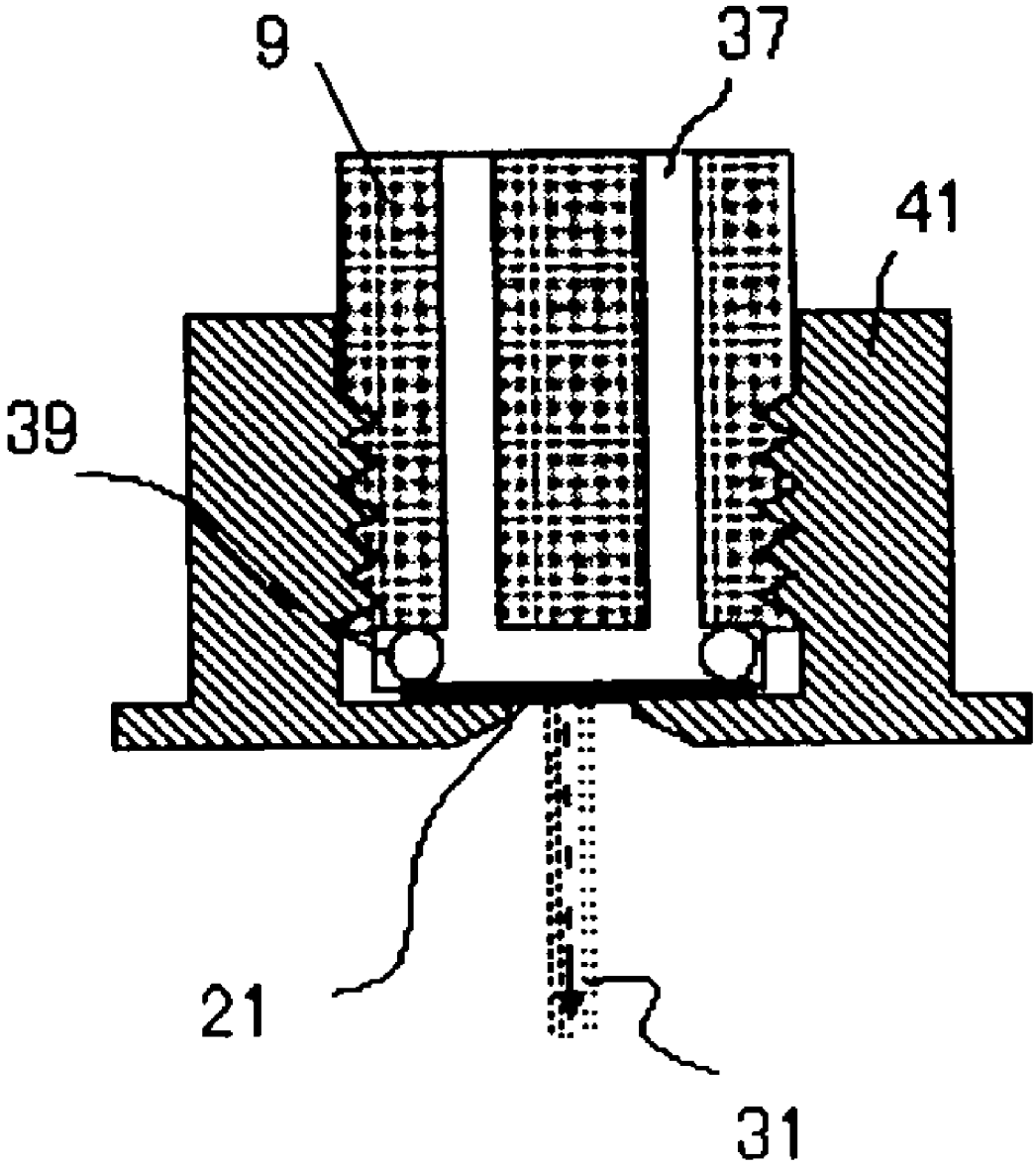
FIG. 4 is a diagram explaining the droplet forming unit which vibrates a nozzle plate.

FIG. 4 shows an example of the droplet forming unit configured to directly vibrate the nozzle plate. In this embodiment, the vibration unit 41 is bonded to the nozzle plate 21, and the nozzle plate 21 is pressed against the housing 9 via an O-shaped ring 39. The toner composition fluid is supplied through the fluid supplying flow path 37 formed by spacing between the nozzle plate 21 and the O-shaped ring 39, and is formed into liquid columns. The droplets are formed by faintly vibrating the nozzle plate 21, and are released into the drying system.

The number of the ejection hole formed on the nozzle plate is adjusted depending on the intended purpose without any restriction. However, it is preferably 1 to 3,000, more preferably 1 to 2,000, and even more preferably 200 to 1,500 for the purpose of more accurately forming fine droplets having the extremely uniform particle diameters.

The solvent removal system 23 is suitably selected without any restriction, provided that it removes the solvent from the droplets 31. The solvent removal system 23 is preferably configured to blow the dry gas 14 in the same direction as the ejection direction of the droplets 31 so as to generate the air flow, to transfer the droplets 31 within the solvent removal system 23 by the air flow, and to remove the solvent contained in the droplets 31 during the transferring to thereby form toner particles 26. Note that, "dry gas" denotes a gas having the dew-point temperature of −10° C. or lower under the atmospheric pressure.

The dry gas is suitably selected without any restriction provided that the gas enables to dry the droplets 31. Examples thereof include air, nitrogen gas, and the like.

The method for sending the dry gas into the solvent removal system 23 is suitably selected without any restriction. Examples thereof include, as shown in FIG. 3, a method for sending a dry gas through dry gas supplying tube 33.

The dry gas preferably has a high temperature in view of the drying efficiency. Even if a dry gas having a boiling point higher than that of the solvent contained in the droplets is employed, the temperature of the droplets will never be increased higher than the boiling point of the solvent in the constant-drying-rate area in the course of drying owing to spray drying properties, and thus a toner to be obtained will not suffer from thermal damages. However, since the main constituent material of the toner is a thermoplastic resin, the toner particles are prone to thermally fuse to each other after drying, namely, when the thermoplastic resin is exposed to a dry gas having a temperature higher than the boiling point of the resin in the decreasing-drying-rate area, it involves the risk that the monodispersity of the toner is impaired. Thus, specifically, the temperature of the dry gas is preferably 40° C. to 200° C., more preferably 60° C. to 150° C., and particularly preferably 75° C. to 85° C.

In addition, as shown in FIG. 3, from the perspective of preventing the droplets 31 from adhering on the internal surface of the solvent removal system 23, it is preferable that an electric field curtain 28 which is charged with a reverse polarity from the charge polarity of the droplets 31 is arranged on the internal surface of the solvent removal system 23 to form a carrier path surrounded by the electric field curtain 28 and then to pass the droplets to the carrier path.

The discharger 24 is a member configured to temporarily neutralize the charged toner particles 26 formed by passing the droplets 11 through the carrier path to thereby house the toner particles 26 in the toner collection section 25.

The discharging method using the discharger 24 is not particularly restricted and may be suitably selected from those known in the art. It is preferable to discharge by means of, for example, soft X-ray irradiation, and plasma irradiation, from the perspective that the charge can be effectively eliminated.

The configuration of the toner collection section 25 may be suitably designed without any restriction, provided that the toner collection section 25 enables to collect the toner. However, from the viewpoint stated above, as exemplarily shown in the drawing, it is preferable that the toner collection section 25 is tapered in such manner that an aperture diameter thereof is gradually narrowed, and the toner particles 26 are transferred by the dry gas which flows downwards from the outlet of the toner collection section 25 which has a narrower aperture diameter than that of the inlet of the toner collection section 25 so as to convey the toner particles 15 to the toner storage vessel 32 which is disposed downstream with respect to the toner collection section 25.

As a conveyance method of the toner particles 26, the toner particles 26 may be pressurized and conveyed to the toner storage vessel 32 by the flow of the dry gas as shown in the drawing. Alternatively, the toner particles 26 may be suctioned from the side of the toner storage vessel 32.

The direction of the flow of the dry gas 14 is not particularly restricted, but it is preferably a voted flow, as the fine particles are removed from the toner particles 26 by the centrifugal force generated by the flow.

Furthermore, it is preferable that the toner collection section 25 and the toner storage vessel 32 are respectively made of a conductive material, and both of them are connected to an earth lead from the perspective that the conveyance of the toner particles 26 is effectively performed. In addition, the toner production apparatus is preferably an explosion-proof.

As previously mentioned, the droplets 31 are formed by ejecting the dissolved or dispersed solution of the toner composition containing a certain substances through the nozzle plate 21 vibrated at the constant frequency. The details of the toner composition will be mentioned later.

According to the method for producing a toner of the present invention described above in details, the number of droplets 31 formed from the ejection holes of the nozzle plate 21 is considerably large i.e several tens of thousands of droplets per second to millions of droplets per second, and it is possible to further increase the number of ejection holes with ease. In addition, droplets having extremely uniform diameters can be obtained, and thus it can be easily said that the method for producing a toner is the most suitable method for producing a toner in view of its sufficient productivity. Furthermore, in the present invention, the particle diameter of the toner to be finally obtained can be determined with accuracy by use of the following equation (1), and there is hardly any difference in the particle diameter, no matter which materials are used.

$$Dp=(6QC/\pi f)^{(1/3)} \qquad \text{Equation (1)}$$

In the equation (1), Dp denotes a diameter of a solid particle, Q denotes a flow rate of a solution (determined depending on the pump flow rate and the nozzle diameter), f denotes a vibration frequency, and C denotes a volume concentration of solid contents.

Although the toner particle diameter can be accurately calculated with the equation (1), the toner particle diameter can be more simply calculated with the following equation (2).

$$\text{Volume concentration of solid contents(\% by volume)}=(\text{Solid particle diameter/Droplet diameter})^3 \qquad \text{Equation (2)}$$

Namely, the diameter of toner particles 26 obtainable in the present invention is twice of the aperture diameter of the nozzle plate 21, regardless of the vibration frequency serving to eject the droplets 31. Therefore, it is possible to obtain an intended diameter of a solid particle by preliminarily calculating the concentration of solid contents based on the equation (2) and adjusting the same. For example, in the case where the nozzle diameter is 7.5 μm, the droplet diameter will be 15 μm. Then, when the volume concentration of solid contents is adjusted to 6.40% by volume, solid particles each having a particle diameter of 6.0 μm can be obtained. In this case, the higher the vibration frequency is the more desirable in terms of productivity. However, the flow rate Q is to be determined from the equation (1) using the vibration frequency determined here.

The horn type film vibration method will be explained as follow.

The droplet forming unit in the horn type film vibration method has a film (i.e. a nozzle plate) disposed in the retention section and having a plurality of nozzles (i.e. ejection holes), and is configured to vibrate and excite the toner composition fluid contacting the film. Since the film has a relatively large area (a diameter of 1 mm or more), the droplet forming unit enable to stably form droplets from the plurality of nozzles (ejection holes).

Figure 5:
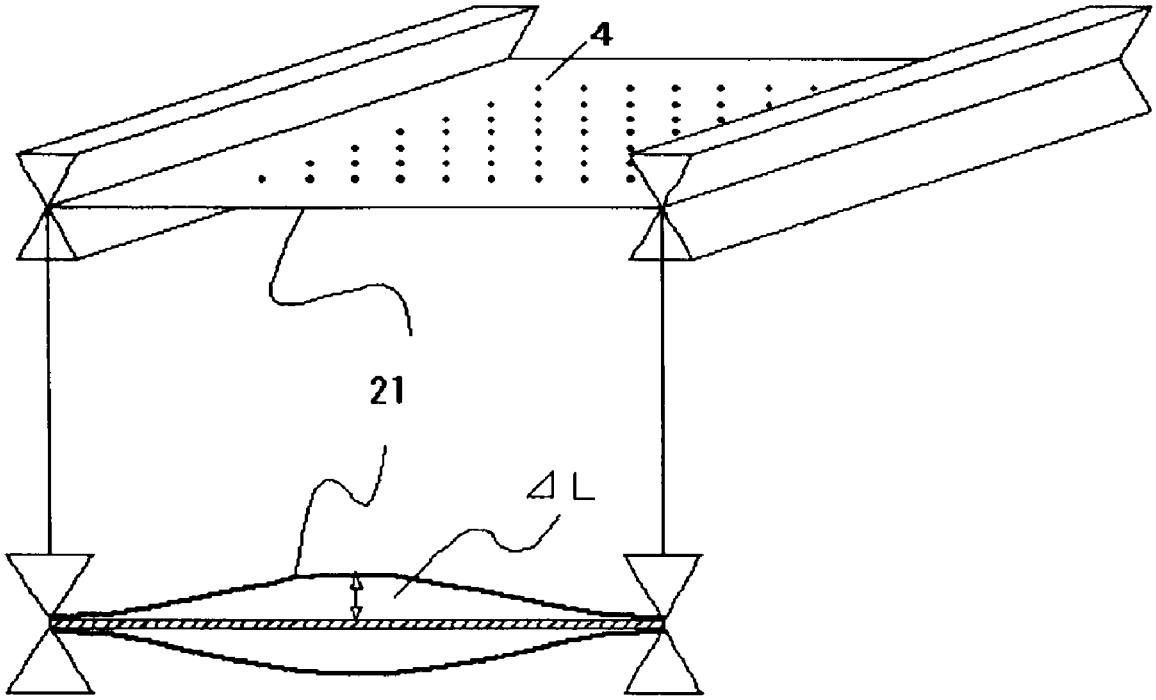
FIG. 5 is a schematic diagram showing a nozzle plate along with one example of the principles of the formation of droplets in accordance with the present invention.

FIG. 5 shows a cross-sectional view of the nozzle film (hereinafter, may also referred to a nozzle plate) having the nozzles (ejection holes).

Figure 6:
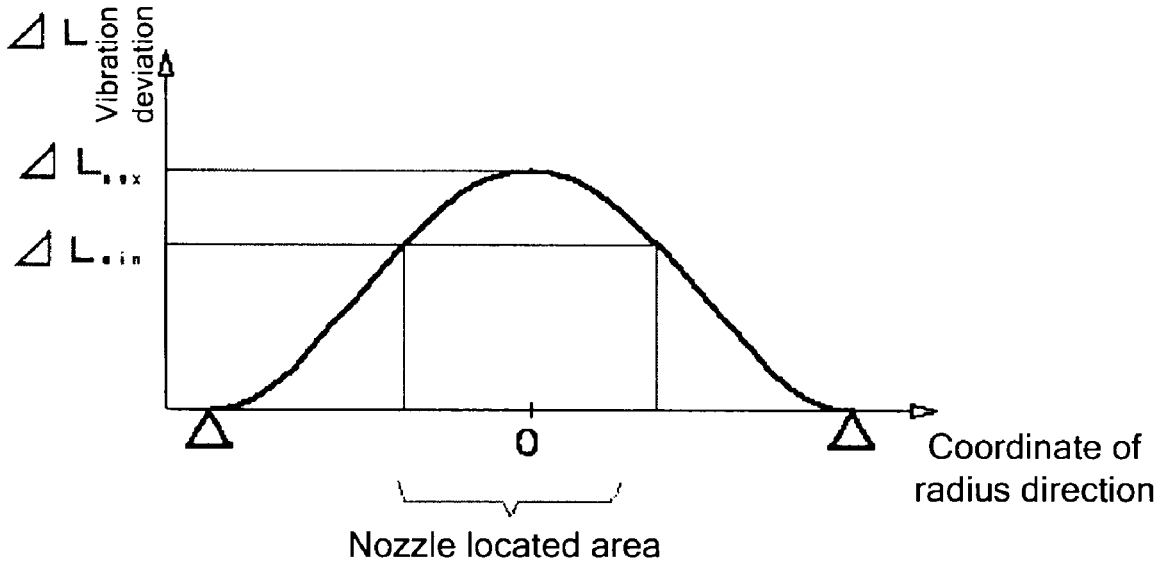
FIG. 6 is a diagram explaining one example of basic vibration mode in accordance with the present invention.
Figure 7:
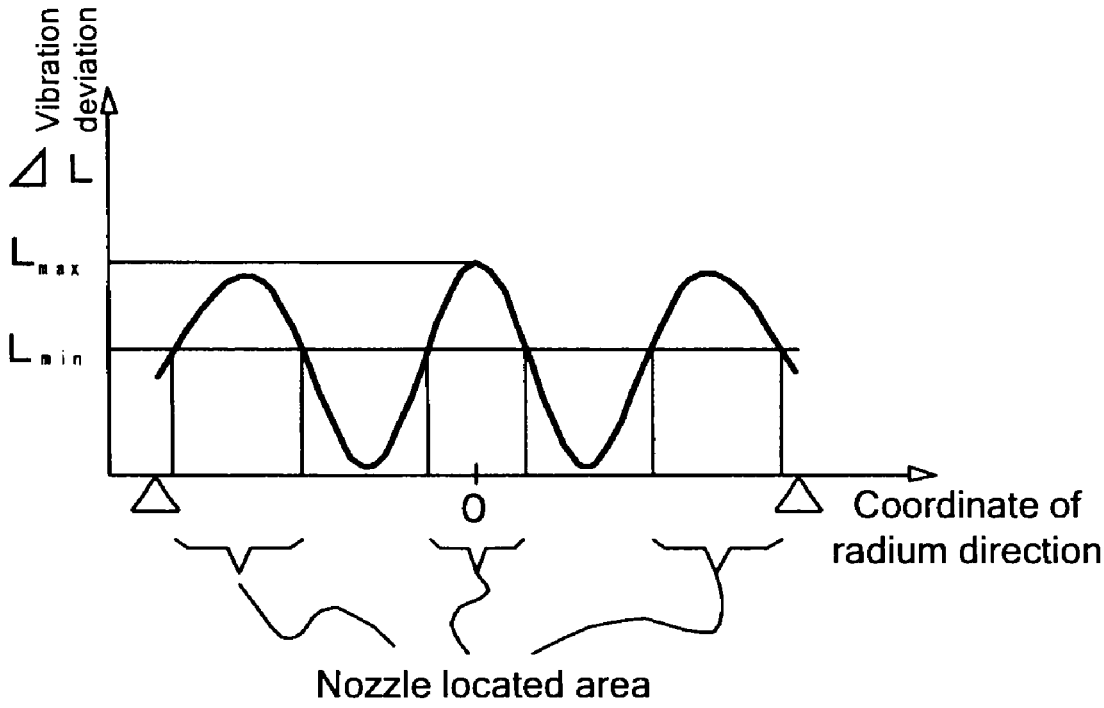
FIG. 7 is a diagram explaining one example of secondary vibration mode in accordance with the present invention.

In the case where the perimeter of the nozzle plate 21 is fixed, basic vibrations are periodical up-down vibrations in the vibrating direction in the cross-sectional shape as shown in FIG. 6 in which the perimeter functions as a node and the deviation ΔL becomes a maximum at the center (a coordinate 0 in the direction of the radius) of the nozzle plate 21. Moreover, there is a mode of higher order as shown in FIG. 7.

The vibrations of the nozzle plate generate sound pressure $P_{ac}$, which is proportional to the vibration velocity $V_m$ of the nozzle plate, to the fluid adjacent to the ejection holes 4 disposed in nozzle plate. It has been known that the sound pressure is generated as a counter effect of radiation impedance $Z_r$ of the medium (toner composition fluid), and the sound pressure is the product of the radiation impedance and the vibration velocity Vm of the nozzle plate and is expressed by the following equation (3).

$$P_{ac}(r,t)=Z_r\cdot V_m(r,t) \qquad \text{Equation (3)}$$

The vibration velocity $V_m$ of the nozzle plate is the function of the time (t) as the vibration velocity $V_m$ is periodically fluctuated, and thus various periodical fluctuations such as a sine wave, rectangular wave can be formed.

Moreover, as previously mentioned, the vibration deviation in the direction of the vibration is different depending on the part of the nozzle plate 21, and thus the vibration velocity $V_m$ is also the function of the position coordinate. Since the preferable vibration form of the nozzle plate is a symmetrically transformed form in the radium direction as mentioned above, it is practically the function of the radius (r).

As has been mentioned above, the sound pressure proportional to the vibration deviation velocity of the nozzle plate 21 having a distribution is generated, and the toner composition fluid is ejected to a gas phase corresponding to the periodical fluctuation of the sound pressure.

The toner composition fluid periodically released into the gas phase is made into a sphere as a result of the difference between the surface tension of the fluid phase and the surface tension of the gas phase, and thus droplets are formed periodically.

The vibration frequency of the nozzle plate 21 sufficient enough to form droplets is in the range of 20 kHz or more but less than 2.0 MHz, preferably 50 kHz to 500 kHz. The vibration period of 20 kHz or more promotes the dispersion of fine particles such as a pigment or wax in the toner composition fluid as the fluid is directly excited on the nozzle plate 21 having the ejection holes 4.

Moreover, when the deviation of the sound pressure is 10 kPa or more, the aforementioned dispersion of the fine particles is more effectively promoted.

The diameter of the droplet to be formed tends to be larger as the vibration deviation adjacent to the ejection hole 4 of the nozzle plate 21 is larger. In the case where the vibration deviation is small, small droplets are formed, or droplets are not formed. In order to reduce the variation in the size of the droplets formed from each of the ejection holes 4, it is necessary to regulate the positioning of the ejection holes 4 to the position of the nozzle plate 21 where has the most suitable vibration deviation.

As explained in FIGS. 6 and 7, the present inventors have found that the variations in the size of the droplets are controlled within a range sufficient enough to produce toner particles capable of providing high quality images by positioning the ejection holes 4 in an area in which a ratio R ($\Delta L_{max}/\Delta L_{min}$) of the maximum value $\Delta L_{max}$ and a minimum value $\Delta L_{min}$ of the vibration direction deviation $\Delta L$ of the nozzle plate 21 adjacent to the ejection hole 4 generated by the vibration unit is 2.0 or less.

The main factor of the variations in the size of the droplets is the generation of satellite particles. At the sound pressure of more than 500 kPa, the generation of few satellite particles is observed on the backend of the main droplet. From the results of the experiments changing the conditions of the toner composition fluid, the regions of the sound pressure at which the satellite particles are generated are the same at the viscosity of 20 mPa·s or less and the surface tension of 20 mN/m to 75 mNm. As a result, it can be said that the deviation of the sound pressure is preferably 101 Pa to 500 kPa, and more preferably 100 kPa or less.

Figure 8:
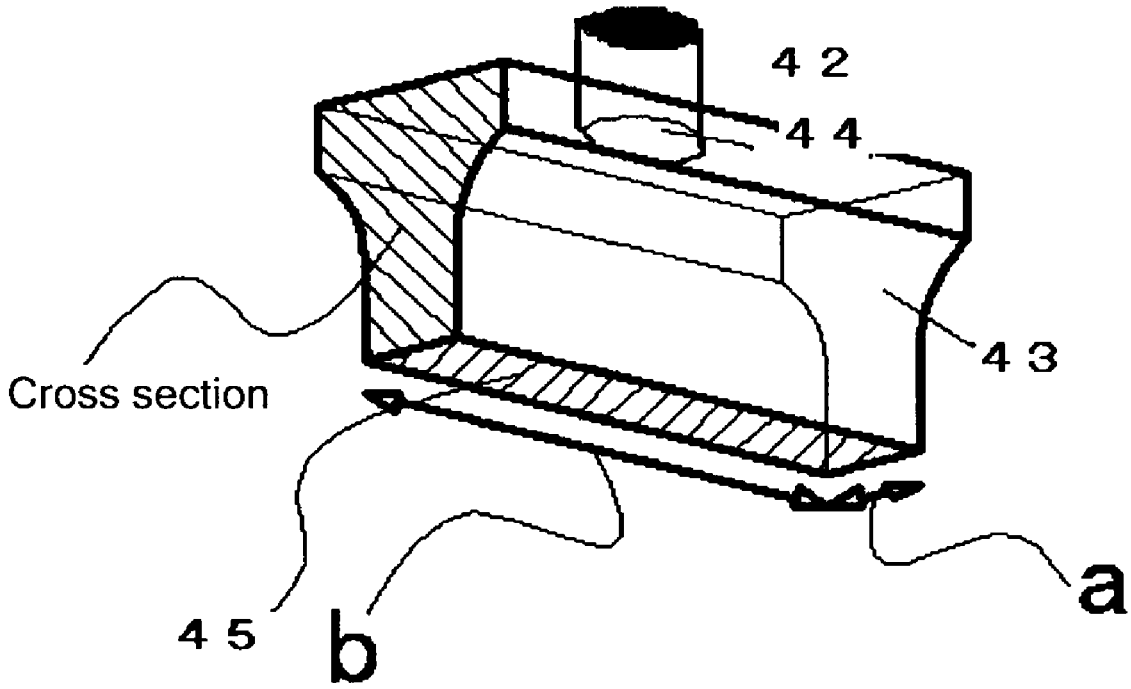
FIG. 8 is a diagram explaining a transducer and a vibration amplifier for use in the present invention.

The vibration unit for use in the present invention is required to provide accurate longitudinal vibrations at a constant frequency and a sufficient vibration fluctuation sufficient enough to atomize at a constant frequency. In order to achieve these vibrations uniformly in a larger area, as shown in FIG. 8, the vibration unit is required to contains a transducer 42 and a vibration amplifier 43 configured to amplify the vibration of the transducer 42 to a large area wherein the transducer 42 and the vibration amplifier 43 are connected on the composition surface 44.

As the transducer 42, it is preferable to use a piezoelectric material having a function to change electrical energy to physical energy. Specifically, the piezoelectric material enables to vibrate the nozzle plate 21 by applying the voltage.

Examples of the piezoelectric material include piezoelectric ceramics such as lead zirconate titanate (PZT) and the like. In the case where the deviation amount thereof is small, a laminate of the piezoelectric material can be used. Other examples of the piezoelectric material are piezoelectric polymers such as polyvinylidene fluoride (PVDF) and the like, monocrystals such as crystal, $LiNbO_3$, $LiTaO_3$, $KNbO_3$, and the like.

The shape of the vibration amplifier 43 is not restricted provide that it longitudinally vibrates with respect to the nozzle plate. The suitable example thereof is a horn amplifier. The horn amplifier is configured to amplify the vibrations of the vibration unit, and thus the vibrations of the vibration unit can be small. Therefore, the life time of the production device is prolonged as the result of the reduction of the physical load. The horn amplifier has a horn shape in the cross section thereof as shown in FIG. 8 and amplifies the vibrations, but the shape thereof does not need to be a symmetrical horn shape. The shape of the vibration plane 45 can be designed so as to be a rectangle, and thus it is possible to excite physical vibrations to a larger area than the vibration area of the transducer 42. Note that, the vibration plane may be a member disposed opposite to and parallel to the nozzle plate, or a plane of the vibration amplifier which is positioned opposite to and parallel to the nozzle plate. The vibration area is larger as the ratio (b/a) of a miner side of the short side (a) and long side (b) of the vibration plane of the vibration amplifier 43 is larger. In view of the productivity, the ratio b/a is preferably more than 2.0.

The retention section 1, the vibration unit 2, and the configurations of the nozzle plate 21 will be explained with reference to FIG. 9. The fluid supplying tube 29 (not shown in the drawing) is disposed at least one part of the retention section 1, and the toner composition fluid 7 is introduced in the retention section 1 via the fluid supplying path 37 as shown in the partial cross-sectional view. Moreover, the fluid may be circulated, as required. The nozzle plate 21 having a plurality of the ejection holes 4 is disposed so as to be parallel to the vibration plane 45 of the vibration amplifier 43, and a part of the nozzle plate 21 is connected with the housing. The connection is preferably a fixation by soldering, using a resinous bonding material insoluble to the toner composition fluid 7, or heat welding, but it is not limited to these examples. The vibration direction of the vibration amplifier 43 is substantially vertical. The conductive trace 11 is disposed to the upper and under surface of the upper transducer 42 of the vibration amplifier 43 so as to apply a voltage signal, and the signal transmitted from the waveform generating device 10 is converted into physical vibrations. As the conductive trace to apply the voltage signal, a lead wire in which the surface thereof is covered with an insulating material is suitably used.

Figure 10:
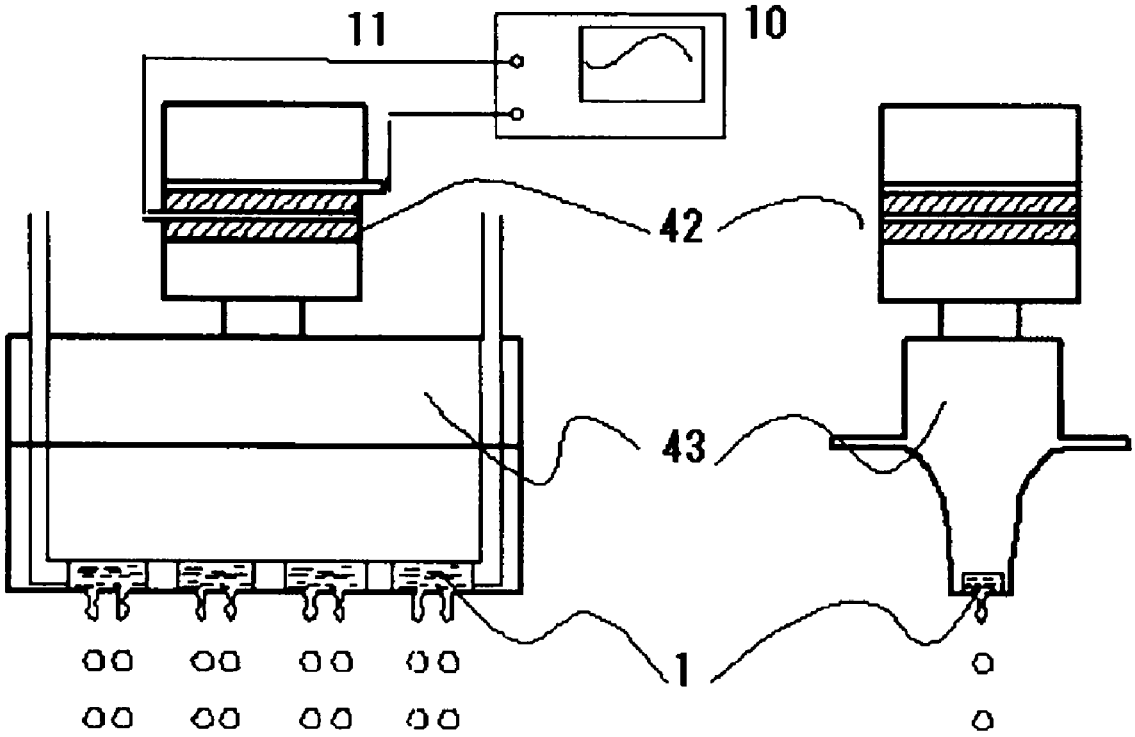
FIG. 10 is a diagram explaining another example of the droplet forming unit for use in the present invention.

The size of the vibration unit 2 which is a composite of the transducer 42 and the vibration amplifier 43 generally becomes larger as the frequency of vibration is reduced. The retension section is disposed by appropriately piercing directly through the vibration unit depending on the required frequency. Moreover, it is possible to efficiently vibrate the entire retention section 1. In this case, the vibration plane is a plane onto which the nozzle plate 21 having a plurality of ejection holes 4 is bonded. Such the configurations will be explained with reference to FIG. 10. In FIG. 10, the retention section 1 (partial cross-sectional view) may be disposed in the vibration amplifier 43. The vibration amplifier 43 is preferably fixed to the wall surface of the drying unit by means of the fixing unit, but it may also be fixed using an elastic material for the purpose of preventing the loss of the vibrations. Moreover, a plurality of the retention sections 1 may be disposed at parallel so as to be suitable for the vibrations.

The droplet forming unit explained above may have a plurality of the retention sections disposed on the upper part of the drying tower. Alternatively, a plurality of the retention sections may be disposed side wall of the drying unit or bottom part of the drying unit depending on the drying conditions. In view of the productivity, it is preferable to dispose a plurality of the droplet forming units at parallel. The number of the droplet forming units to be disposed is preferably 100 to 1,000 in view of the control. Although it is not shown in the drawing, each retention section is connected to the common fluid storage via pipes and the fluid is supplied to each retention section. The fluid is self-supplied by the droplet phenomenon, but it may be supplied by supplementary using a pump at the time of the operation of the device or the like.

As mentioned earlier, the nozzle plate is a member configured to eject the toner composition fluid so as to form droplets.

The material of the nozzle plate and the shape of the ejection hole 4 are suitably selected depending on the intended purpose without any restriction. For example, the nozzle plate is a metal plate having a thickness of 5 μm to 500 μm, and the ejection hole 4 has an aperture size of 3 μm to 35 μm, as fine droplets having extremely uniform particle size are formed. Note that, the aperture size denotes a diameter in case where the aperture is in a round and a miner axis in case where the aperture is an oval.

The units for use the process other than the droplet forming unit, such as the solvent removal system, discharger, toner collection unit and the like are the same as in the Rayleigh breakup method.

The ring type film vibrating method will be described next.

The toner production method in accordance with the ring type film vibration method contains periodically ejecting toner composition fluid containing at least a certain colorant from a plurality of ejection holes so as to periodically form droplets and release the droplets by means of the droplet forming unit, and solidifying the droplets of the toner composition fluid so as to form particles. In this method, the droplet forming unit contains a nozzle plate having a plurality of ejection holes, and a circular ring vibration unit disposed at the perimeter of the area of the nozzle plate where can be deformed, and configured to vibrate the nozzle plate.

The droplet forming unit has the nozzle plate which is formed in the shape of the convex in the direction where the droplets are released, and a plurality of the ejection holes are formed in the convex part of the nozzle plate. In this case, the convex part of the nozzle plate is in the shape of a circular cone, and the convex part preferably has R/h of 14 to 40 where h denotes a height of the circular cone, and R denotes a diameter of the bottom plane of the circular cone. Alternatively, the shape of the convex is a truncated cone, and the truncated cone has R/h of 14 to 40 and r/R of 0.125 to 0.375 where h denotes a height of the truncated cone, R denotes a diameter of the bottom plane of the truncated cone, and r denotes a diameter of the top plane of the truncated cone.

The droplet forming unit is preferably configured to vibrate the nozzle plate at the vibration mode which does not have any node in the direction of the diameter of the nozzle plate. Moreover, the droplet forming unit preferably vibrates the nozzle plate so that the vibration frequency of the nozzle plate is 20 kHz or more but less than 2.0 MHz. Furthermore, a plurality of the ejection holes are preferably disposed on an area of the nozzle plate at where the pressure applied to the toner composition fluid from the nozzle plate is in the range of 10 kPa to 500 kPa. A plurality of the ejection holes are also preferably disposed on an area at where the nozzle plate has a ratio R ($\Delta L_{max}/\Delta L_{min}$) of 2.0 or less where $\Delta L_{max}$ denotes the maximum value of the vibration direction deviation $\Delta L$ of the nozzle plate and $\Delta L_{min}$ denotes the minimum value of the vibration direction deviation $\Delta L$ of the nozzle plate.

In addition, the droplet forming unit has the nozzle plate which is a thin metal film having a thickness of 5 μm to 500 μm and has a plurality of ejection holes each having an aperture size of 3 μm to 35 μm. The droplet forming unit has preferably 2 to 3,000 ejection holes.

Hereinafter, the preferable embodiment to carry out the ring type film vibration method will be explained with reference to the attached drawings. At first, one example of the apparatus for producing a toner of the present invention in accordance with the method for producing a toner of the present invention will be explained with reference to a schematic diagram of FIG. 11.

The apparatus for producing the toner contains a droplet ejecting unit 13 equipped with a droplet forming unit 8 and a retention section 1, a solvent removal system 6 as a particle forming unit, disposed downstream of the droplet ejecting unit 13 and configured to solidify the droplets 31 of the toner composition fluid released from the droplet ejecting unit 13 so as to form toner particles 15, a toner collection section 25 configured to collect the toner particles 15 formed in the solvent removal system 6, a toner storage vessel 32 as a toner storage unit, configured to convey the toner particles 15 collected in the toner collection section 25 through a pipe arrangement and store the conveyed toner particles 15, a toner composition fluid storage vessel 35 configured to store toner composition fluid 7, a fluid supplying unit 5 configured to pressurize and send the toner composition fluid 7 from the toner composition fluid storage vessel 35 so as to supply the toner composition fluid 7 at the time of the operation or the like.

Figure 11:
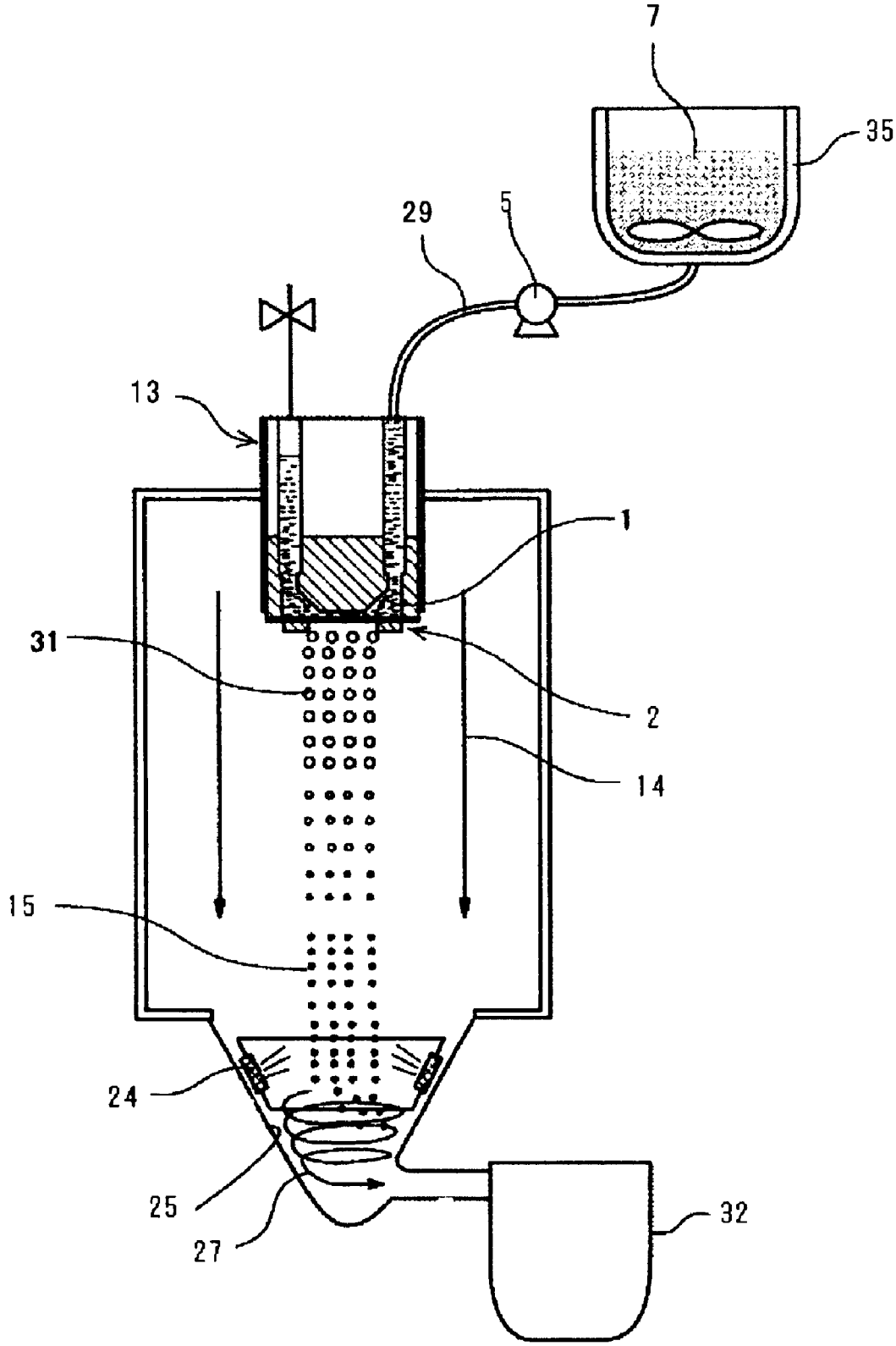
FIG. 11 is a diagram explaining one example of the apparatus for producing a toner.
Figure 12:
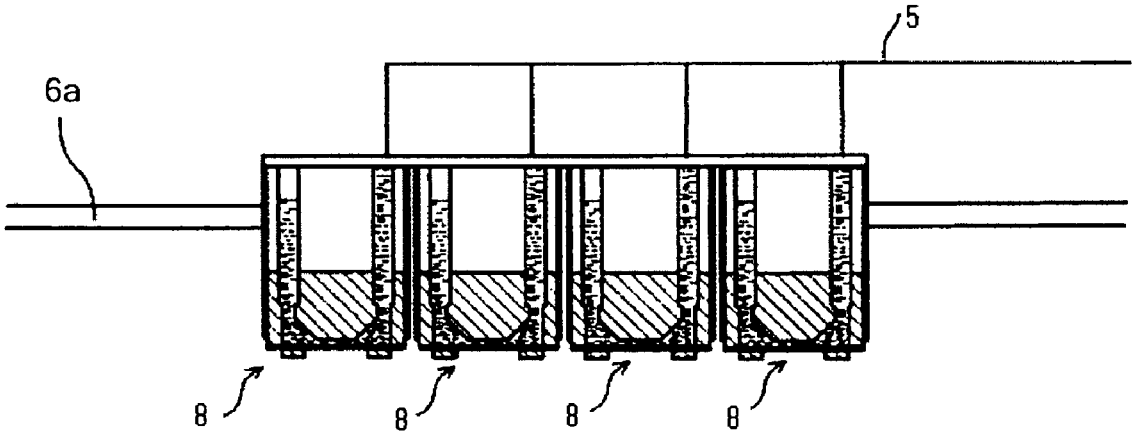
FIG. 12 is a diagram explaining another example of the droplet forming unit for use in the present invention.

FIG. 11 illustrates the example in which the single droplet ejecting unit 13 is disposed, but it is preferable to dispose a plurality of the fluid ejecting unit 13 as shown in FIG. 12. For example, it is preferable that 100 to 1,000 units (only 4 units are shown in FIG. 12) of the droplet ejecting unit 13 are aligned and disposed on the ceiling **6*a* of the solvent removal system 6 and each fluid ejecting unit 13 is supplied with the toner composition fluid 7 through the fluid supplying tube 29 connected with the toner composition fluid storage vessel 35**. In this manner, a large number of the droplets are released at once, and thus the production efficiency can be improved.

The toner composition fluid 7 is self-supplied from the toner composition fluid storage vessel 35 to the droplet ejecting unit 13 by the droplet forming phenomenon of the droplet ejecting unit 13, but the toner composition fluid 7 is supplied by supplementary using the fluid supplying unit 5 at the time of the operation of the apparatus or the like, as mentioned earlier. The toner composition fluid for use here is a dissolved solution or dispersion in which the toner composition containing at least a colorant formed by reacting a polymer and a basic dye is dissolved or dispersed.

Figure 13:
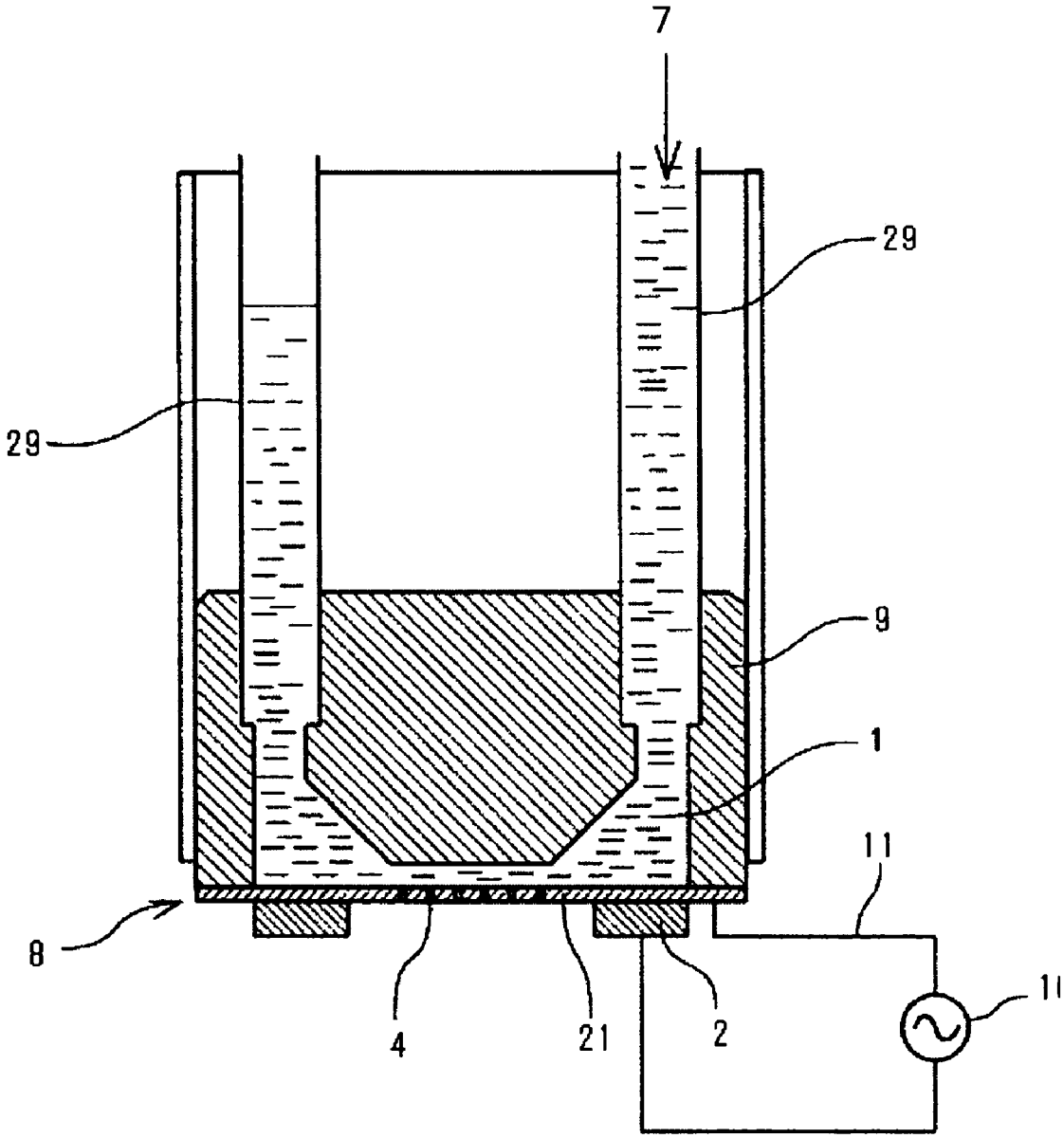
FIG. 13 is an enlarged view explaining a droplet ejecting unit of the apparatus for producing a toner shown in FIG. 12.
Figure 14:
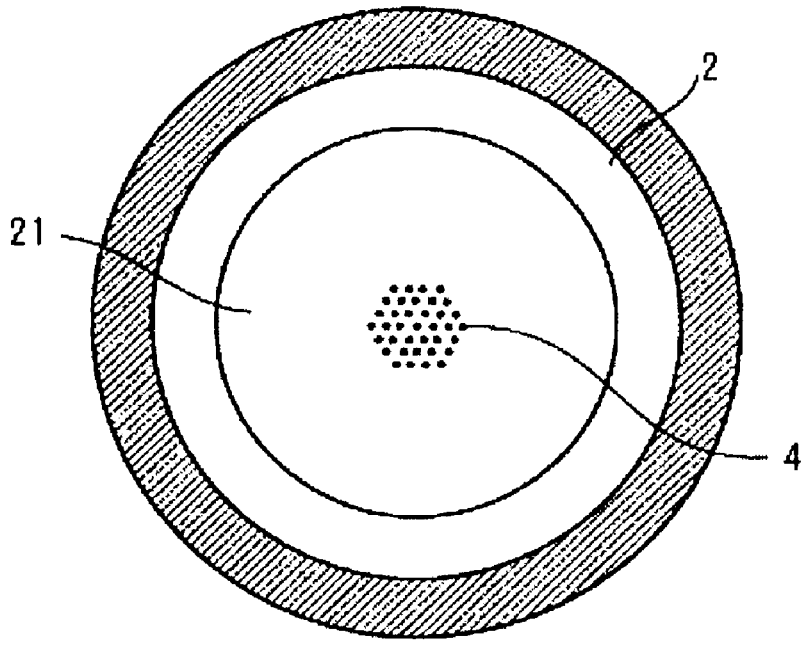
FIG. 14 is a bottom plane view showing FIG. 13 from the bottom side.
Figure 15:
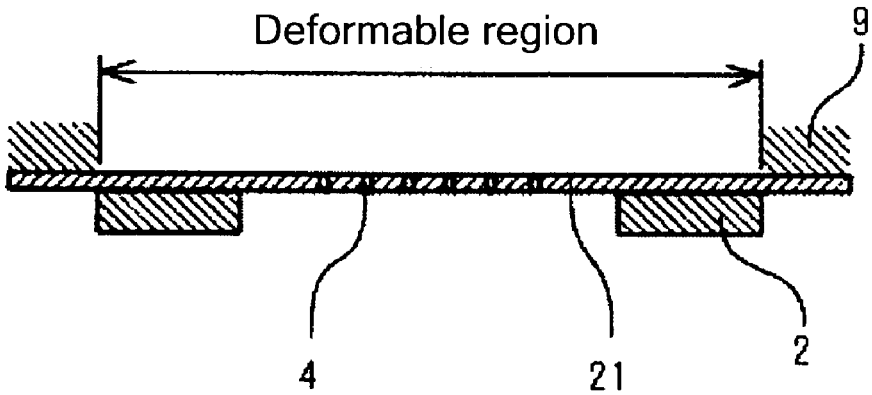
FIG. 15 is an enlarged cross-sectional view of the droplet forming unit.

The droplet ejecting unit 13 will be explained next, with reference to FIGS. 13 to 15. Note that, FIG. 13 is a cross-sectional diagram of the droplet ejecting unit 13, FIG. 14 is a bottom plane view of the main part which is the view seeing FIG. 13 from the bottom side, and FIG. 15 is a schematic cross-sectional view of the droplet forming unit.

The droplet ejecting unit 13 contains at least a droplet forming unit 8 configured to eject the toner composition fluid 7 containing at least a colorant formed by reacting the polymer and the basic dye so as to form droplets, and a housing 9 formed with a retention section 1 supplying the toner composition fluid 7 to the droplet forming unit 8.

The droplet forming unit 8 contains a nozzle plate 21 having a plurality of ejection holes 4, and a circular ring vibration unit 2 configured to vibrate the nozzle plate 21. The outer circumferential part (the area shown with oblique lines in FIG. 14) of the nozzle plate 21 is connected with and fixed to the housing 9 by soldering or using a resinous bonding material. The nozzle plate 21 is disposed at the circumference within the deformable area (the area where is not fixed to the flow path). The vibration unit 2 is applied with a driving voltage (driving signal) of the required frequency from the waveform generating device 10 via a conductive trace 11 so as to generate, for example, deflection vibration.

The material of the nozzle plate 21 and the shape of the ejection hole 4 are suitably selected depending on the intended purpose without any restriction. For example, the nozzle plate is a metal plate having a thickness of 5 μm to 500 μm, and the ejection hole has an aperture size of 3 μm to 35 μm, as fine droplets having extremely uniform particle size are formed. Note that, the aperture size denotes a diameter in case where the aperture is in a round and a miner axis in case where the aperture is an oval. The number of the ejection holes 15 is preferably 2 to 3,000.

The method for producing a toner of the present invention by means of the apparatus for producing a toner having the aforementioned configurations will be explained next.

As mentioned above, a driving signal having the required frequency is applied to the vibration unit 2 of the droplet forming unit 8, while the retention section 1 of the droplet ejecting unit 13 is supplied with the toner composition fluid 7 in which the toner composition containing at least the colorant formed by reacting the polymer and the basic dye is dissolved or dispersed, so as to generate deflection vibrations to the vibration unit 2, the deflection vibrations of the vibration unit 2 periodically vibrate the nozzle plate 21, and the vibrations of the nozzle plate 21 make the toner composition fluid 7 retained in the retention section 1 eject from a plurality of the ejection holes 4 so as to periodically form droplets 31 and release the droplets 31 in the solvent removal system 6 (refer to FIG. 11).

Thereafter, the droplets 31 released in the solvent removal system 6 are conveyed by the a flow of dry gas 14 in the same direction to the flying direction of the droplets 31 in the particle forming section so as to remove the solvent from the droplets 31, to thereby form toner particles 15. The thus formed toner particles 15 are collected in the toner collection section 25 disposed downstream of the solvent removal system 6 by the flow of the gas 27, and the collected toner particles 15 are sent to the toner storage vessel 32 through the pipe arrangement so as to store.

In this manner, the droplet forming unit 8 of the droplet ejecting unit 13 has a plurality of the ejection holes 4. Therefore, the toner composition fluid is made into a plurality of droplets 31 and a large number of the droplets 31 are continuously released, and thus the production efficiency of the toner is significantly improved. In addition, as mentioned above, the droplet forming unit 8 contains the circular ring vibration unit 2 disposed at an circumference within the deformable area of the nozzle plate 21 having a plurality of ejection holes 4 facing the retention section 1. Therefore, a large deviation of the nozzle plate can be obtained, and a large number of the droplets 31 are stably released without causing any clogging by disposing a plurality of the ejection holes 4 in an area where the large deviation is obtained. As a result, the toner can be stably and efficiently produced. Moreover, it has been confirmed that the toner having monodispersity having such the particle size that has not been realized in the related art is obtained.

The units for use the process other than the droplet forming unit, such as the solvent removal system, discharger, toner collection unit and the like are the same as in the Rayleigh breakup method.

In accordance with the toner production method of the related art, the particle size of the toner largely varied depending on the materials for use. However, in accordance of the method of the present invention, particles having the targeted particle size can be continuously obtained by controlling the diameter of droplets at the time of ejecting and the concentration of the solids content.

As the toner obtained by the present invention has extremely uniform particle size, the toner particles have extremely high flowability. Therefore, in the case where external additives are added to the toner particles in order to lower the adherence of the toner to the apparatus for producing the toner or the like, its effect can be exhibited with extremely small usage amount of the external additives. This is one of the advantages of the present invention, as the external additives are preferably used as less as possible in view of the deterioration of the external additive caused by the stress or a safety hazard of the fine particles for the human body.

(Toner)

The toner of the present invention is the toner produced by the method for producing a toner of the present invention.

As a result of the method for producing a toner of the present invention, the toner has a particle size distribution of monodispersity.

Specifically, the particle size distribution (weight average particle diameter D4/number average particle diameter Dn) of the toner is 1.00 to 1.10, and preferably 1.00 to 1.05. Moreover, the weight average particle diameter D4 of the toner is preferably 1 μm to 6 μm.

The toner composition for use in the present invention is those used for the conventional toner for electrophotography. Namely, a binder resin such as styrene acryl resin, polyester resin, polyol resin, epoxy resin or the like is dissolved in a suitable organic solvent, a colorant is dispersed therein, and a releasing agent is dispersed or dissolved therein, this solution is then ejected from ejection holes to form fine droplets and the formed droplets are dried and solidified in accordance with the method for producing a toner of the present invention, to thereby produce the intended toner particles.

The shape, size and the like of the toner are suitably selected depending on the intended purpose without any restriction. However, it is preferable that the toner has the following average circularity, weight average particle diameter, and a ratio (D4/Dn) of the weight average particle diameter D4 to a number average particle diameter Dn.

The average circularity is a measure obtained by dividing the circumference of a circle that has the same area as an actual projected area of a toner particle by the circumference of that toner particle, and is preferably 0.900 to 0.980, more preferably 0.950 to 0.975. Note that it is preferable that the proportion of particles having the average circularity of less than 0.940 be 15% or less of the total particles.

In the case where the average circularity is less than 0.900, it may result in poor transfer properties and dust-free and high quality images may not be obtained. In the case where the average circularity is more than 0.980, it may cause problems such that cleaning failures occur on the photoconductor and transfer belt in an image-forming system equipped with a cleaning blade, causing smears on images. For example, in a case of formation of an image that occupies a large area of a sheet (e.g., photographic images), background depositions may occur, because, when paper feed failure or the like occurs, toner particles that have been used to develop the image remains unremoved and accumulates on the photoconductor, or, in that case, a charging roller which provides charges to the photoconductor becomes soiled by residual toner particles and thus its original charging ability may be impaired.

The average circularity can be measured using a flow particle image analyzer (e.g., FPIA-2000, produced by Sysmex Corp.) Measurements are made in the following manner. Tiny dusts in water are first removed by filtration so that the number of particles to be measured (e.g., circle equivalent diameter of 0.60 μm to less than 159.21 μm) is 20 or less per $10^{-3}$ $cm^3$, followed by addition of a few droplets of a nonionic surfactant (preferably "Contaminon" produced by Wako Pure Chemical Industries, Ltd.) and 5 mg of a sample to 10 ml of the water. The mixture is then homogenized using a distributed machine (UH-50, produced by SMT Co., Ltd.) for 1 minute at 20 kHz and 50 W/10 $cm^3$. Homogenization continues for a further 5 minutes, preparing a sample solution with a particle concentration of $4{,}000/10^{-3}$ $cm^3$ to $8{,}000/10^{-3}$ $cm^3$ (particles with a circle equivalent diameter of 0.60 μm to less than 159.21 μm). The particle size distribution of these particles is then determined as follows.

The sample solution is allowed to flow through a flat, transparent flow cell (thickness: about 200 μm) that extends in the flow direction. A flash lamp and a CCD camera are arranged on opposite sides of the flow cell to establish an optical path that crosses the flow cell. While the sample solution is running, a strobe light flashes at 1/30-second intervals to obtain a 2D image of each particle in the flow cell at a parallel range. By calculating the diameter of a circle that has the same area as the 2D image, the circle equivalent diameter of the particle is determined.

The circle equivalent diameters of 1,200 or more particles can be determined in about 1 minute, and the number and proportion (number-based %) of particles with a specified circle equivalent diameter can be determined on the basis of the circle equivalent diameter distribution. Measurement results (frequency % and accumulation %) can be obtained by dividing a particle size range (0.06 μm to 400 μm) into 226 channels (30 channels per octave). In actual measurements, particles with a circle equivalent diameter of 0.60 μm to less than 159.21 μm are subjected to measurements.

As measurement apparatuses of particle size distribution of toner particles by the Coulter Counter method, for example, Coulter Counter TA-II and COULTER MULTISIZER II (both are manufactured by Coulter) are used. A measurement method will be described below.

First, as a dispersant, 0.1 ml to 5 ml of a surfactant (preferably, polyoxyethylene alkyl ether: product name, DRYWELL) is added to 100 ml to 150 ml of an electrolytic aqueous solution. Note that the electrolytic solution was an approximately 1% NaCl aqueous solution prepared using primary sodium chloride, for example, ISOTON-II (by Beckmann Coulter Inc.). Subsequently, 2 mg to 20 mg of sample to be measured was further added. The sample suspension was sonicated for approximately 1 minute to 3 minutes using an ultrasonic dispersion device. By the measurement instrument using 100 μm-aperture, the weight and the number of toner particles were measured to produce its weight distribution and number distribution, from which the weight average particle diameter (D4) and number average particle diameter (Dn) were obtained.

For channels, 13 different channels were used—from 2.00 μm or more to less than 2.52 μm; from 2.52 μm or more to less than 3.17 μm; from 3.17 μm or more to less than 4.00 μm; from 4.00 μm or more to less than 5.04 μm; from 5.04 μm or more to less than 6.35 μm; from 6.35 μm or more to less than 8.00 μm; from 8.00 μm or more to less than 10.08 μm; from 10.08 μm or more to less than 12.70 μm; from 12.70 μm or more to less than 16.00 μm; from 16.00 μm or more to less than 20.20 μm; from 20.20 μm or more to less than 25.40 μm; from 25.40 μm or more to less than 32.00 μm; and from 32.00 μm or more to less than 40.30 μm—targeting particles having a diameter of from 2.00 μm or more to less than 40.30 μm.

The weight average particle diameter of the toner is suitably adjusted depending on the intended purpose without any restriction. For example, the weight average particle diameter is preferably 1 μm to 6 μm.

In the case where the weight average particle diameter is less than 1 μm, in a case of two-component developer, the toner may fuse to the carrier surface to reduce its charging properties as a result of a long-time agitation in a developing unit, and in a case of a one-component developer, toner filming may occur at a developing roller or toner may more likely to fuse to members such as blade because of its reduced layer thickness. In the case where the weight average particle diameter is more than 6 μm, it becomes difficult to obtain images of high resolution and high quality, and the variations in the toner particle diameter may be large when fresh toner is supplied to the developing unit to compensate the consumed toner.

The ratio D4/Dn of the weight average particle diameter D4 to the number average particle diameter Dn of the toner is preferably 1.00 to 1.10, more preferably 1.00 to 1.05.

In the case where ratio D4/Dn is more than 1.10, in a case of two-component developer, the toner may fuse to the carrier surface to reduce its charging properties as a result of a long-time agitation in the developing unit, and in a case of a one-component developer, a toner filming may occur at the developing roller or toner may more likely to fuse to members such as blades because of its reduced layer thickness. In addition, it becomes difficult to obtain images of high resolution and high quality, and the variations in toner particle diameter may be large when fresh toner is supplied to the developing unit to compensate the consumed toner.

In the case where the usage amount of the external additive which improves flowability is reduced, the flowability of the toner is decreased when the ratio (D4/Dn) of the weight average particle diameter D4 to the number average particle diameter Dn is more than 1.10, and as a result, the supplying performance of the toner from the toner container to the developing unit may be impaired.

The weight average particle diameter and the ratio D4/Dn of the weight average particle diameter D4 to the number-average particle diameter Dn can be determined using, for example, Coulter Counter TA-II, a particle size analyzer manufactured by Beckmann Coulter Inc.

(Developer)

The developer of the present invention contains the toner of the present invention and appropriately selected additional ingredients such as a carrier. The developer may be either a one-component or a two-component developer; however, when it is applied to high-speed printers that support increasing information processing rates of recent years, the two-component developer is preferable in view of achieving an excellent shelf life.

In the case of the one-component developer containing the toner of the present invention, the variations in the toner particle size are minimized even after consumption or addition of toner, and toner filming to a developing roller and toner adhesion to members such as blade to reduce layer thickness of the toner are prevented. Thus, it is possible to provide excellent and stable developing properties and images even after a long time usage of the developing unit, i.e. after long time agitation of developer. Meanwhile, in the case of a two-component developer containing the toner of the present invention, even after many cycles of consumption and addition of toner, the variations in the toner particle diameter are minimized and, even after a long time agitation of the developer in the developing unit, excellent and stable developing properties may be obtained.

In the case where the toner of the present invention is mixed with a carrier and used as a two-component developer, the carrier for use may be either the conventional carrier such as ferrite or magnetite, or a resin coated carrier.

The resin coated carrier contains carrier core particles, and a coating material which coats each surface of the carrier core particles.

The material for the core is appropriately selected from conventional materials without any restriction. For example, it is selected from materials based on manganese-strontium (Mn—Sr) of 50 emu/g to 90 emu/g and materials based on manganese-magnesium (Mn—Mg) are preferable. From the standpoint of securing image density, high magnetizing materials such as iron powder (100 emu/g or more) and magnetite (75 emu/g to 120 emu/g) are preferable. In addition, weak magnetizing materials such as copper-zinc (Cu—Zn)-based materials (30 emu/g to 80 emu/g) are preferable from the standpoint for achieving higher-grade images by reducing the contact pressure against the photoconductor having standing toner particles. These materials may be used singly or in combination.

The particle diameter of the core particles, in terms of weight average particle diameter, is preferably 10 μm to 150 μm, more preferably 40 μm to 100 μm.

In the case where the weight average particle diameter is less than 10 μm, fine particles make up a large proportion of the carrier particle distribution, causing carrier scattering due to reduced magnetization per one particle in some cases. In the case where it is more than 150 μm, the specific surface area of the particle decreases, causing toner scatterings and reducing the reproducibility of images, particularly the reproducibility of solid images in full-color images due to many solid images in full-color images.

The materials for the resin layer are appropriately selected from those known in the art depending on the intended purpose, without any restriction. Examples thereof include amino resin, polyvinyl resin, polystyrene resin, halogenated olefin resin, polyester resin, polycarbonate resin, polyethylene resin, polyvinyl fluoride resin, polyvinylidene fluoride resin, polytrifluoroethylene resin, polyhexafluoropropylene resin, a copolymer of vinylidene fluoride and acrylic monomer, a copolymer of vinylidene fluoride and vinyl fluoride, fluoroterpolymer such as terpolymer of tetrafluoroethylene, vinylidene fluoride and non-fluoride monomer, and silicone resin. These resins may be used singly or in combination.

Examples of the amino resin include urea-formaldehyde resin, melamine resin, benzoguanamine resin, urea resin, polyamide resin, and epoxy resin. Examples of the polyvinyl resin include acrylic resin, polymethyl methacrylate resin, polyacrylonitrile resin, polyvinyl acetate resin, polyvinyl alcohol resin, and polyvinyl butyral resin. Examples of the polystyrene resin include polystyrene resin, and styrene-acryl copolymer resin. Examples of the halogenated olefin resin include polyvinyl chloride. Examples of the polyester resin include polyethylene terephthalate resin, and polybutylene terephthalate resin.

The resin layer may contain such material as conductive powder depending on the application. Examples of the conductive powder include metal powder, carbon black, titanium oxide, tin oxide and zinc oxide. These conductive powders preferably have an average particle diameter of 1 μm or less. In the case where the average particle diameter is more than 1 μm, it may be difficult to control electrical resistance.

The resin layer may be formed by dissolving the silicone resin or the like into a solvent to prepare a coating solution, uniformly coating the surface of the core material with the coating solution by a known coating process, and drying and baking the core material. Examples of the coating process include immersion coating, spray coating, and the like.

The solvent is appropriately selected depending on the intended purpose, without any restriction. Examples thereof include toluene, xylene, methyl ethyl ketone, methyl isobutyl ketone, cellosolve, and butylacetate.

The baking process is not particularly limited and may be an externally heating process or an internally heating process, and can be selected from, for example, a process using a fixed type electric furnace, a fluid type electric furnace, a rotary type electric furnace or a burner furnace, and a process using microwave and the like.

The content of the resin layer in the carrier is preferably 0.01% by mass to 5.0% by mass. In the case where the content is less than 0.01% by mass, it may be difficult to form a uniform resin layer on the surface of the core particle, on the other hand, in the case where the content thereof is more than 5.0% by mass, the resin layer becomes so thick that carrier particles may associate together. Thus, it may result in failure to obtain uniform carrier particles.

In the case of the two-component developer, the content of the carrier in the two-component developer is appropriately determined depending on the intended purpose without any restriction. For example, it is preferably 90% by mass to 98% by mass, more preferably 93% by mass to 97% by mass.

Since the developer contains the toner of the present invention, the charging ability is excellent and high quality images are stably formed at the time of the image formation.

(Toner Container)

The toner container for use in the present invention contains a container housing therein the toner of the present invention or the developer containing the toner of the present invention.

The toner container is appropriately selected from conventional containers without any restriction. Suitable examples thereof include a toner container having a container main body and a cap.

The size, shape, structure, material and several features of the container main body is appropriately determined depending on the intended purpose without any restriction. For example, the container main body may preferably have a cylindrical shape, most preferably a cylindrical shape in which spiral grooves are formed on its inner surface that allow toner in the container to shift to the outlet along with rotation of the main body, and in which all or part of the spiral grooves have a bellow function.

The materials for the container main body are not specifically restricted, but are preferably those capable of providing accurate dimensions when fabricated and examples thereof include resins. For example, polyester resin, polyethylene resin, polypropylene resin, polystyrene resin, polyvinyl chloride resin, polyacrylic acid resin, polycarbonate resin, ABS resin, and polyacetal resin are suitable examples.

The toner container can be readily stored and transferred, and is easy to handle. The toner container can be suitably used to supply toner by detachably attaching it to a process cartridge, image forming apparatus or the like to be described later.

(Process Cartridge)

The process cartridge for use in the present invention contains a latent electrostatic image bearing member configured to bear a latent electrostatic image, and a developing unit configured to develop the latent electrostatic image formed on the latent electrostatic image bearing member using a toner to thereby form a visible image, and further contains additional units appropriately selected.

The developing unit contains a developer storing container for storing the toner of the present invention or the developer, and a developer bearing member configured to bear and transfer the toner or developer stored in the developer container, and may further contains a layer-thickness control member configured to control the thickness of the layer of toner to be carried.

Figure 17:
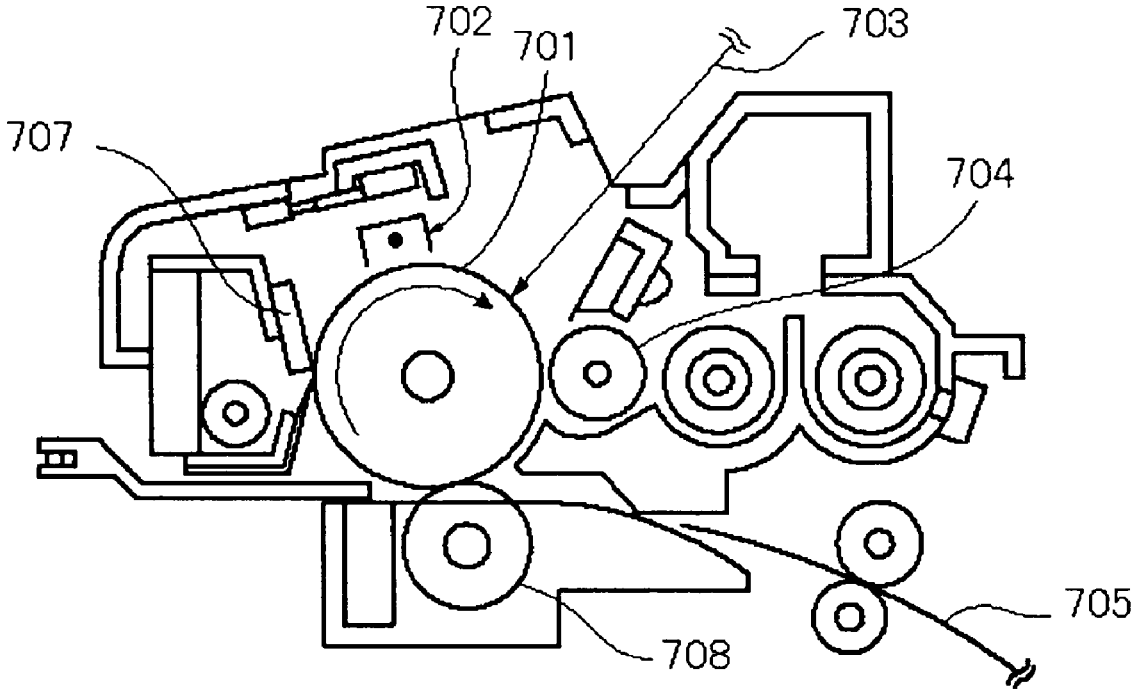
FIG. 17 is a schematic diagram showing one example of a process cartridge for use in the present invention.

The process cartridge contains, for example, as shown in FIG. 17, a latent electrostatic image bearing member 701 mounted in, charging unit 702, developing unit 704, transferring unit 708, and cleaning unit 707 and, if necessary, further contains additional units. In FIG. 17, 703 denotes exposure light by means of an exposing unit, and 705 denotes a recording medium.

Next, an image forming process by means of the process cartridge shown in FIG. 17 will be described. The latent electrostatic image bearing member 701 rotates in the arrow direction, charged by means of the charging unit 702 and is exposed with the exposure light 703 by means of an exposing unit (not shown), whereby a latent electrostatic image corresponding to the exposed image is formed thereon. This electrostatic image is developed by means of the developing unit 704, and the resultant visible image is transferred to the recording medium 705 by means of the transferring unit 708. The recording medium 705 is then printed out. Subsequently, after transferring the image, the surface of the latent electrostatic image bearing member 701 is cleaned by means of the cleaning unit 707, and charges are removed by means of a charge-eliminating unit (not shown). This whole process is continuously repeated.

(Image Forming Method and Image Forming Apparatus)

The image forming method of the present invention contains at least a latent electrostatic image forming step, a developing step, a transferring step and a fixing step, and further contains additional steps such as a discharging step, a cleaning step, a recycling step and a controlling step, which are optionally selected as needed.

The image forming apparatus used in the present invention contains an latent electrostatic image bearing member, a latent electrostatic image forming unit, a developing unit, a transferring unit and a fixing unit, and further contains additional units such as a charge eliminating unit, a cleaning unit, a recycling unit and a controlling unit, which are optionally selected as needed.

The material, shape, size, structure, and several features of the latent electrostatic image bearing member (hereinafter also referred as a photoconductor) are not particularly limited. The latent electrostatic image bearing member can be appropriately selected from those known in the art. However, a drum shaped-latent electrostatic image bearing member is a suitable example. For the material constituting the latent electrostatic image bearing member, inorganic photoconductive materials such as amorphous silicon and selenium, and organic photoconductive materials such as polysilane and phthalopolymethine are preferable. Among these, amorphous silicon is preferable in view of its long life.

The formation of the latent electrostatic image is achieved by, for example, exposing the latent electrostatic image bearing member imagewise after equally charging its entire surface. This step is performed by means of the latent electrostatic image forming unit. The latent electrostatic image forming unit contains a charging device configured to equally charge the surface of the latent electrostatic image bearing member, and an exposing device configured to expose imagewise the surface of the latent electrostatic image bearing member.

The charging step is achieved by, for example, applying voltage to the surface of the latent electrostatic image bearing member by means of the charging device The charging device is not particularly limited and can be appropriately selected depending on the intended purpose, examples include known contact-charging devices equipped with a conductive or semiconductive roller, blush, film or rubber blade, and known non-contact-charging devices utilizing corona discharge such as corotron or scorotoron.

The exposing step is achieved by, for example, exposing the surface of the photoconductor imagewise by means of an exposing unit.

The exposing device is not particularly limited as long as it is capable of performing imagewise exposure on the surface of the charged latent electrostatic image bearing member by means of the charging device, and may be appropriately selected depending on the intended use. Examples thereof include various exposing devices, such as optical copy devices, rod-lens-eye devices, optical laser devices, and optical liquid crystal shatter devices.

Note in the present invention that a backlight system may be employed for exposure, where imagewise exposure is performed from the back side of the latent electrostatic image bearing member.

Developing and Developing Unit

The developing step is a step of developing the latent electrostatic image using the toner of the present invention or developer to form a visible image.

The formation of the visible image can be achieved, for example, by developing the latent electrostatic image using the toner of the present invention or the developer. This is performed by means of the developing unit.

The developing unit is not particularly limited as long as it is capable of performing developing by means of the toner of the present invention or the developer, and can be appropriately selected from known developing units depending on the intended purpose. Suitable examples include those having at least a developing device, which is capable of housing the toner of the present invention or the developer therein and is capable of directly or indirectly applying the toner or developer to the latent electrostatic image. A developing device equipped with the toner container is more preferable.

The developing device may be of dry developing type or wet developing type, and may be designed either for monochrome or multiple-color. Suitable examples include those having an agitation unit for agitating the toner or developer to provide electrical charges by frictional electrification, and a rotatable magnetic roller.

In the developing device the toner and carrier are mixed together and the toner is charged by friction, allowing the rotating magnetic roller to bear toner particles in such a way that they stand on its surface. In this way a magnetic blush is formed. Since the magnetic roller is arranged in the vicinity of the latent electrostatic image bearing member (photoconductor), some toner particles on the magnetic roller that constitute the magnetic blush electrically migrate to the surface of the latent electrostatic image bearing member (photoconductor). As a result, a latent electrostatic image is developed by means of the toner, forming a visible image on the surface of the latent electrostatic image bearing member (photoconductor).

The developer contained in the developing device is a developer containing the toner of the present invention. The developer may be either a one-component developer or a two-component developer. The toner contained in the developer is the toner of the present invention.

Transferring and Transferring Unit

The transferring step is a step of transferring the visible image onto a recording medium. A preferred embodiment of transferring involves two steps: primary transferring in which the visible image is transferred onto an intermediate transferring medium, and secondary transferring in which the visible image transferred onto the intermediate transferring medium is transferred onto a recording medium. A more preferable embodiment of transferring involves two steps: primary transferring in which a visible image is transferred onto an intermediate transferring medium to form a complex image thereon by means of toners of two or more different colors, preferably full-color toners; and secondary transferring in which the complex image is transferred onto a recording medium.

The transferring step is achieved by, for example, charging the latent electrostatic image bearing member (photoconductor) by means of a transfer charging unit. This transferring step is performed by means of the transferring unit. A preferable embodiment of the transferring unit has two units: a primary transferring unit configured to transfer a visible image onto an intermediate transferring medium to form a complex image; and a secondary transferring unit configured to transfer the complex image onto a recording medium.

The intermediate transferring medium is not particularly limited and can be selected from conventional transferring media depending on the intended purpose; suitable examples include transferring belts.

The transferring unit (i.e., the primary and secondary transferring steps) preferably contains a transferring device configured to charge and separate the visible image from the latent electrostatic image bearing member (photoconductor) and transfer it onto the recording medium. The number of the transferring step to be provided may be either 1 or more.

Examples of the transferring devices include corona transferring devices utilizing corona discharge, transferring belts, transferring rollers, pressure-transferring rollers, and adhesion-transferring devices.

The recording medium is not particularly limited and can be appropriately selected from known recording media (recording sheets).

The fixing step is a step of fixing a transferred visible image onto a recording medium by means of the fixing unit. Fixing may be performed every time after each color toner has been transferred to the recording medium or may be performed in a single step after all different toners have been transferred to the recording medium.

The fixing device is not particularly limited and can be appropriately selected depending on the intended purpose. Examples include a heating-pressurizing unit. The heating-pressurizing unit is preferably a combination of a heating roller and a pressurizing roller, or a combination of a heating roller, a pressurizing roller, and an endless belt, for example.

In general, heating treatment by means of the heating-pressurizing unit is preferably performed at a temperature of 120° C. to 200° C.

Note in the present invention that a known optical fixing unit may be used in combination with or instead of the fixing step and fixing unit, depending on the intended purpose.

The discharging step is a step of applying a bias to the charged latent electrostatic image bearing member so as to discharge. This is suitably performed by means of the discharging unit.

The discharging unit is not particularly limited as long as it is capable of applying a charge eliminating bias to the latent electrostatic image bearing member, and can be appropriately selected from known discharging units depending on the intended purpose. A suitable example thereof is a discharging lamp and the like.

The cleaning step is a step of removing toner particles remained on the latent electrostatic image bearing member. This is suitably performed by means of the cleaning unit. The cleaning unit is not particularly limited as long as it is capable of eliminating such toner particles from the latent electrostatic image bearing member, and can be suitably selected from known cleaners depending on the intended use. Examples thereof include a magnetic blush cleaner, an electrostatic brush cleaner, a magnetic roller cleaner, a blade cleaner, a blush cleaner, and a wave cleaner The recycling step is a step of recycling the toner particles removed through the cleaning step to the developing unit. This is suitably performed by means of the recycling unit.

The recycling unit is not particularly limited and can be appropriately selected from conventional conveyance systems.

One embodiment of the image forming method of the present invention by means of the image forming apparatus will be described with reference to FIG. 18. Image forming apparatus 800 shown in FIG. 18 contains a photoconductor drum 810 (hereinafter referred to as "photoconductor 810") as the latent electrostatic image bearing member, a charging roller 820 as the charging unit, an exposure device 830 as the exposing unit, a developing device 840 as the developing unit, an intermediate transferring member 850, a cleaning device 860 as the cleaning unit having a cleaning blade, and a discharging lamp 870 as the discharging unit.

Intermediate transferring member 850 is an endless belt, and is so designed that it loops around three rollers 851 disposed its inside and rotates in the direction shown by the arrow by means of rollers 851. Some of three rollers 851 also function as a transfer bias roller capable of applying a certain transfer bias (primary bias) to the intermediate transferring member 850. Cleaning blade 890 is provided adjacent to the intermediate transferring member 850. There is provided a transferring roller 880 facing to the intermediate transferring member 850 as the transferring unit capable of applying a transfer bias so as to transfer a developed image (toner image) to a transfer sheet 895 as a recording medium (secondary transferring). Moreover, there is provided a corona charger 858 around the intermediate transferring member 850 for applying charges to the toner image transferred on the intermediate transferring member 850. Corona charger 858 is arranged between the contact region of the photoconductor 810 and the intermediate transferring member 850 and the contact region of the intermediate transferring member 850 and the transfer sheet 895, in the rotational direction of the intermediate transferring member 850.

Developing device 840 contains a developing belt 841 as a developer bearing member, a black developing unit 845K, a yellow developing unit 845Y, a magenta developing unit 845M and a cyan developing unit 845C, these developing units being positioned around the developing belt 841. The black developing unit 845K contains a developer container 842K, a developer supplying roller 843K, and a developing roller 844K. The yellow developing unit 845Y contains a developer container 842Y, a developer supplying roller 843Y, and a developing roller 844Y. The magenta developing unit 845M contains a developer container 842M, a developer supplying roller 843M, and a developing roller 844M. The cyan developing unit 845C contains a developer container 842C, a developer supplying roller 843C, and a developing roller 844C. The developing belt 841 is an endless belt looped around a plurality of belt rollers so as to be rotatable. A part of the developing belt 841 is in contact with the photoconductor 810.

Figure 18:
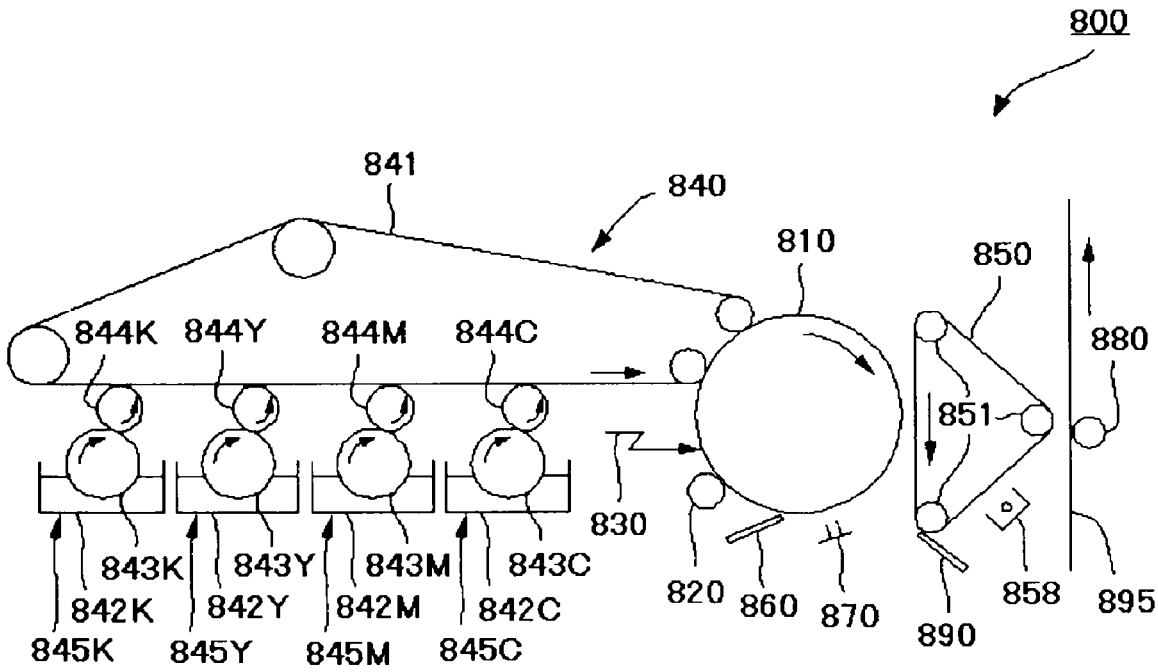
FIG. 18 is a schematic diagram showing one example of an image forming apparatus for use in an image forming method.

In image forming apparatus 800 shown in FIG. 18, the photoconductor drum 810 is uniformly charged by means of, for example, the charging roller 820. The exposure device 830 then exposes imagewise on the photoconductor drum 810 so as to form a latent electrostatic image. The latent electrostatic image formed on the photoconductor drum 810 is provided with toner from the developing device 840 to form a visible image (toner image). The roller 851 applies a bias to the toner image to transfer the visible image (toner image) onto the intermediate transferring medium 850 (primary transferring), and further applies a bias to transfer the toner image from the intermediate transferring medium 850 to the transfer sheet 895 (secondary transferring). In this way a transferred image is formed on the transfer sheet 895. Thereafter, toner particles remained on the photoconductor drum 810 are removed by means of the cleaning device 860, and charges of the photoconductor drum 810 are removed by means of a discharging lamp 870 on a temporary basis.

Figure 19:
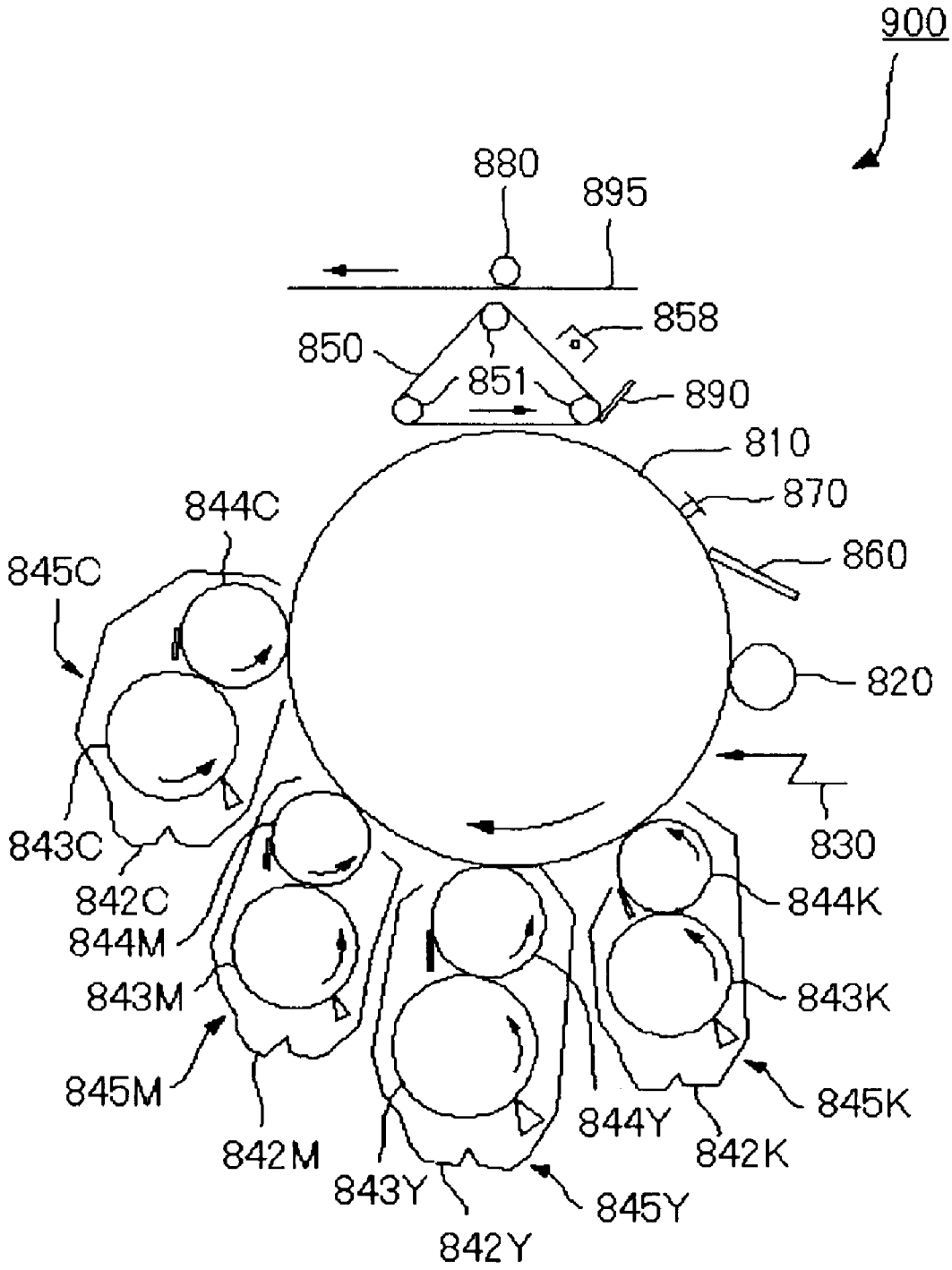
FIG. 19 is a schematic diagram showing another example of the image forming apparatus for use in the image forming method.

Another embodiment of the image forming method of the present invention by means of the image forming apparatus will be described with reference to FIG. 19. The image forming apparatus 900 shown in FIG. 19 has an identical configuration and working effects to those of the image forming apparatus 800 shown in FIG. 18 except that this image forming apparatus 900 does not contains the developing belt 841 and that the black developing unit 845K, yellow developing unit 845Y, magenta developing unit 845M and cyan developing unit 845C are disposed adjacent to the photoconductor 810 so as to face to the photoconductor 810. Note in FIG. 19 that members identical to those in FIG. 18 are denoted by the same reference numerals.

Figure 20:
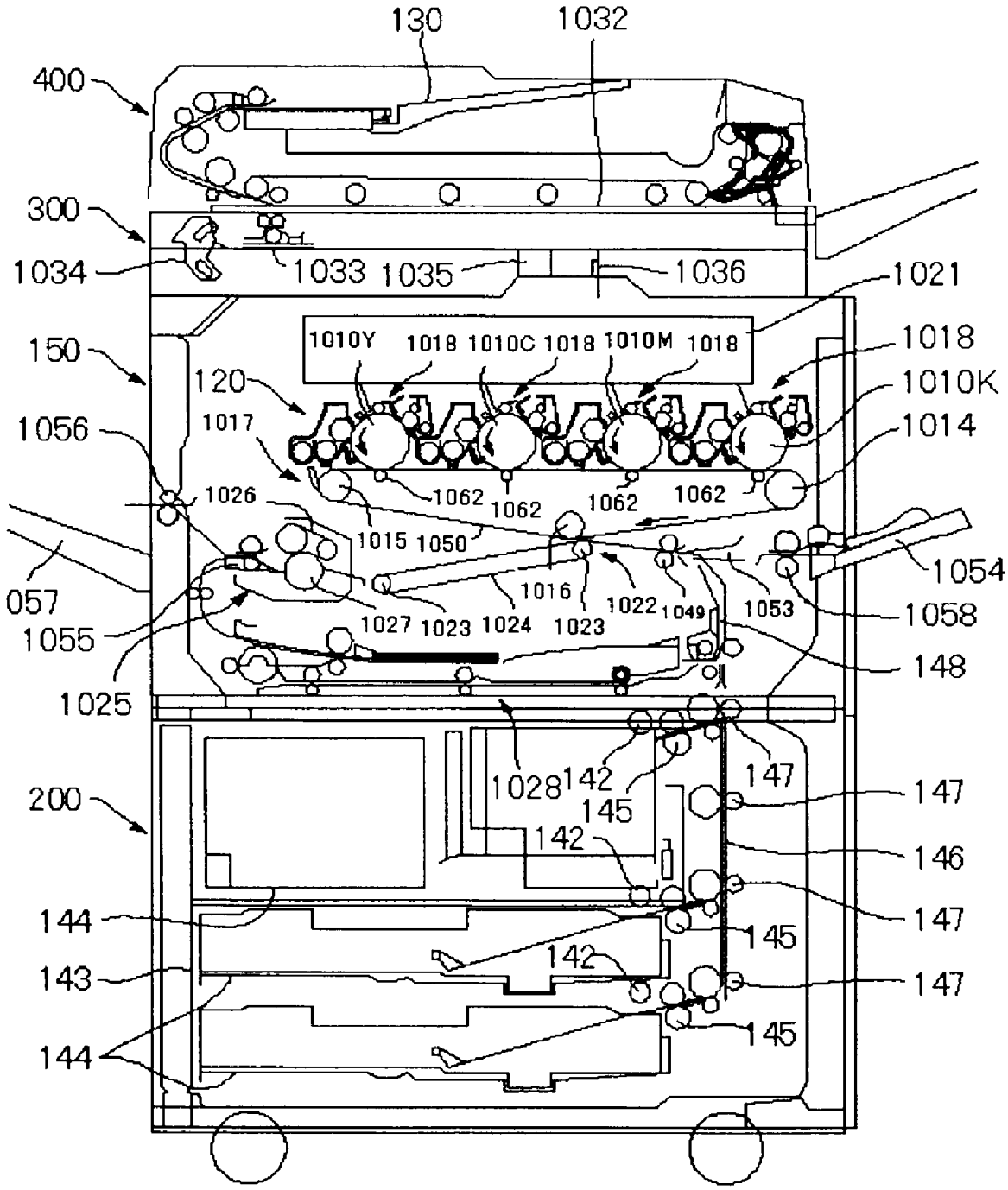
FIG. 20 is a schematic diagram showing one example of the image forming apparatus (tandem color image forming apparatus) for use in the image forming method.

Still another embodiment of the image forming method of the present invention by means of the image forming apparatus will be described with reference to FIG. 20. Image forming apparatus shown in FIG. 20 is a tandem color image-forming apparatus. The tandem image forming apparatus contains a copy machine main body 150, feeder table 200, scanner 300, and automatic document feeder (ADF) 400.

The copy machine main body 150 has an endless-belt intermediate transferring member 1050 in the center. The intermediate transferring member 1050 is looped around support rollers 1014, 1015 and 1016 and is configured to be rotatable in a clockwise direction in FIG. 20. A cleaning device 1017 for the intermediate transferring member is provided in the vicinity of the support roller 1015. The cleaning device 1017 removes toner particles remained on the intermediate transferring member 1050. On the intermediate transferring member 1050 looped around the support rollers 1014 and 1015, four color-image forming devices 1018—yellow, cyan, magenta, and black—are aligned along the conveying direction so as to face the intermediate transferring member 1050, which constitutes a tandem developing unit 120.

An exposing unit 1021 is arranged adjacent to the tandem developing unit 120. A secondary transferring unit 1022 is arranged across the intermediate transferring member 1050 from the tandem developing unit 120. The secondary transferring unit 1022 contains a secondary transferring belt 1024, which is an endless belt and looped around a pair of rollers 1023. A transferred sheet which is conveyed on the secondary transferring belt 1024 is allowed to contact the intermediate transferring member 1050. An image fixing unit 1025 is arranged in the vicinity of the secondary transferring unit 1022. The image fixing unit 1025 contains a fixing belt 1026 which is an endless belt, and a pressurizing roller 1027 which is pressed by the fixing belt 1026.

In the tandem image forming apparatus, a sheet reverser 1028 is arranged adjacent to both the secondary transferring unit 1022 and image fixing unit 1025. A sheet reverser 1028 turns over a transferred sheet to form images on the both sides of the sheet.

Next, full-color image formation (color copying) using a tandem developing unit 120 will be described. At first, a source document is placed on a document tray 130 of an automatic document feeder 400. Alternatively, the automatic document feeder 400 is opened, the source document is placed on a contact glass 1032 of a scanner 300, and the automatic document feeder 400 is closed.

When a start switch (not shown) is pushed, the source document placed on the automatic document feeder 400 is transferred onto the contact glass 1032, and the scanner 300 is then driven to operate first and second carriages 1033 and 1034. In a case where the source document is originally placed on the contact glass 1032, the scanner 300 is immediately driven after pushing of the start switch. Light is applied from a light source to the document by means of the first carriage 1033, and light reflected from the document is further reflected by the mirror of the second carriage 1034. The reflected light passes through the image-forming lens 1035, and read the sensor 1036 receives it. In this way the color document (color image) is scanned, producing 4 types of color image information—black, yellow, magenta, and cyan.

Figure 21:
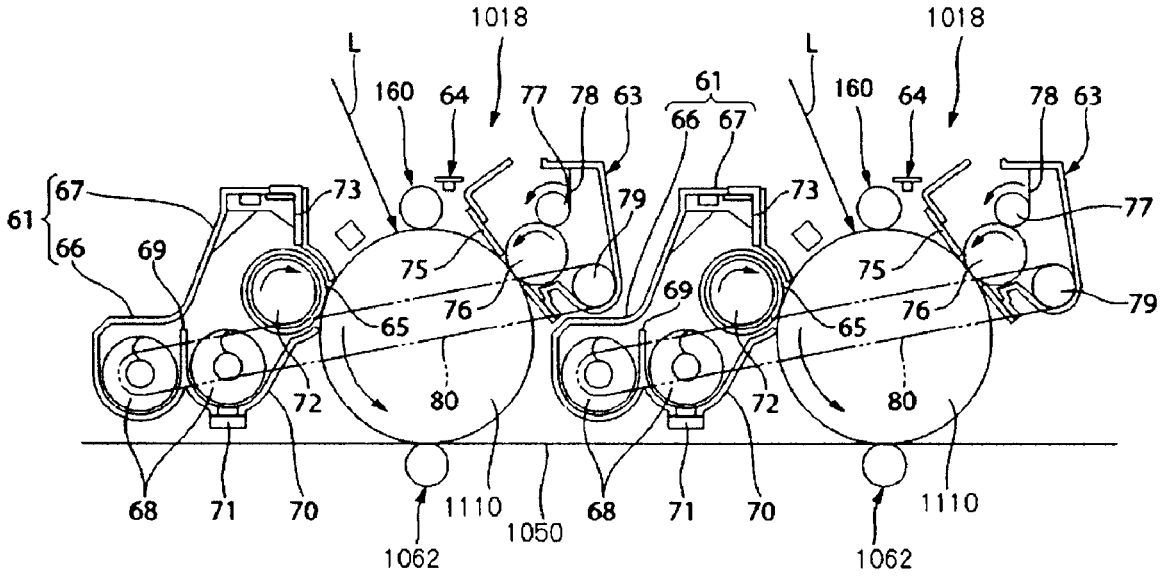
FIG. 21 is a partially enlarged schematic diagram of the image forming apparatus shown in FIG. 20.

Each image information of black, yellow, magenta, and cyan is transmitted to an image forming unit 1018 (black image forming unit, yellow image forming unit, magenta image forming unit, or cyan image forming unit) of the tandem developing unit 120, and toner images of each color are formed in each image-forming unit 1018. As shown in FIG. 21, each image-forming unit 1018 (black image-forming unit, yellow image forming unit, magenta image forming unit, and cyan image forming unit) of the tandem developing unit 120 contains: a photoconductor 1110 (photoconductor for black 1010K, photoconductor for yellow 1010Y, photoconductor for magenta 1010M, or photoconductor for cyan 1010C); a charging device 160 for uniformly charging the photoconductor 1110; an exposing unit for forming a latent electrostatic image corresponding to the color image on the photoconductor by exposing imagewise (denoted by "L" in FIG. 21) on the basis of the corresponding color image information; a developing device 61 for developing the latent electrostatic image using the corresponding color toner (black toner, yellow toner, magenta toner, or cyan toner) to form a toner image; a transfer charger 1062 for transferring the toner image to an intermediate transferring member 1050, a cleaning device 63, and a charge eliminating device 64. Thus, images of one color (a black image, a yellow image, a magenta image, and a cyan image) can be formed based on the color image information. The black toner image formed on the photoconductor for black 1010K, yellow toner image formed on the photoconductor for yellow 1010Y, magenta toner image formed on the photoconductor for magenta 1010M, and cyan toner image formed on the photoconductor for cyan 1010C are sequentially transferred onto the intermediate transferring member 1050 which rotates by means of support rollers 1014, 1015 and 1016 (primary transferring). These toner images are superimposed on the intermediate transferring member 1050 to form a composite color image (color transferred image).

Meanwhile, in FIG. 20, one of feed rollers 142 of the feed table 200 is selected and rotated, whereby sheets (recording sheets) are ejected from one of multiple feed cassettes 144 in a paper bank 143 and are separated one by one by a separation roller 145. Thereafter, the sheets are fed to feed path 146, transferred by a transfer roller 147 into a feed path 148 inside the copying machine main body 150, and are bumped against the resist roller 1049 to stop. Alternatively, one of the feed rollers 142 is rotated to eject sheets (recording sheets) placed on a manual feed tray 1054. The sheets are then separated one by one by means of the separation roller 145, fed into a manual feed path 1053, and similarly, bumped against the resist roller 1049 to stop. Note that the resist roller 1049 is generally earthed, but it may be biased for removing paper dusts on the sheets. The resist roller 1049 is rotated synchronously with the movement of the composite color image (color transferred image) on the intermediate transferring member 1050 to transfer the sheet (recording sheet) into between the intermediate transferring member 1050 and the secondary transferring unit 1022, and the composite color image (color transferred image) is transferred onto the sheet by means of the secondary transferring unit 1022 (secondary transferring). In this way the color image is formed on the sheet (recording sheet). Note that after image transferring, toner particles remained on the intermediate transferring member 1050 are cleaned by means of the cleaning device 1017.

The sheet (recording sheet) bearing the transferred color image is conveyed by the secondary transferring unit 1022 into the image fixing unit 1025, where the composite color image (color transferred image) is fixed onto the sheet (recording sheet) by heat and pressure. Thereafter, the sheet changes its direction by action of a switch hook 1055, ejected by an ejecting roller 1056, and stacked on an output tray 1057. Alternatively, the sheet changes its direction by action of the switch hook 1055, flipped over by means of the sheet reverser 1028, and transferred back to the image transfer section for recording of another image on the other side. The sheet that bears images on both sides is then ejected by means of the ejecting roller 1056, and is stacked on the output tray 1057.

In accordance with the image forming method and image forming apparatus of the present invention, high quality image can be formed as the toner of the present invention which has a sharp particle size distribution, and excellent toner characteristics such as charging ability, environmental stability, storage stability and the like is used.

EXAMPLES

Hereinafter, the examples of the present invention will be explained, but the present invention shall not be construed to limit by these examples.

Synthesis Example 1

Synthesis of Colorant 1 Obtained by Reacting a Polymer and a Basic Dye

Into a 1 L four-neck flask equipped with a stirrer, condenser, thermometer, and nitrogen gas inlet tube, a nitrogen gas was introduced to replace the inner atmosphere, 25 g of distill water was added, and then the temperature of the distill water was increased up to 90° C. by heating the flask in an oil bath. Into the heated distilled water, a monomer aqueous solution in which 125 g of sodium p-styrene sulfonate was dissolved in 360 g of distilled water, and an aqueous solution of a polymerization initiator in which 2 g of ammonium persulfate was dissolved in 15 g of distilled water were respectively dripped by a dropping funnel for three hours, and the mixture was polymerized for two hours. Thereafter, the reaction solution was cooled down to the room temperature to thereby obtain a polymer aqueous solution. The thus obtained polymer aqueous solution was poured into ethanol so as to deposit and refine the polymer. 50 g of the thus obtained polymer and 18 g of Cathilon Yellow GLH (C.I. Basic Yellow 14, manufactured by Hodogaya Chemical Co., Ltd.) were dissolved in 500 g of water, and then the solution was added with 5 g of 50% acetic acid aqueous solution so as to adjust the pH value at 4.5, and stirred at 60° C. for one hour. Thereafter, the sediment was filtered, purified, and dried to thereby obtain Colorant 1.

Synthesis Example 2

Synthesis of Colorant 2 Obtained by Reacting a Polymer and a Basic Dye

Colorant 2 was obtained in the same manner as in Synthesis Example 1, provided that Cathilon Yellow GLH was replaced with Cathilon Brilliant Red 4GH (C.I. Basic Red 14, manufactured by Hodogaya Chemical Co., Ltd.).

Synthesis Example 3

Synthesis of Colorant 3 Obtained by Reacting a Polymer and a Basic Dye

Colorant 3 was obtained in the same manner as in Synthesis Example 1, provided that Cathilon Yellow GLH was replaced with Cathilon Blue 5GLH (C.I. Basic Blue 45, manufactured by Hodogaya Chemical Co., Ltd.).

Synthesis Example 4

Synthesis of Colorant 4 Obtained by Reacting a Polymer and a Basic Dye

Into a 1 L reaction device equipped with a stirrer, condenser, thermometer, and nitrogen gas inlet tube, a nitrogen gas was introduced to replace the inner atmosphere, 7 g of distill water and 13 g of ethanol were added, and then the temperature of the solution was increased up to 70° C. by heating in an oil bath. Into the heated solution, a monomer aqueous solution in which 83.3 g of butyl acrylate and 21.7 g of sodium p-styrene sulfonate were dissolved in 60 g of distilled water, and an aqueous solution of a polymerization initiator in which 5 g of azobisisobutyronitrile was dissolved in 250 g of ethanol were respectively dripped by a dropping funnel for three hours, and the mixture was polymerized for five hours and cooled down to the room temperature to thereby obtain a polymer aqueous solution. 50 g of the thus obtained polymer solution was added with 210 g of water, and a solution in which 2.9 g of Cathilon Yellow GLH (C.I. Basic Yellow 14, manufactured by Hodogaya Chemical Co., Ltd.) and 15 g of acetic acid were dissolved in 100 g of water was dripped in the aforementioned mixed solution while being stirred, to thereby deposit dyed resin. The pH value of the thus obtained solution was adjusted at 4 with 20% by weight of sodium hydroxide solution, and the solution was stirred for 30 minutes at 50° C. Thereafter, the sediment was filtered, purified, and dried to thereby obtain Colorant 4.

Synthesis Example 5

Synthesis of Colorant 5 Obtained by Reacting a Polymer and a Basic Dye

Colorant 5 was obtained in the same manner as in Synthesis Example 4, provided that Cathilon Yellow GLH was replaced with Cathilon Brilliant Red 4GH (C.I. Basic Red 14, manufactured by Hodogaya Chemical Co., Ltd.).

Synthesis Example 6

Synthesis of Colorant 6 Obtained by Reacting a Polymer and a Basic Dye

Colorant 6 was obtained in the same manner as in Synthesis Example 4, provided that Cathilon Yellow GLH was replaced with Cathilon Blue 5GLH (C.I. Blue 45, manufactured by Hodogaya Chemical Co., Ltd.).

Synthesis Example 7

Synthesis of Colorant 7 Obtained by Reacting a Polymer and a Basic Dye

Into a 1 L reaction device equipped with a stirrer, condenser, thermometer, and nitrogen gas inlet tube, a nitrogen gas was introduced to replace the inner atmosphere, 60 g of N-methyl pyrrolidone was added, and then the temperature thereof was increased up to 90° C. by heating in an oil bath. Into the heated N-methylpyrrolidone, a monomer aqueous solution in which 25.6 g of n-butyl acrylate and 18.7 g of 2-acrylamide-2-methylpropane sulfonic acid were dissolved in 200 g of N-methylpyrrolidone, and a polymerization initiator solution in which 2 g of azobisisobutyronitrile was dissolved in 100 g of ethanol were respectively dripped by a dropping funnel for five hours, and the mixture was polymerized for ten hours and cooled down to the room temperature to thereby obtain a polymer solution. 50 g of the thus obtained polymer solution was added with 3.9 g of Cathilon Yellow GLH (C.I. Basic Yellow 14, manufactured by Hodogaya Chemical Co., Ltd.), and the mixed solution was stirred for one hour while maintaining the temperature thereof at 70° C. The thus obtained solution was added in a large amount of distilled water so as to deposit colored resin. Thereafter, the sediment was filtered, purified, and dried to thereby obtain Colorant 7.

Synthesis Example 8

Synthesis of Colorant 8 Obtained by Reacting a Polymer and a Basic Dye

Colorant 8 was obtained in the same manner as in Synthesis Example 7, provided that Cathilon Yellow GLH was replaced with Cathilon Brilliant Red 4GH (C.I. Basic Red 14, manufactured by Hodogaya Chemical Co., Ltd.).

Synthesis Example 9

Synthesis of Colorant 9 Obtained by Reacting a Polymer and a Basic Dye

Colorant 9 was obtained in the same manner as in Synthesis Example 7, provided that Cathilon Yellow GLH was replaced with Cathilon Blue 5GLH (C.I. Blue 45, manufactured by Hodogaya Chemical Co., Ltd.).

Synthesis Example 10

Synthesis of Colorant 10 Obtained by Reacting a Polymer and a Basic Dye

Into a 1 L reaction device equipped with a stirrer, condenser, thermometer, and nitrogen gas inlet tube, a nitrogen gas was introduced to replace the inner atmosphere, 100 g of ethanol, 35.4 g of styrene, 7.7 g of butyl acrylate, 0.8 g of ethyleneglycol dimethacrylate, and 6.2 g of 2-acrylamide-2-methylpropane sulfonic acid were added, and then the temperature of the solution was increased up to 70° C. by heating in an oil bath. Into the heated solution, a monomer aqueous solution in which 1 g of azobisisobutylonitrile was dissolved in 100 g of ethanol was dripped by a dropping funnel for five hours, and the mixture was polymerized for five hours and cooled down to the room temperature to thereby obtain a polymer solution. The thus obtained polymer solution was added with 3 g of 10% sodium hydroxide, and then sufficiently stirred. Thereafter, the solution was added with a coloring liquid in which 1.2 g of Cathilon Yellow GLH (C.I. Basic Yellow 14, manufactured by Hodogaya Chemical Co., Ltd.) was dissolved in 100 g of water, and was further added with acetic acid so as to adjust the pH value at 5. Thereafter, the solution was stirred for 1 hour while maintaining the temperature at 60° C. The thus obtained solution was added in a large amount of distilled water so as to deposit a colored resin. The sediment was then filtered, purified, and dried to thereby obtain Colorant 10.

Synthesis Example 11

Synthesis of Colorant 11 Obtained by Reacting a Polymer and a Basic Dye

Colorant 11 was obtained in the same manner as in Synthesis Example 10, provided that Cathilon Yellow GLH was replaced with Cathilon Brilliant Red 4GH (C.I. Basic Red 14, manufactured by Hodogaya Chemical Co., Ltd.).

Synthesis Example 12

Synthesis of Colorant 12 Obtained by Reacting a Polymer and a Basic Dye

Colorant 12 was obtained in the same manner as in Synthesis Example 10, provided that Cathilon Yellow GLH was replaced with Cathilon Blue 5GLH (C.I. Blue 45, manufactured by Hodogaya Chemical Co., Ltd.).

Synthesis Example 13

Synthesis of Colorant 13 Obtained by Reacting a Polymer and a Basic Dye

Into a 1 L four-neck flask equipped with a stirrer, condenser, thermometer, and nitrogen gas inlet tube, a nitrogen gas was introduced to replace the inner atmosphere, 25 g of distill water was added, and then the temperature of the distill water was increased up to 90° C. by heating the flask in an oil bath. Into the heated distilled water, a monomer aqueous solution in which 14.4 g of sodium p-styrene sulfonate and 91.1 g of 2-hydroxyethyl methacrylate were dissolved in 300 g of distilled water, and an aqueous solution of a polymerization initiator in which 7.5 g of ammonium persulfate was dissolved in 75 g of distilled water were respectively dripped by a dropping funnel for three hours, and the mixture was polymerized for two hours. Thereafter, the reaction solution was cooled down to the room temperature to thereby obtain a polymer aqueous solution. 100 g of the thus obtained polymer, 1 g of Cathilon Yellow GLH (C.I. Basic Yellow 14, manufactured by Hodogaya Chemical Co., Ltd.), 1 g of 50% acetic acid aqueous solution, 20 g of distilled water were mixed and stirred at the temperature of 60° C. and the pH value of 4.5 for one hour. Thereafter, the thus obtained solution was spray-dried by means of Minispray GS310 (manufactured by Yamato Scientific Co., Ltd.) to thereby obtain Colorant 13.

Synthesis Example 14

Synthesis of Colorant 14 Obtained by Reacting a Polymer and a Basic Dye

Colorant 14 was obtained in the same manner as in Synthesis Example 13, provided that Cathilon Yellow GLH was replaced with Cathilon Brilliant Red 4GH (C.I. Basic Red 14, manufactured by Hodogaya Chemical Co., Ltd.).

Synthesis Example 15

Synthesis of Colorant 15 Obtained by Reacting a Polymer and a Basic Dye

Colorant 15 was obtained in the same manner as in Synthesis Example 13, provided that Cathilon Yellow GLH was replaced with Cathilon Blue 5GLH (C.I. Blue 45, manufactured by Hodogaya Chemical Co., Ltd.).

Synthesis Example 16

Synthesis of Colorant 16 Obtained by Reacting a Polymer and a Basic Dye

Into a 1 L four-neck flask equipped with a stirrer, condenser, thermometer, and nitrogen gas inlet tube, a nitrogen gas was introduced to replace the inner atmosphere, 25 g of distill water was added, and then the temperature of the distill water was increased up to 90° C. by heating the flask in an oil bath. Into the heated distilled water, a monomer aqueous solution in which 45.4 g of sodium p-styrene sulfonate and 88.5 g of 2-hydroxyethyl methacrylate were dissolved in 300 g of distilled water, and an aqueous solution of a polymerization initiator in which 1.25 g of ammonium persulfate was dissolved in 50 g of distilled water were respectively dripped by dropping funnels for three hours, and the mixture was polymerized for two hours. Thereafter, the reaction solution was cooled down to the room temperature to thereby obtain a polymer aqueous solution. 100 g of the thus obtained polymer, 1 g of Cathilon Yellow GLH (C.I.

Basic Yellow 14, manufactured by Hodogaya Chemical Co., Ltd.), 1 g of 50% acetic acid aqueous solution, 20 g of distilled water were mixed and stirred at the temperature of 60° C. and the pH value of 4.5 for one hour. Thereafter, the thus obtained solution was spray-dried by means of Minispray GS310 (manufactured by Yamato Scientific Co., Ltd.) to thereby obtain Colorant 16.

Synthesis Example 17

Synthesis of Colorant 17 Obtained by Reacting a Polymer and a Basic Dye

Colorant 17 was obtained in the same manner as in Synthesis Example 16, provided that Cathilon Yellow GLH was replaced with Cathilon Brilliant Red 4GH (C.I. Basic Red 14, manufactured by Hodogaya Chemical Co., Ltd.).

Synthesis Example 18

Synthesis of Colorant 18 Obtained by Reacting a Polymer and a Basic Dye

Colorant 18 was obtained in the same manner as in Synthesis Example 16, provided that Cathilon Yellow GLH was replaced with Cathilon Blue 5GLH (C.I. Blue 45, manufactured by Hodogaya Chemical Co., Ltd.).

Synthesis Example 19

Synthesis of Polyester 1 as a Binder Resin

Into a reaction vessel equipped with a thermometer, stirrer, condenser, and nitrogen gas inlet tube, there were added 64 parts by mass of PO adduct of bisphenol A (hydroxyl value: 320), 544 parts by mass of EO adduct of bisphenol A (hydroxyl value: 343), 123 parts by mass of terephthalic acid, and 4 parts by mass of dibutylthioxaide, and the mixture was reacted for three hours at 230° C. under the atmospheric pressure. The reaction solution was then cooled down to 180° C., and further added with 296 parts by mass of dodecenylsuccinic anhydride. The solution was then reacted under the reduced pressure of 10 mmHg to 15 mmHg until the acid value thereof became 2 mgKOH/g or less. Thereafter, the solution was added with 20 parts by mass of trimellitic anhydride, and the mixed solution was reacted at 180° C. under the atmospheric pressure for 2 hours. The reactant was removed from the reaction vessel to thereby yield Polyester 1. Polyester 1 had Tg of 48° C., a number average molecular weight of 9,000, a weight average molecular weight of 22,000, an acid value of 10 mgKOH/g, and a hydroxyl value of 17 mgKOH/g.

Synthesis Example 20

Synthesis of Polyester 2 as a Binder Resin

Into a reaction vessel equipped with a thermometer, stirrer, condenser, and nitrogen gas inlet tube, there were added 636 parts by mass of PO adduct of bisphenol A (hydroxyl value: 320), 191 parts by mass of terephthalic acid, and 4 parts by mass of dibutylthioxaide, and the mixture was reacted at 230° C. under the atmospheric pressure for three hours. The reaction solution was then cooled down to 180° C., and further added with 205 parts by mass of dodecenylsuccinic anhydride. The solution was then reacted under the reduced pressure of 10 mmHg to 15 mmHg until the acid value thereof became 2 mgKOH/g or less. Thereafter, the solution was added with 20 parts by mass of trimellitic anhydride, and the mixed solution was reacted at 180° C. under the atmospheric pressure for 2 hours. The reactant was removed from the reaction vessel to thereby yield Polyester 2. Polyester 2 had Tg of 55° C., a number average molecular weight of 5,000, a weight average molecular weight of 10,000, an acid value of 11 mgKOH/g, and a hydroxyl value of 16 mgKOH/g.

Example 1

Preparation of Wax Dispersion Liquid

Into a mixer equipped with a stirring wing, there were charged 18 parts by mass of carnauba wax, 2 parts by mass of a wax dispersant, and 80 parts by mass of ethyl acetate, and the mixture was subjected to a primary dispersion so as to form a primary dispersion liquid. The primary dispersion liquid was heated to a temperature of 80° C. while being stirred so as to dissolve the carnauba wax therein, and then the primary dispersion was cooled to a room temperature so as to deposit wax particles having a maximum particle diameter of 3 μm or less. As the aforementioned wax dispersant, polyethylene wax to which styrene-butyl acrylate copolymer was grafted was used. The thus obtained dispersion liquid was further dispersed finely by a powerful shearing force by means of Dyno-mill so as to control the maximum particle diameter of the wax particles to be 2 μm or less.

Preparation of Dispersion Liquid Added with Resin and Wax

Into a mixer equipped with a stirring wing, there were charged 100 g of Polyester 1 as a binder resin, 1 g of Colorant 1, 25 g of the dispersion liquid of the carnauba wax, 0.4 g of FTERGENT F100 (manufactured by Neos Company Limited) and 1,000 g of ethyl acetate, and the mixture was stirred for 10 minutes so as to disperse the components. The thus obtained dispersion liquid was filtered by a PTFE filter having a pore size of 0.45 μm, and it was confirmed that all the dispersion liquid was passed through the filter without any clogging.

The dispersion liquid was diluted with ethyl acetate to as to have solid contents of 6.0%, and the thus obtained liquid was supplied to a toner composition fluid storage vessel 35 disposed in the toner production apparatus shown in FIG. 1 using the droplet generating unit shown in FIG. 2. The plate having ejection holes for use here was prepared in a manner such that a nickel plate having a thickness of 20 μm was subjected to a removal processing using femtosecond laser in accordance with a mask reduction projection method to thereby form ten ejection holes, each of which is a round outlet having a diameter of 8.0 μm, on a concentric circle. The formed ejection holes were present within an area where is a square having a side length of 0.5 mm on the plate.

After preparing the dispersion liquid, droplets were formed and the formed droplets were dried at the following conditions for toner production, and then the dried droplets were collected by a cyclone so as to obtain particles. 100 parts by mass of the thus obtained particles were added with 0.2 parts by mass of hydrophobic silica (AEROSIL R-972, manufactured by Nippon Aerosil Co., Ltd.), and then mixed by means of Henschel Mixer to thereby yield Yellow Toner 1. Magenta Toner 1 and Cyan Toner 1 were prepared in the same manner respectively using Colorant 2 and Colorant 3.

[Conditions for Toner Production]

Solid contents of the dispersion liquid: 6.0%

Flow rate of the liquid: 40 mL/hr

Flow rate of dry air: Sheath 2.0 L/min., Inner atmospheric air 3.0 L/min.

Temperature inside the apparatus: 27° C. to 28° C.

Dew point temperature: −20° C.

Vibration frequency of the common retention section: 601.0 kHz

Example 2

Yellow Toner 2, Magenta Toner 2, and Cyan Toner 2 were respectively prepared in the same manner as in Example 1, provided that 1 g of each of Colorants 1-3 was respectively changed to 3 g of each of Colorants 4-6.

Example 3

Yellow Toner 3, Magenta Toner 3, and Cyan Toner 3 were respectively prepared in the same manner as in Example 1, provided that 1 g of each of Colorants 1-3 was respectively changed to 2 g of each of Colorants 7-9.

Example 4

Yellow Toner 4, Magenta Toner 4, and Cyan Toner 4 were respectively prepared in the same manner as in Example 1, provided that 1 g of each of Colorants 1-3 was respectively changed to 4.5 g of each of Colorants 10-12.

Example 5

Yellow Toner 5, Magenta Toner 5, and Cyan Toner 5 were respectively prepared in the same manner as in Example 1, provided that 1 g of each of Colorants 1-3 was respectively changed to 4 g of each of Colorants 13-15.

Example 6

Yellow Toner 6, Magenta Toner 6, and Cyan Toner 6 were respectively prepared in the same manner as in Example 1, provided that 1 g of each of Colorants 1-3 was respectively changed to 3 g of each of Colorants 16-18.

Example 7

Yellow Toner 7, Magenta Toner 7, and Cyan Toner 7 were respectively prepared in the same manner as in Example 1, provided that no binder resin was used, and 1 g of each of Colorants 1-3 was respectively changed to 100 g of each of Colorants 13-15.

Example 8

Into a mixer equipped with a stirring wing, there were charged 100 g of Polyester 2 as a binder resin, 1 g of Colorant 1, 25 g of the dispersion liquid of the carnauba wax prepared in Example 1, 0.4 g of FTERGENT F100 (manufactured by Neos Company Limited) and 1,000 g of ethyl acetate, and the mixture was stirred for 10 minutes so as to disperse the components. The thus obtained dispersion liquid was filtered by a PTFE filter having a pore size of 0.45 μm, and it was confirmed that all the dispersion liquid was passed through the filter without any clogging.

The dispersion liquid was diluted with ethyl acetate to as to have solid contents of 6.0%, and the thus obtained liquid was supplied to a toner composition fluid storage vessel 35 disposed in the toner production apparatus shown in FIG. 1 using the droplet generating unit shown in FIG. 2. The plate having ejection holes for use here was prepared in a manner such that a nickel plate having a thickness of 20 μm was subjected to a removal processing using femtosecond laser in accordance with a mask reduction projection method to thereby form ten ejection holes, each of which was a round outlet having a diameter of 8.0 μm, on a concentric circle. The formed ejection holes were present within an area where is a square having a side length of 0.5 mm on the plate.

After preparing the dispersion liquid, droplets were formed and the formed droplets were dried at the following conditions for toner production, and then the dried droplets were collected by a cyclone so as to obtain particles. 100 parts by mass of the thus obtained particles were added with 0.2 parts by mass of hydrophobic silica (AEROSIL R-972, manufactured by Nippon Aerosil Co., Ltd.), and then mixed by means of Henschel Mixer to thereby yield Yellow Toner 8. Magenta Toner 8 and Cyan Toner 8 were prepared in the same manner respectively using Colorant 2 and Colorant 3.

[Conditions for Toner Production]

Solid contents of the dispersion liquid: 6.0%

Flow rate of the liquid: 40 mL/hr

Flow rate of dry air: Sheath 2.0 L/min., Inner atmospheric air 3.0 L/min.

Temperature inside the apparatus: 27° C. to 28° C.

Dew point temperature: −20° C.

Vibration frequency of the common retention section: 601.0 kHz

Example 9

Yellow Toner 9, Magenta Toner 9, and Cyan Toner 9 were respectively prepared in the same manner as in Example 8, provided that 1 g of each of Colorants 1-3 was respectively changed to 3 g of each of Colorants 4-6.

Example 10

Yellow Toner 10, Magenta Toner 10, and Cyan Toner 10 were respectively prepared in the same manner as in Example 8, provided that 1 g of each of Colorants 1-3 was respectively changed to 2 g of each of Colorants 7-9.

Example 11

Yellow Toner 11, Magenta Toner 11, and Cyan Toner 11 were respectively prepared in the same manner as in Example 8, provided that 1 g of each of Colorants 1-3 was respectively changed to 4.5 g of each of Colorants 10-12.

Example 12

Yellow Toner 12, Magenta Toner 12, and Cyan Toner 12 were respectively prepared in the same manner as in Example 8, provided that 1 g of each of Colorants 1-3 was respectively changed to 4 g of each of Colorants 13-15.

Example 13

Yellow Toner 13, Magenta Toner 13, and Cyan Toner 13 were respectively prepared in the same manner as in Example 8, provided that 1 g of each of Colorants 1-3 was respectively changed to 3 g of each of Colorants 16-18.

Example 14

Yellow Toner 14, Magenta Toner 14, and Cyan Toner 14 were respectively prepared in the same manner as in Example 8, provided that no binder resin was used, and 1 g of each of Colorants 1-3 was respectively changed to 100 g of each of Colorants 13-15.

Example 15

Into a mixer equipped with a stirring wing, there were charged 100 g of Polyester 1 as a binder resin, 1 g of Colorant 1, 25 g of the dispersion liquid of the carnauba wax prepared in Example 1, 0.4 g of FTERGENT F100 (manufactured by Neos Company Limited) and 1,000 g of ethyl acetate, and the mixture was stirred for 10 minutes so as to disperse the components. The thus obtained dispersion liquid was filtered by a PTFE filter having a pore size of 0.45 μm, and it was confirmed that all the dispersion liquid was passed through the filter without any clogging.

Figure 9:
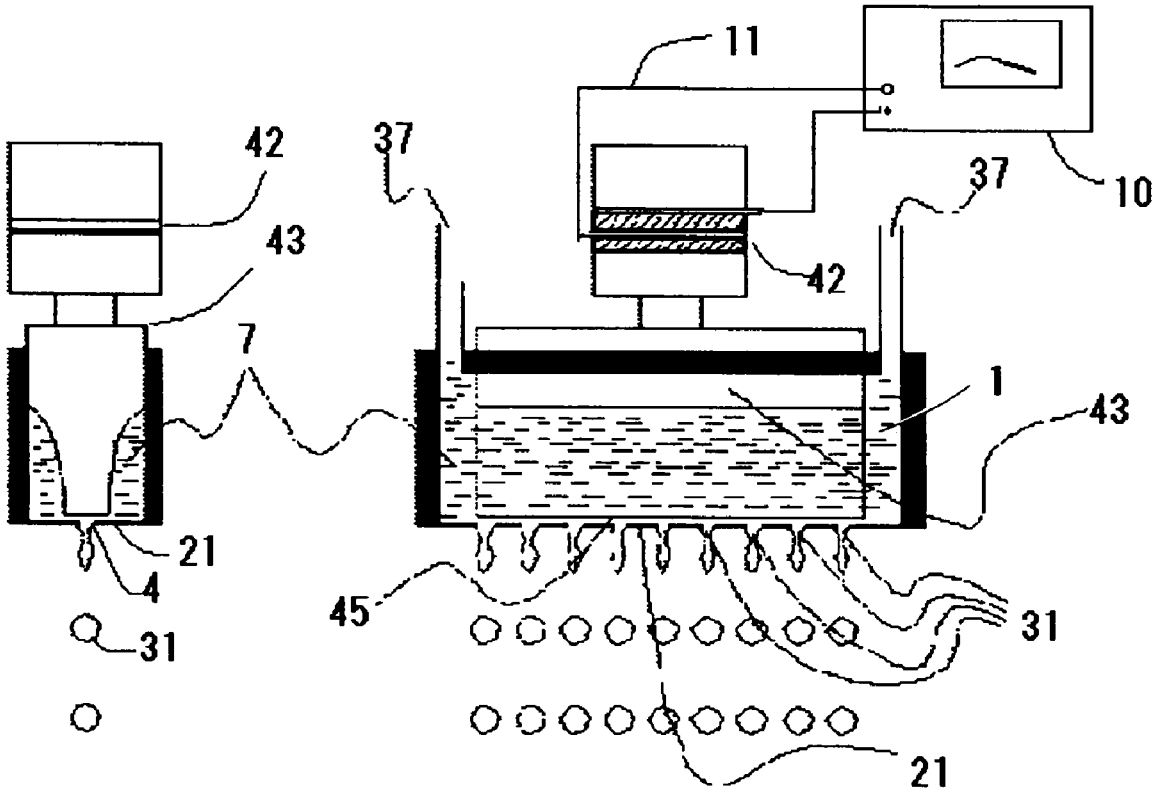
FIG. 9 is a diagram explaining one example of the droplet forming unit for use in the present invention.

The thus obtained dispersion liquid was supplied to the retention section having the configurations shown in FIG. 9. The nozzle plate for use here was a plate processed in accordance with a nickel electrocasting method, and the nozzle plate had circular nozzles each having a diameter of 10 μm disposed in the pattern of cross-woven lattice at a pitch of 100 μm. The nozzles were disposed on the plane which contacts a vibration plane of a transducer.

As the transducer, a Langevin transducer formed by laminating two layers of a piezoelectric material each having a thickness of 7 mm and a diameter of 20 mm was used. The vibration amplifier was the one which has a vibration plane in the shape of rectangle having a long side of 50 mm and short side of 10 mm. In addition, the nozzle plate (film) had maximum amplitude of 4.0 μm.

It was confirmed that $\Delta L_{max}/\Delta L_{min}$ was 1.8. This value was calculated based on the maximum value and the minimum value among the measurements of $\Delta L$ at ten spots at 500 μm intervals in accordance with the Laser Doppler method.

After preparing the dispersion liquid, droplets were formed and the formed droplets were dried at the following conditions for toner production, and then the dried droplets were collected by a cyclone so as to obtain particles. 100 parts by mass of the thus obtained particles were added with 0.2 parts by mass of hydrophobic silica (AEROSIL R-972, manufactured by Nippon Aerosil Co., Ltd.), and then mixed by means of Henschel Mixer to thereby yield Yellow Toner 15. Magenta Toner 15 and Cyan Toner 15 were prepared in the same manner respectively using Colorant 2 and Colorant 3.

[Conditions for Toner Production]

Solid contents of the dispersion liquid: 7.0%

Specific gravity of the dispersion liquid: $\rho$=1.154 g/cm$^3$

Flow rate of dry air: Nitrogen gas for dispersion 2.0 L/min., Dry Nitrogen gas inside the apparatus 30.0 L/min.

Inlet temperature of dry gas: 60° C.

Outlet temperature of dry gas: 45° C.

Dew point temperature: −20° C.

Driving vibration frequency: 40 kHz

Example 16

Yellow Toner 16, Magenta Toner 16, and Cyan Toner 16 were respectively prepared in the same manner as in Example 15, provided that 1 g of each of Colorants 1-3 was respectively changed to 3 g of each of Colorants 4-6.

Example 17

Yellow Toner 17, Magenta Toner 17, and Cyan Toner 17 were respectively prepared in the same manner as in Example 15, provided that 1 g of each of Colorants 1-3 was respectively changed to 2 g of each of Colorants 7-9.

Example 18

Yellow Toner 18, Magenta Toner 18, and Cyan Toner 18 were respectively prepared in the same manner as in Example 15, provided that 1 g of each of Colorants 1-3 was respectively changed to 4.5 g of each of Colorants 10-12.

Example 19

Yellow Toner 19, Magenta Toner 19, and Cyan Toner 19 were respectively prepared in the same manner as in Example 15, provided that 1 g of each of Colorants 1-3 was respectively changed to 4 g of each of Colorants 13-15.

Example 20

Yellow Toner 20, Magenta Toner 20, and Cyan Toner 20 were respectively prepared in the same manner as in Example 15, provided that 1 g of each of Colorants 1-3 was respectively changed to 3 g of each of Colorants 16-18.

Example 21

Yellow Toner 21, Magenta Toner 21, and Cyan Toner 21 were respectively prepared in the same manner as in Example 15, provided that no binder resin was used, and 1 g of each of Colorants 1-3 was respectively changed to 100 g of each of Colorants 13-15.

Example 22

Yellow Toner 22, Magenta Toner 22, and Cyan Toner 22 were respectively prepared in the same manner as in Example 15, provided that the transducer was replaced with the one having a vibration plane in the shape of the rectangle having a long side of 50 mm and a short side of 5 mm, and the vibration frequency was adjusted at 100 kHz.

Example 23

Yellow Toner 23, Magenta Toner 23, and Cyan Toner 23 were respectively prepared in the same manner as in Example 15, provided that the transducer was replaced with a bolting Langevin transducer.

Example 24

Into a mixer equipped with a stirring wing, there were charged 100 g of Polyester 1 as a binder resin, 1 g of Colorant 1, 25 g of the dispersion liquid of the carnauba wax prepared in Example 1, 0.4 g of FTERGENT F100 (manufactured by Neos Company Limited) and 1,000 g of ethyl acetate, and the mixture was stirred for 10 minutes so as to disperse the components. The thus obtained dispersion liquid was filtered by a PTFE filter having a pore size of 0.45 μm, and it was confirmed that all the dispersion liquid was passed through the filter without any clogging.

The thus obtained dispersion liquid was supplied to the retention section having the configurations shown in FIG. 11. The nozzle plate for use here was a nickel plate having an outer diameter of 8.0 mm, and a thickness of 20 μm, and processed in accordance with a nickel electrocasting method so as to have circular nozzles each having a diameter of 10 μm. The ejection holes were disposed in an area where is within an approximately 5 mm from the center of the nozzle plate, in the pattern of cross-woven lattice at a pitch of 100 μm. In this case, the number of the ejection holes valid for the calculation was 1,000. It was confirmed that $\Delta Lmax/\Delta Lmin$ was 1.9.

After preparing the dispersion liquid, droplets were formed and the formed droplets were dried and solidified at the following conditions for toner production so as to obtain base particles for a toner. In order to prevent the collection efficiency of the toner from being lowered as a result of that the charged particles after passed though the nozzle would be attached to the inner wall of the apparatus by static electricity at the time of the collection, the particles were exposed with soft X ray so as to be discharged before the collection. As the soft X-ray exposure device, an explosion-proof photoionizer L9499 manufactured by Hamamatsu Photonics K.K. was used. As a result of that the discharging was performed by the exposure of the soft X-ray, the base particles of the toner were not attached to the inner wall in the collecting section.

The base particles were collected by a cyclone. 100 parts by mass of the thus obtained particles were added with 0.2 parts by mass of hydrophobic silica (AEROSIL R-972, manufactured by Nippon Aerosil Co., Ltd.), and then mixed by means of Henschel Mixer to thereby yield Yellow Toner 24. Magenta Toner 24 and Cyan Toner 24 were prepared in the same manner respectively using Colorant 2 and Colorant 3.

[Conditions for Toner Production]

Specific gravity of the dispersion liquid: $\rho=1.1888$ g/cm$^3$

Flow rate of dry air: Dry Nitrogen gas inside the apparatus 30.0 L/min.

Temperature inside the apparatus: 27° C. to 28° C.

Dew point temperature: −20° C.

Vibration frequency: 98 kHz

Peak of a sine wave of the applied voltage: 20.0V

The pressure applied to the toner composition fluid was calculated based on the results of the measurement of the vibration deviation as mentioned before, and was 20 kPa.

Example 25

Yellow Toner 25, Magenta Toner 25, and Cyan Toner 25 were respectively prepared in the same manner as in Example 24, provided that 1 g of each of Colorants 1-3 was respectively changed to 3 g of each of Colorants 4-6.

Example 26

Yellow Toner 26, Magenta Toner 26, and Cyan Toner 26 were respectively prepared in the same manner as in Example 24, provided that 1 g of each of Colorants 1-3 was respectively changed to 2 g of each of Colorants 7-9.

Example 27

Yellow Toner 27, Magenta Toner 27, and Cyan Toner 27 were respectively prepared in the same manner as in Example 24, provided that 1 g of each of Colorants 1-3 was respectively changed to 4.5 g of each of Colorants 10-12.

Example 28

Yellow Toner 28, Magenta Toner 28, and Cyan Toner 28 were respectively prepared in the same manner as in Example 24, provided that 1 g of each of Colorants 1-3 was respectively changed to 4 g of each of Colorants 13-15.

Example 29

Yellow Toner 29, Magenta Toner 29, and Cyan Toner 29 were respectively prepared in the same manner as in Example 24, provided that 1 g of each of Colorants 1-3 was respectively changed to 3 g of each of Colorants 16-18.

Example 30

Yellow Toner 30, Magenta Toner 30, and Cyan Toner 30 were respectively prepared in the same manner as in Example 24, provided that no binder resin was used, and 1 g of each of Colorants 1-3 was respectively changed to 100 g of each of Colorants 13-15.

Example 31

Figure 16:
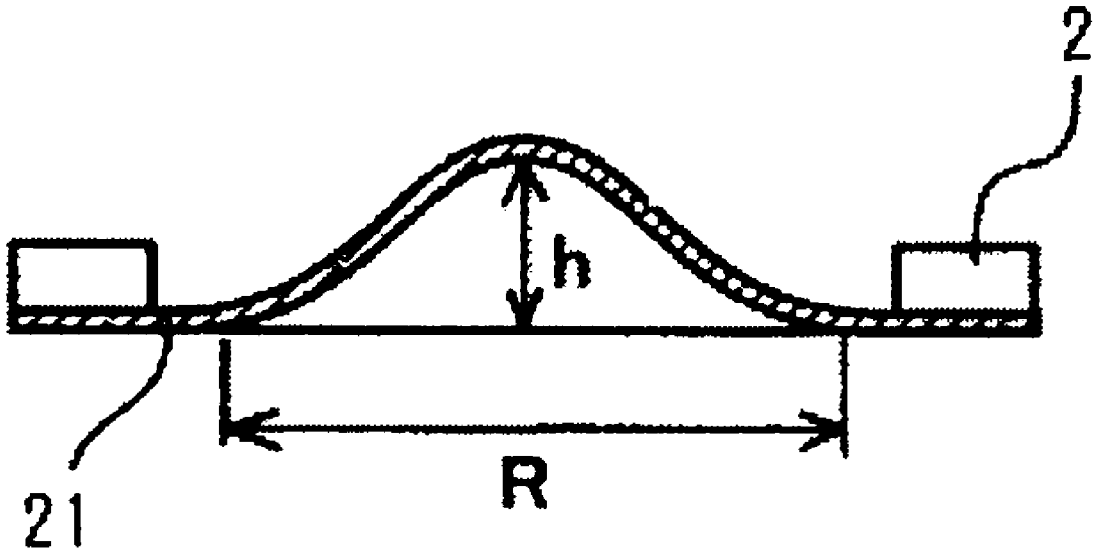
FIG. 16 is a diagram explaining a case where a convex part is formed at a center part of a film.

Yellow Toner 31, Magenta Toner 31, and Cyan Toner 31 were respectively prepared in the same manner as in Example 24, provided that the nozzle plate was replaced with the one having a convex area in the shape of a truncated cone as shown in FIG. 16, and the vibration frequency was adjusted at 103 kHz. The truncated cone shape had the bottom plane diameter R of 4,000 μm and the top plane diameter r of 250 μm.

Comparative Example 1

15 parts by mass of a yellow pigment (Novoperm Yellow P-HG manufactured by Clariant Japan K.K.) and 3 parts by mass of a pigment dispersant were dispersed in 82 parts by mass of ethyl acetate by means of a mixer equipped with a stirring wing so as to prepare a primal dispersion liquid. As the pigment dispersant, AJISPER PB821 manufactured by Ajinomoto Fine-Techno Co., Inc. was used. The thus obtained primal dispersion liquid was further finely dispersed by powerful shearing force by means of Dyno-mill so as to obtain the dispersion liquid from which the aggregations were completely removed. Moreover, the thus obtained dispersion liquid was passed through a PTFE filter having fine pores of 0.45 μm to thereby obtain Pigment Dispersion 1 in which the pigment was dispersed in submicron order.

15 parts by mass of a magenta pigment (Hosterperm Pink E-02 manufactured by Clariant Japan K.K.) and 3 parts by mass of a pigment dispersant were dispersed in 82 parts by mass of ethyl acetate by means of a mixer equipped with a stirring wing so as to prepare a primal dispersion liquid. As the pigment dispersant, AJISPER PB821 manufactured by Ajinomoto Fine-Techno Co., Inc. was used. The thus obtained primal dispersion liquid was further finely dispersed by powerful shearing force by means of Dyno-mill so as to obtain the dispersion liquid from which the aggregations were completely removed. Moreover, the thus obtained dispersion liquid was passed through a PTFE filter having fine pores of 0.45 μm to thereby obtain Pigment Dispersion 2 in which the pigment was dispersed in submicron order.

15 parts by mass of a cyan pigment (LIONOL BLUE FG-7351 manufactured by Toyo Ink Mfg. Co., Ltd.) and 3 parts by mass of a pigment dispersant were dispersed in 82 parts by mass of ethyl acetate by means of a mixer equipped with a stirring wing so as to prepare a primal dispersion liquid. As the pigment dispersant, AJISPER PB821 manufactured by Ajinomoto Fine-Techno Co., Inc. was used. The thus obtained primal dispersion liquid was further finely dispersed by powerful shearing force by means of Dyno-mill so as to obtain the dispersion liquid from which the aggregations were completely removed. Moreover, the thus obtained dispersion liquid was passed through a PTFE filter having fine pores of 0.45 μm to thereby obtain Pigment Dispersion 3 in which the pigment was dispersed in submicron order.

Yellow Toner 32, Magenta Toner 32, and Cyan Toner 32 were respectively prepared in the same manner as in Example 1, provided that 1 g of each of Colorants 1-3 was respectively changed to 40 g of each of Pigment Dispersion 1-3.

Comparative Example 2

Yellow Toner 33, Magenta Toner 33, and Cyan Toner 33 were respectively prepared in the same manner as in Example 1, provided that 1 g of each of Colorants 1-3 was changed to 3 g of each of basic dyes, i.e. 3 g of a yellow dye (Mikketon Polyester Yellow YL, manufactured by Mitsui Chemicals, Inc.), 3 g of a magenta dye (Sumikaron Brilliant Red S-BLF, manufactured by Sumitomo Chemical Co., Ltd.), and 3 g of a cyan dye (Sumikaron Turquoise Blue S-GL, manufactured by Sumitomo Chemical Co., Ltd.).

Comparative Example 3

Yellow Toner 34, Magenta Toner 34, and Cyan Toner 34 were respectively prepared in the same manner as in Example 8, provided that 1 g of each of Colorants 1-3 was respectively changed to 40 g of each of Pigment Dispersions 1-3.

Comparative Example 4

Yellow Toner 35, Magenta Toner 35, and Cyan Toner 35 were respectively prepared in the same manner as in Example 8, provided that 1 g of each of Colorants 1-3 was respectively changed to 3 g of each of basic dyes, i.e. 3 g of a yellow dye (Mikketon Polyester Yellow YL, manufactured by Mitsui Chemicals, Inc.), 3 g of a magenta dye (Sumikaron Brilliant Red S-BLF, manufactured by Sumitomo Chemical Co., Ltd.), and 3 g of a cyan dye (Sumikaron Turquoise Blue S-GL, manufactured by Sumitomo Chemical Co., Ltd.).

Comparative Example 5

Yellow Toner 36, Magenta Toner 36, and Cyan Toner 36 were respectively prepared in the same manner as in Example 15, provided that 1 g of each of Colorants 1-3 was respectively changed to 40 g of each of Pigment Dispersions 1-3.

Comparative Example 6

Yellow Toner 37, Magenta Toner 37, and Cyan Toner 37 were respectively prepared in the same manner as in Example 15, provided that 1 g of each of Colorants 1-3 was respectively changed to 3 g of each of basic dyes, i.e. 3 g of a yellow dye (Mikketon Polyester Yellow YL, manufactured by Mitsui Chemicals, Inc.), 3 g of a magenta dye (Sumikaron Brilliant Red S-BLF, manufactured by Sumitomo Chemical Co., Ltd.), and 3 g of a cyan dye (Sumikaron Turquoise Blue S-GL, manufactured by Sumitomo Chemical Co., Ltd.).

Comparative Example 7

Yellow Toner 38, Magenta Toner 38, and Cyan Toner 38 were respectively prepared in the same manner as in Example 24, provided that 1 g of each of Colorants 1-3 was respectively changed to 40 g of each of Pigment Dispersions 1-3.

Comparative Example 8

Yellow Toner 39, Magenta Toner 39, and Cyan Toner 39 were respectively prepared in the same manner as in Example 24, provided that 1 g of each of Colorants 1-3 was respectively changed to 3 g of each of basic dyes, i.e. 3 g of a yellow dye (Mikketon Polyester Yellow YL, manufactured by Mitsui Chemicals, Inc.), 3 g of a magenta dye (Sumikaron Brilliant Red S-BLF, manufactured by Sumitomo Chemical Co., Ltd.), and 3 g of a cyan dye (Sumikaron Turquoise Blue S-GL, manufactured by Sumitomo Chemical Co., Ltd.).

(Evaluations)

<Productivity>

The toner composition fluid of each toner was subjected to a measurement so as to determine the ejected amount of the droplets at an initial stage, and after the operation of 8 hours. The results are shown in Tables 1-1, 1-2, and 1-3.

<Weight Average Particle Diameter and Particle Size Distribution>

Each toner was subjected to measurements of a weight average particle diameter and a particle size distribution by using COULTER COUNTER TA-II manufactured by Beckman Coulter, Inc. in accordance with a Coulter Counter method. The weight average particle diameter (D4) and number average particle diameter (Dn) of the toner were determined based on the thus obtained particle size distribution.

Moreover, a ratio (D4/Dn) was determined based on the thus obtained weight average particle diameter (D4) and number average particle diameter (Dn) of the toner, and the particle size distribution was evaluated based on the following criteria. The results are shown in Tables 1-1, 1-2 and 1-3.

[Evaluation of Particle Size Distribution (D4/Dn)]

A: D4/Dn is less than 1.05

B: D4/Dn is 1.05 or more, but less than 1.10

C: D4/Dn is 1.10 or more

Preparation of a Developer

Silicone resin was diluted with toluene to thereby obtain silicone resin solution having a solid content of 5%. With respect to the solid content, 3% by mass of an aminosilane coupling agent, i.e. $H_2N(CH_2)_3Si(OC_2H_5)_3$, was added to the silicone resin solution. The thus obtained silicone resin solution was applied to Cu—Zn ferrite particles (F-300, manufactured by Powdertech Co., Ltd.) so as to coat the surface of each particles at 40 g/min. in an atmosphere having a temperature of 100° C. by means of a fluid bed coating device, and the coated particles were further heated at 240° C. for 2 hours to thereby yield carrier wherein each carrier particles has a silicone resin layer of 0.38 μm.

Sequentially, 5 parts by mass of each of thus obtained toner and 95 parts by mass of the thus obtained silicone coated Cupper-Zinc ferrite carrier were added to thereby prepare a developer.

The thus obtained developer was evaluated in terms of fixing quality, image density, image quality, and light fastness in the following manners.

<Image Density, Image Quality and Fixing Quality>

Using each of the thus obtained developer, an image having a 5% chart area and a toner deposition amount of 0.50±0.05 mg/cm$^2$ was formed on a copy paper (TYPE 6000, manufactured by Ricoh Company Limited) by means of a tandem color printer (IPSIO SPC811, manufactured by Ricoh Company Limited), and the thus obtained image was subjected to measurements of image density and coloring performance, and a quality of the image was evaluated with clearness and light fastness.

The image density was measured by means of Spectrodensitometer X-RITE 938 manufactured by X-Rite Inc. under the conditions that $D_{65}$ light source, a view angle of 2 degrees, and status T were used, and evaluated based on the following criteria.

[Evaluation Criteria]

A: 1.4 or more

B: 1.2 or more, but less than 1.4

C: less than 1.2

As the evaluation of the coloring performance, chroma (C*) was measured by means of the same device at the same conditions as mentioned above, and evaluated based on the following criteria.

A: C* is 75 or more

B: C* is 60 or more, but less than 75

C: C* is less than 60

As the evaluation of the clearness, an image was formed on an OHP sheet (TYPE ST, manufactured by Ricoh Company Limited) so as to have a toner deposition amount of 0.50±0.05 mg/cm$^2$ using each toner, and the thus obtained image was subjected to a measurement by means of a direct-reading digital haze computer HGM-2DP manufactured by Suga Test Instruments Co., Ltd.

[Evaluation Criteria]

A: Less than 10%

B: 10% or more, but less than 20%

C: 20% or more

<Light Fastness>

As a sample, a solid image (50 mm×30 mm) formed on copy paper (TYPE 6000, manufactured by Ricoh Company Limited) using each toners and having a toner deposition amount of 0.50±0.05 mg/cm$^2$ was taken, and this image sample was subjected to a light fastness test for 15 hours by means of a light resistance testing device (XW-150, manufactured by Shimadzu Corp.). In this test, a*, b*, L* were measured on the initial image, and the image after being exposed for 15 hours, and ΔE was calculated based on the following formula. The light fastness was evaluated based on the thus obtained ΔE using the evaluation criteria below.

$$\Delta E = \sqrt{(a^*_{Initial} - a^*_{After\ 15\ hours})^2 + (b^*_{Initial} - b^*_{After\ 15\ hours})^2 + (L^*_{Initial} - L^*_{After\ 15\ hours})^2}$$

[Evaluation Criteria]

A: Less than 5

B: 5 or more, but less than 8

C: 8 or more

Note that, with regard to Toners 7, 14, 21 and 30, each image was formed so as to have a toner deposition amount of 0.10±0.05 g/cm$^2$, and then evaluated.

TABLE 1-1

| | | Productivity | | D4 (μm) | | Distribution | | Image | | | Light |
|---|---|---|---|---|---|---|---|---|---|---|---|
| | | Init | 8 hours | Init | 8 hours | Init | 8 hours | density | Coloring | Clearness | fastness |
| Toner 1 | Y | 0.7 | 0.7 | 4.9 | 5.0 | A | A | A | A | A | A |
| | M | 0.7 | 0.7 | 4.9 | 5.1 | A | A | A | A | A | B |
| | C | 0.7 | 0.7 | 5.0 | 5.0 | A | A | A | A | A | A |
| Toner 2 | Y | 0.7 | 0.7 | 5.0 | 5.0 | A | A | A | A | A | A |
| | M | 0.7 | 0.7 | 5.1 | 4.9 | A | A | A | A | A | B |
| | C | 0.7 | 0.7 | 5.1 | 4.9 | A | A | A | A | A | A |
| Toner 3 | Y | 0.7 | 0.7 | 5.1 | 5.1 | A | A | A | A | A | A |
| | M | 0.7 | 0.7 | 4.9 | 5.1 | A | A | A | A | A | B |
| | C | 0.7 | 0.7 | 4.9 | 5.0 | A | A | A | A | A | A |
| Toner 4 | Y | 0.7 | 0.7 | 5.0 | 5.0 | A | A | A | A | A | A |
| | M | 0.7 | 0.7 | 5.0 | 4.9 | A | A | A | A | A | B |
| | C | 0.7 | 0.7 | 5.0 | 4.9 | A | A | A | A | A | A |

TABLE 1-1-continued

| | | Productivity | | D4 (μm) | | Distribution | | Image | | | Light |
|---|---|---|---|---|---|---|---|---|---|---|---|
| | | Init | 8 hours | Init | 8 hours | Init | 8 hours | density | Coloring | Clearness | fastness |
| Toner 5 | Y | 0.7 | 0.7 | 5.1 | 4.9 | A | A | A | A | A | A |
| | M | 0.7 | 0.7 | 5.1 | 5.1 | A | A | A | A | A | B |
| | C | 0.7 | 0.7 | 4.9 | 5.1 | A | A | A | A | A | A |
| Toner 6 | Y | 0.7 | 0.7 | 4.9 | 5.0 | A | A | A | A | A | A |
| | M | 0.7 | 0.7 | 5.0 | 5.0 | A | A | A | A | A | B |
| | C | 0.7 | 0.7 | 5.0 | 4.9 | A | A | A | A | A | A |
| Toner 7 | Y | 0.7 | 0.7 | 5.0 | 4.9 | A | A | A | A | A | A |
| | M | 0.7 | 0.7 | 5.1 | 4.8 | A | A | A | A | A | B |
| | C | 0.7 | 0.7 | 5.1 | 5.1 | A | A | A | A | A | A |
| Toner 8 | Y | 0.7 | 0.7 | 4.9 | 5.1 | A | A | A | A | A | A |
| | M | 0.7 | 0.7 | 4.9 | 5.0 | A | A | A | A | A | B |
| | C | 0.7 | 0.7 | 4.9 | 5.0 | A | A | A | A | A | A |
| Toner 9 | Y | 0.7 | 0.7 | 5.0 | 4.9 | A | A | A | A | A | A |
| | M | 0.7 | 0.7 | 5.0 | 4.9 | A | A | A | A | A | B |
| | C | 0.7 | 0.7 | 5.1 | 4.8 | A | A | A | A | A | A |
| Toner 10 | Y | 0.7 | 0.7 | 5.1 | 5.1 | A | A | A | A | A | A |
| | M | 0.7 | 0.7 | 4.9 | 5.1 | A | A | A | A | A | B |
| | C | 0.7 | 0.7 | 4.9 | 5.0 | A | A | A | A | A | A |
| Toner 11 | Y | 0.7 | 0.7 | 4.9 | 5.0 | A | A | A | A | A | A |
| | M | 0.7 | 0.7 | 5.0 | 4.9 | A | A | A | A | A | B |
| | C | 0.7 | 0.7 | 5.0 | 4.9 | A | A | A | A | A | A |
| Toner 12 | Y | 0.7 | 0.7 | 5.1 | 4.8 | A | A | A | A | A | A |
| | M | 0.7 | 0.7 | 5.1 | 5.1 | A | A | A | A | A | B |
| | C | 0.7 | 0.7 | 4.8 | 5.1 | A | A | A | A | A | A |
| Toner 13 | Y | 0.7 | 0.7 | 4.9 | 5.0 | A | A | A | A | A | A |
| | M | 0.7 | 0.7 | 4.9 | 5.0 | A | A | A | A | A | B |
| | C | 0.7 | 0.7 | 5.0 | 4.9 | A | A | A | A | A | A |
| Toner 14 | Y | 0.7 | 0.7 | 5.0 | 4.9 | A | A | A | A | A | A |
| | M | 0.7 | 0.7 | 5.1 | 4.8 | A | A | A | A | A | B |
| | C | 0.7 | 0.7 | 5.1 | 5.1 | A | A | A | A | A | A |

TABLE 1-2

| | | Productivity | | D4 (μm) | | Distribution | | Image | | | Light |
|---|---|---|---|---|---|---|---|---|---|---|---|
| | | Init | 8 hours | Init | 8 hours | Init | 8 hours | density | Coloring | Clearness | fastness |
| Toner 15 | Y | 2300 | 2300 | 4.8 | 5.1 | A | A | A | A | A | A |
| | M | 2300 | 2300 | 4.9 | 5.0 | A | A | A | A | A | B |
| | C | 2300 | 2300 | 4.9 | 5.0 | A | A | A | A | A | A |
| Toner 16 | Y | 2300 | 2300 | 5.0 | 4.9 | A | A | A | A | A | A |
| | M | 2300 | 2300 | 5.0 | 4.9 | A | A | A | A | A | B |
| | C | 2300 | 2300 | 5.1 | 5.1 | A | A | A | A | A | A |
| Toner 17 | Y | 2300 | 2300 | 5.1 | 5.1 | A | A | A | A | A | A |
| | M | 2300 | 2300 | 4.8 | 5.0 | A | A | A | A | A | B |
| | C | 2300 | 2300 | 4.9 | 5.0 | A | A | A | A | A | A |
| Toner 18 | Y | 2300 | 2300 | 4.9 | 5.0 | A | A | A | A | A | A |
| | M | 2300 | 2300 | 5.0 | 4.9 | A | A | A | A | A | B |
| | C | 2300 | 2300 | 5.0 | 4.9 | A | A | A | A | A | A |
| Toner 19 | Y | 2300 | 2300 | 5.1 | 5.1 | A | A | A | A | A | A |
| | M | 2300 | 2300 | 5.1 | 5.1 | A | A | A | A | A | B |
| | C | 2300 | 2300 | 4.8 | 5.0 | A | A | A | A | A | A |
| Toner 20 | Y | 2300 | 2300 | 4.9 | 5.0 | A | A | A | A | A | A |
| | M | 2300 | 2300 | 4.9 | 4.9 | A | A | A | A | A | B |
| | C | 2300 | 2300 | 5.0 | 4.9 | A | A | A | A | A | A |
| Toner 21 | Y | 2300 | 2300 | 5.0 | 4.8 | A | A | A | A | A | A |
| | M | 2300 | 2300 | 5.1 | 5.1 | A | A | A | A | A | B |
| | C | 2300 | 2300 | 5.1 | 5.1 | A | A | A | A | A | A |
| Toner 22 | Y | 2000 | 2000 | 4.8 | 5.0 | A | A | A | A | A | A |
| | M | 2000 | 2000 | 4.9 | 5.0 | A | A | A | A | A | B |
| | C | 2000 | 2000 | 4.9 | 4.9 | A | A | A | A | A | A |
| Toner 23 | Y | 2350 | 2350 | 5.0 | 4.9 | A | A | A | A | A | A |
| | M | 2350 | 2350 | 5.0 | 4.8 | A | A | A | A | A | B |
| | C | 2350 | 2350 | 5.1 | 5.1 | A | A | A | A | A | A |
| Toner 24 | Y | 2.1 | 2.1 | 5.1 | 5.1 | A | A | A | A | A | A |
| | M | 2.1 | 2.1 | 4.8 | 5.0 | A | A | A | A | A | B |
| | C | 2.1 | 2.1 | 4.9 | 5.0 | A | A | A | A | A | A |
| Toner 25 | Y | 2.1 | 2.1 | 4.9 | 4.9 | A | A | A | A | A | A |
| | M | 2.1 | 2.1 | 5.0 | 4.9 | A | A | A | A | A | B |
| | C | 2.1 | 2.1 | 5.0 | 4.8 | A | A | A | A | A | A |
| Toner 26 | Y | 2.1 | 2.1 | 5.1 | 5.1 | A | A | A | A | A | A |
| | M | 2.1 | 2.1 | 5.1 | 5.1 | A | A | A | A | A | B |
| | C | 2.1 | 2.1 | 4.8 | 5.0 | A | A | A | A | A | A |

TABLE 1-2-continued

| | | Productivity | | D4 (μm) | | Distribution | | Image | | | Light |
|---|---|---|---|---|---|---|---|---|---|---|---|
| | | Init | 8 hours | Init | 8 hours | Init | 8 hours | density | Coloring | Clearness | fastness |
| Toner 27 | Y | 2.1 | 2.1 | 4.9 | 5.0 | A | A | A | A | A | A |
| | M | 2.1 | 2.1 | 4.9 | 4.9 | A | A | A | A | A | B |
| | C | 2.1 | 2.1 | 5.0 | 4.9 | A | A | A | A | A | A |
| Toner 28 | Y | 2.1 | 2.1 | 5.0 | 4.8 | A | A | A | A | A | A |
| | M | 2.1 | 2.1 | 5.1 | 5.1 | A | A | A | A | A | B |
| | C | 2.1 | 2.1 | 5.1 | 5.1 | A | A | A | A | A | A |
| Toner 29 | Y | 2.1 | 2.1 | 4.8 | 5.0 | A | A | A | A | A | A |
| | M | 2.1 | 2.1 | 4.9 | 5.0 | A | A | A | A | A | B |
| | C | 2.1 | 2.1 | 4.9 | 4.9 | A | A | A | A | A | A |
| Toner 30 | Y | 2.1 | 2.1 | 5.0 | 4.9 | A | A | A | A | A | A |
| | M | 2.1 | 2.1 | 5.0 | 4.8 | A | A | A | A | A | B |
| | C | 2.1 | 2.1 | 5.1 | 5.1 | A | A | A | A | A | A |

TABLE 1-3

| | | Productivity | | D4 (μm) | | Distribution | | Image | | | Light |
|---|---|---|---|---|---|---|---|---|---|---|---|
| | | Init | 8 hours | Init | 8 hours | Init | 8 hours | density | Coloring | Clearness | fastness |
| Toner 31 | Y | 10.3 | 10.3 | 5.1 | 5.1 | A | A | A | A | A | A |
| | M | 10.3 | 10.3 | 4.8 | 5.0 | A | A | A | A | A | B |
| | C | 10.3 | 10.3 | 4.9 | 5.0 | A | A | A | A | A | A |
| Toner 32 | Y | 0.7 | 0.7 | 4.9 | 5.4 | A | C | A | C | C | A |
| | M | 0.7 | 0.7 | 5.0 | 5.7 | A | B | A | C | C | A |
| | C | 0.7 | 0.7 | 5.0 | 5.3 | A | B | A | B | B | A |
| Toner 33 | Y | 0.7 | 0.7 | 5.1 | 5.1 | A | A | A | A | A | C |
| | M | 0.7 | 0.7 | 5.1 | 5.0 | A | A | A | A | A | C |
| | C | 0.7 | 0.7 | 4.8 | 5.0 | A | A | A | A | A | C |
| Toner 34 | Y | 0.7 | 0.7 | 4.9 | 5.6 | A | C | A | C | C | A |
| | M | 0.7 | 0.7 | 4.9 | 5.5 | A | B | A | C | C | A |
| | C | 0.7 | 0.7 | 5.0 | 5.5 | A | B | A | B | B | A |
| Toner 35 | Y | 0.7 | 0.7 | 5.0 | 5.1 | A | A | A | A | A | C |
| | M | 0.7 | 0.7 | 5.1 | 5.1 | A | A | A | A | A | C |
| | C | 0.7 | 0.7 | 5.1 | 5.0 | A | A | A | A | A | C |
| Toner 36 | Y | 2300 | 1450 | 4.8 | 4.6 | A | B | A | B | B | A |
| | M | 2300 | 1380 | 4.9 | 4.5 | A | B | A | B | B | A |
| | C | 2300 | 1550 | 4.9 | 4.8 | A | B | A | B | B | A |
| Toner 37 | Y | 2300 | 2300 | 5.0 | 4.8 | A | A | A | A | A | C |
| | M | 2300 | 2300 | 5.0 | 5.1 | A | A | A | A | A | C |
| | C | 2300 | 2300 | 5.1 | 5.1 | A | A | A | A | A | C |
| Toner 38 | Y | 2.1 | 1.4 | 5.1 | 4.7 | A | B | A | B | B | A |
| | M | 2.1 | 1.3 | 5.1 | 4.5 | A | B | A | B | B | A |
| | C | 2.1 | 1.5 | 4.9 | 4.8 | A | B | A | B | B | A |
| Toner 39 | Y | 2.1 | 2.1 | 4.9 | 4.9 | A | A | A | A | A | C |
| | M | 2.1 | 2.1 | 5.0 | 4.8 | A | A | A | A | A | C |
| | C | 2.1 | 2.1 | 5.0 | 5.1 | A | A | A | A | A | C |

In the tables above, "Distribution" denotes a particle size distribution, "Init" denotes an initial image, "8 hours" denotes an image after being exposed for 8 hours, and the unit for "Productivity" is g/min.

From the results shown in Tables 1-1, 1-2 and 1-3, it was found that, by using the certain colorant in the present invention, the toner having not particle size variation with time and the images having high clearness and color tone were obtained as shown with the results of Toners 32 and 34 in the Rayliegh method represented by Examples 1 and 8. Moreover, in the film vibration method represented by Examples 15 and 24, images having high clearness and color tone were obtained without lowering the productivity as shown with the results of Toners 36 and 38. By using the certain colorant in the present invention, the toner having no problem of the color fading due to the light for the practical use can be obtained, whereas the dye-colorant having the similar effects to the colorant for use in the present invention on the particle size change and prevention for lowering the productivity, had the problems of color fading due to the light as shown with the results of Toners 33, 35, 37, and 39.

The method for producing a toner and apparatus for producing a toner of the present invention are capable of efficiently producing a toner, and producing the toner having a monodispersity at the degree which has never been seen in the related art, and the resulted toner is suitably used as a developer for developing a latent electrostatic image in electrophotography, latent electrostatic recording, latent electrostatic printing and the like.

Moreover, the toner of the present invention is suitably used for developing a latent electrostatic image in electrophotography, latent electrostatic recording, latent electrostatic printing and the like, as the toner of the present invention is capable of stably forming a color image of high image quality and high standard regardless of environment and time.

What is claimed is:

1. A toner for developing a latent electrostatic image, obtained by the method comprising:

ejecting a toner composition fluid from an ejection hole so as to make the toner composition fluid into droplets; and solidifying the droplets in an atomizing space so as to form solid particles, wherein the toner composition fluid comprises at least a colorant formed by reacting a polymer containing 10 mol % or more of a monomer unit having a sulfonic acid group or a salt thereof, or a monomer unit having a sulfuric acid group or a salt thereof as a constitutional unit, and a basic dye.

2. The toner according to claim 1, wherein the toner composition fluid comprises an organic solvent dissolving at least the colorant.

3. The toner according to claim 2, wherein a content of the colorant in the toner composition fluid is 5 parts by mass to 98 parts by mass with respect to 100 parts by mass of a solids content of the toner composition fluid.

4. The toner according to claim 1, wherein the monomer unit having a sulfonic acid group or the salt thereof, or the unit monomer unit having a sulfuric acid group or the salt thereof as the constitutional unit is at least one selected from the group consisting of 2-(meth)acrylamide-2-methylpropane sulfonic acid, a salt thereof, styrene sulfonic acid, and a salt thereof.

5. The toner according to claim 1, wherein the polymer comprises 10 mol % or more of a monomer unit at least one selected from the group consisting of 2-(meth)acrylamide-2-methylpropane sulfonic acid, a salt thereof, styrene sulfonic acid, and a salt thereof, and an alkyl (meth)acrylate monomer unit, as the constitutional unit.

6. The toner according to claim 1, wherein the toner has a weight average particle diameter of 1 μm to 6 μm, and a ratio D4/Dn of the weight average particle diameter D4 to a number average particle diameter Dn of 1.00 to 1.10.

7. A method for producing a toner, comprising:

ejecting a toner composition fluid from an ejection hole so as to make the toner composition fluid into droplets; and solidifying the droplets in an atomizing space so as to form solid particles, wherein the toner composition fluid comprises at least a colorant formed by reacting a polymer containing 10 mol % or more of a monomer unit having a sulfonic acid group or a salt thereof, or a monomer unit having a sulfuric acid group or a salt thereof as a constitutional unit, and a basic dye.

8. The method for producing a toner according to claim 7, wherein the ejecting is performed by vibrating a nozzle plate having the ejection hole and applying a pressure to the toner composition fluid, so as to continuously eject the toner composition fluid from the ejection hole to thereby from the droplets.

9. The method for producing a toner according to claim 8, wherein a vibration frequency of the nozzle plate is 50 kHz or more, but less than 50 MHz.

10. The method for producing a toner according to claim 8, wherein the nozzle plate is disposed in a retention section configured to retain the toner composition fluid, and the nozzle plate is vibrated by vibrating the retention section.

11. The method for producing a toner according to claim 7, wherein the ejecting is carried out by means of a droplet forming unit which contains a nozzle plate having a plurality of the ejection holes formed thereon, and a vibration unit containing a transducer which is configured to generate vibration, a vibration amplifier configured to amplify the vibration generated by the transducer, and a vibration plane disposed opposite to and parallel to the nozzle plate, and wherein the ejecting is to periodically eject the toner composition fluid supplied between the nozzle plate and the vibration plane from the ejection holes so as to periodically form and release the droplets.

12. The method for producing the toner according to claim 7, wherein the ejecting is carried out by means of a droplet forming unit which contains a nozzle plate on which a plurality of the ejection holes are formed, and a circular ring vibration unit disposed in an area surrounding an area of the nozzle plate where the nozzle plate is deformable, and configured to vibrate the nozzle plate, and wherein the ejecting is to periodically eject the toner composition fluid from the ejection holes so as to periodically form and release the droplets.

13. A developer comprising:

a toner; and a carrier, wherein the toner is formed by a method comprising:

ejecting a toner composition fluid from an ejection hole so as to make the toner composition fluid into droplets; and solidifying the droplets in an atomizing space so as to form solid particles, wherein the toner composition fluid comprises at least a colorant formed by reacting a polymer containing 10 mol % or more of a monomer unit having a sulfonic acid group or a salt thereof, or a monomer unit having a sulfuric acid group or a salt thereof as a constitutional unit, and a basic dye.

* * * * *